US012760432B2

(12) United States Patent
Zhang et al.

(10) Patent No.: US 12,760,432 B2
(45) Date of Patent: Oct. 13, 2026

(54) ARTICLES, SYSTEMS, AND METHODS FOR ELECTROCHEMICALLY GENERATING CHEMICAL PRODUCTS

(71) Applicant: Phase Two Chemicals Inc., Lowell, MA (US)

(72) Inventors: Mengqi Zhang, Shaoxing (CN); Ming Qi, Cambridge, MA (US); Jon Owejan, Honeoye, NY (US); Steven Goebel, Victor, NY (US); Alan Pezeshki, Dracut, MA (US)

(73) Assignee: Phase Two Chemicals Inc., Lowell, MA (US)

( * ) Notice: Subject to any disclaimer, the term of this patent is extended or adjusted under 35 U.S.C. 154(b) by 672 days.

(21) Appl. No.: 18/365,901

(22) Filed: Aug. 4, 2023

(65) Prior Publication Data

US 2025/0043447 A1 Feb. 6, 2025

(51) Int. Cl.
*C25B 11/052* (2021.01)
*C25B 1/30* (2006.01)
(Continued)

(52) U.S. Cl.
CPC ..... *C25B 11/052* (2021.01); *C25B 1/30* (2013.01); *C25B 11/056* (2021.01); *C25B 11/065* (2021.01)

(58) Field of Classification Search
CPC ..... C25B 1/30; C25B 11/031; C25B 11/052; C25B 11/056
See application file for complete search history.

(56) References Cited

U.S. PATENT DOCUMENTS 1,144,271 A 6/1915 Weber
3,969,201 A 7/1976 Oloman et al.
(Continued)

FOREIGN PATENT DOCUMENTS

CN 110040789 A 7/2019
CN 110136969 A 8/2019
(Continued)

OTHER PUBLICATIONS

International Search Report and Written Opinion for International Application No. PCT/US2024/040779 dated Dec. 6, 2024.
(Continued)

*Primary Examiner* — Hosung Chung
(74) *Attorney, Agent, or Firm* — Wolf, Greenfield & Sacks, P.C.

(57) ABSTRACT

Some aspects of the present disclosure are generally directed to systems for electrochemically generating compounds, for example, for generating hydrogen peroxide or other applications. In some cases, the systems may include electrodes containing a substrate comprising non-woven fibers comprising carbon, PTFE particles on the substrate, and/or an active material, for example, carbon particles, on the substrate and/or the PTFE. In some embodiments, the systems may generate and/or flow a two-phase solution over and/or through at least a portion of an electrode. Some systems using the electrode structures and/or two-phase solution may promote the formation of three-phase boundaries, and thus may facilitate the electrocatalytic generation of certain compounds at the three-phase boundaries. Still other aspects are directed to methods of making and/or using the systems, or the like.

14 Claims, 27 Drawing Sheets

(51) Int. Cl.
*C25B 11/056* (2021.01)
*C25B 11/065* (2021.01)

(56) References Cited

U.S. PATENT DOCUMENTS

| | | | |
|---|---|---|---|
| 4,319,973 | A | 3/1982 | Porta et al. |
| 4,731,173 | A | 3/1988 | Chiang et al. |
| 5,645,700 | A | 7/1997 | White et al. |
| 5,647,968 | A | 7/1997 | Fraser et al. |
| 6,254,762 | B1 | 7/2001 | Wakita et al. |
| RE41,886 | E | 10/2010 | Marple et al. |
| 8,641,874 | B2 | 2/2014 | Kuiphoff |
| 10,522,842 | B2 | 12/2019 | Qi et al. |
| 11,031,606 | B2 | 6/2021 | Qi et al. |
| 2002/0192383 | A1 | 12/2002 | Lo et al. |
| 2003/0019758 | A1 | 1/2003 | Gopal et al. |
| 2003/0022057 | A1 | 1/2003 | Iwasaki et al. |
| 2006/0180936 | A1 | 8/2006 | Japp et al. |
| 2006/0264321 | A1 | 11/2006 | Fernandez et al. |
| 2012/0028154 | A1 | 2/2012 | Owejan et al. |
| 2016/0211527 | A1 | 7/2016 | Swiegers et al. |
| 2017/0012297 | A1 | 1/2017 | Tanimura et al. |
| 2017/0207464 | A1 | 7/2017 | Gyenge et al. |
| 2017/0226647 | A1 | 8/2017 | Benetton et al. |
| 2018/0019483 | A1 | 1/2018 | Pezeshki et al. |
| 2018/0138534 | A1 | 5/2018 | Jang et al. |
| 2018/0371628 | A1 | 12/2018 | Murayama et al. |
| 2019/0071783 | A1 | 3/2019 | Verdaguer Casadevall et al. |
| 2019/0390354 | A1 | 12/2019 | Frimann |
| 2020/0056298 | A1 | 2/2020 | Voskian et al. |
| 2021/0351401 | A1 | 11/2021 | Liu et al. |
| 2023/0312276 | A1* | 10/2023 | Kawaguchi ..... B65H 1/14 271/109 |
| 2023/0312376 | A1* | 10/2023 | Han ..... C25B 11/032 |
| 2025/0043436 | A1 | 2/2025 | Zhang et al. |
| 2025/0043437 | A1 | 2/2025 | Qi et al. |
| 2025/0043448 | A1 | 2/2025 | Zhang et al. |

FOREIGN PATENT DOCUMENTS

| | | | | |
|---|---|---|---|---|
| CN | 213013123 | U | 4/2021 | |
| CN | 213172616 | U | 5/2021 | |
| CN | 213172619 | U | 5/2021 | |
| CN | 213177652 | U | 5/2021 | |
| CN | 213570775 | U | 6/2021 | |
| CN | 213570777 | U | 6/2021 | |
| CN | 213866436 | U | 8/2021 | |
| FR | 2493878 | A1 | 5/1982 | |
| GB | 1528405 | A * | 10/1978 | ..... C25B 1/30 |
| KR | 20220132348 | A | 9/2022 | |
| WO | WO 1988/003966 | A1 | 6/1988 | |

OTHER PUBLICATIONS

International Preliminary Report for Patentability for International Application No. PCT/US2024/040779 dated Feb. 19, 2026.

[No Author Listed], Analyzing Liquids with the AccuPyc. Application Note 179. Micromeritics. 2025: 2 pages.

Liu et al., Morphological Properties and Electrochemical Performance for Compressed Carbon-fiber Electrodes in Redox Flow Batteries, Journal of the Electrochemical Society, Apr. 2024, vol. 171, No. 4.

Invitation to Pay Additional Fees for International Application No. PCT/US2024/040779 dated Sep. 10, 2024.

[No Author Listed], Isopropyl Alcohol Safety Data Sheet. Millipore Sigma. Jul. 13, 2024. https://www.sigmaaldrich.com/US/en/product/mm/px1830: 12 pages.

Foller et al., Processes for the production of mixtures of caustic soda and hydrogen peroxide via the reduction of oxygen. J Appl Electrochem. Jul. 1995;25:613-27.

Gupta et al., Scale-up of the perforated bipole trickle-bed electrochemical reactor for the generation of alkaline peroxide. J Appl Electrochem. Aug. 2006;36:1133-41.

Pletcher, Electrogenerated Hydrogen Peroxide—From History to New Opportunities. Electrosynthesis. Jan. 1999;4(1): 10 pages.

Yamada et al., Development of Trickle-Bed Electrolyzer for On-Site Electrochemical Production of Hydrogen Peroxide. J Electrochem Soc. 1999;146(7):2587-91.

*U.S. Appl. No. 18/365,934, filed Aug. 4, 2023, Pezeshki.

*U.S. Appl. No. 18/365,956, filed Aug. 4, 2023, Pezeshki.

*U.S. Appl. No. 18/365,962, filed Aug. 4, 2023, Pezeshki.

* cited by examiner

ARTICLES, SYSTEMS, AND METHODS FOR ELECTROCHEMICALLY GENERATING CHEMICAL PRODUCTS

TECHNICAL FIELD

Systems and methods for electrochemically generating compounds, for example, hydrogen peroxide, are generally described.

BACKGROUND

Electrochemical systems are used for a variety of applications, ranging from electrocatalytic chemical generation to energy storage. Many of these electrochemical systems, however, are run at relatively low efficiencies due to side reactions, slow kinetics of the reaction of interest at the relevant electrode structures, and/or slow mass transport inhibiting the rate of the reaction of interest. Moreover, the design of systems and related methods for generating chemicals of interest may not be configured for continuous and efficient operation, for example, due to the generation of precipitates in the system which may poison or otherwise block active sites on the electrode surface and/or cause the electrode pore structure to rupture. Accordingly, improved electrode structures, systems, and methods are needed.

SUMMARY

Systems and methods for electrochemically generating compounds, for example, hydrogen peroxide, are generally described. The subject matter of the present disclosure involves, in some cases, interrelated products, alternative solutions to a particular problem, and/or a plurality of different uses of one or more systems and/or articles.

Some aspects are related to electrodes. In some cases, an electrode, comprises a non-woven substrate including fibers comprising carbon; a first hydrophobic polymer formed on at least a portion of the non-woven substrate; and a catalyst layer comprising a second hydrophobic polymer and an active material comprising carbon, the active material having a surface area of greater than or equal to 5 $m^2/g$ and less than or equal to 5000 $m^2/g$ and formed on at least a portion of the non-woven substrate and/or the first hydrophobic polymer. In some embodiments, an electrode comprises a non-woven substrate including fibers comprising carbon; and a plurality of hydrophobic regions distributed on at least a portion of the non-woven substrate, wherein at least a portion of the plurality is at least partially surrounded by a hydrophilic region. In some embodiments, the first hydrophobic polymer comprises polytetrafluoroethylene (PTFE) particles. In some embodiments, the second hydrophobic polymer comprises polytetrafluoroethylene (PTFE) particles. In some embodiments, the first and/or the second hydrophobic polymer comprises a PTFE powder and/or PTFE micropowder.

In some embodiments, the non-woven substrate has a porosity of at least 0.85. In some embodiments, a thickness of the non-woven substrate is greater than or equal to 0.75 mm. In some embodiments, a thickness of the non-woven substrate is greater than or equal to 2 mm. In some embodiments, the non-woven substrate comprises elemental carbon. In some embodiments, the non-woven substrate comprises carbon felt. In some embodiments, the non-woven substrate is carbon felt. In some embodiments, the average largest cross-sectional dimension of the PTFE particles is no more than 25 microns. In some embodiments, the PTFE particles form the plurality of hydrophobic regions. In some embodiments, the plurality of hydrophobic regions comprises a hydrophobic polymer. In some embodiments, the hydrophobic polymer is PTFE. In some embodiments, the hydrophilic region comprises carbon. In some embodiments, the PTFE particles infiltrate at least 5% of a thickness of the non-woven substrate. In some embodiments, the PTFE particles infiltrate through a thickness of the non-woven substrate. In some embodiments, the first and/or second hydrophobic polymer comprises PTFE from a dispersion and/or emulsion. In some embodiments, the first and/or second hydrophobic polymer comprises a mixture of PTFE powder and/or micropowder and/or PTFE from a dispersion and/or emulsion.

Some aspects are related to systems. In some cases, the system comprises an electrode comprising a non-woven substrate including fibers comprising carbon; and a plurality of hydrophobic regions distributed on at least a portion of the non-woven substrate, wherein at least a portion of the plurality is at least partially surrounded by a hydrophilic region. In some embodiments, the system comprises an electrode comprising a non-woven substrate including fibers comprising carbon; a first hydrophobic polymer formed on at least a portion of the non-woven substrate; and a catalyst layer comprising a second hydrophobic polymer and an active material comprising carbon, the active material having a surface area of greater than or equal to 5 $m^2/g$ and less than or equal to 5000 $m^2/g$ and formed on at least a portion of the non-woven substrate and/or the first hydrophobic polymer. In some embodiments, the electrode is configured to electrogenerate a compound. In some embodiments, the electrode is configured to electrogenerated hydrogen peroxide. In some embodiments, the system is configured to operate at a faradaic efficiency for generating hydrogen peroxide of greater than or equal to 95%.

Some aspects are related to electrodes. In some cases, the electrode comprises a non-woven substrate including fibers comprising carbon; a first hydrophobic polymer formed on at least a portion of the non-woven substrate; and a catalyst layer comprising a second hydrophobic polymer and an active material comprising carbon, wherein the electrode is configured to electrochemically generate hydrogen peroxide at a current density of greater than or equal to 300 $mA/cm^2$ at a voltage of less than or equal to 1.5 V for greater than or equal to 1000 hours when configured in a system comprising greater than or equal to 0.001 M and less than or equal to 4.8 M $OH^-$, greater than or equal to 0.001 M and less than or equal to 2 M $H_2O_2$, and having an average temperature of at least 35 degrees C. In some embodiments, a counterion to the $OH^-$ is an alkali metal. In some embodiments, the counterion to the $OH^-$ is $Na^+$ and/or $K^+$. In some embodiments, a molecular ratio of $OH^+$ to $H_2O_2$ in the system is approximately 2 to 1.

Some aspects are related to methods. In some embodiments, the method comprises mixing a liquid and a gas to form a two-phase solution; flowing the two-phase solution over and/or through at least a portion of an electrode comprising a substrate including non-woven fibers comprising carbon; and applying a voltage to the electrode such that at least a portion of the gas participates in a reaction to electrochemically generate a compound at the electrode. In some embodiments, prior to mixing the liquid and the gas to form the two-phase solution, the gas is passed through a liquid ring compressor. In some embodiments, a hydrophobic polymer and/or a catalyst layer is on the substrate. In some embodiments, the electrode is contained in an electrochemical system having a volume of greater than or equal to 100 $cm^3$, a flow rate of a liquid of the two-phase solution is greater than or equal to 30 mL/min and/or a mass flow rate of a gas of the two-phase solution is greater than or equal to 0.2 slpm.

In some embodiments, the flow rate of a liquid of the two-phase solution is greater than or equal to 200 mL/min and a mass flow rate of a gas of the two-phase solution is greater than or equal to 5 slpm. In some embodiments, the compound is hydrogen peroxide. In some embodiments, the gas comprises oxygen. In some embodiments, the liquid comprises an alkali hydroxide. In some embodiments, the liquid is flowed at a rate of at least 5 mL/min. In some embodiments, the gas is flowed at a mass flow rate of at least 0.5 slpm. In some embodiments, the electrode is a cathode in a system. In some embodiments, the hydrophobic polymer is a first hydrophobic polymer and the catalyst layer comprises a second hydrophobic polymer and/or an active material comprising carbon, and the catalyst layer is formed on at least a portion of the non-woven substrate and/or the first hydrophobic polymer. In some embodiments, the active material has a surface area of greater than or equal to 5 $m^2/g$ and less than or equal to 5000 $m^2/g$. In some embodiments, the first and/or second hydrophobic polymer comprises PTFE particles. In some embodiments, the catalyst layer comprises less than or equal to 0.01 wt % metal.

In another aspect, methods are described. In some cases, the method comprises flowing a solution over at least a portion of a surface area of an electrode in a compartment; electrochemically generating a compound in the solution at the electrode; flowing the solution from the electrode through an outlet of the compartment; and recirculating at least a portion of the solution from the outlet of the compartment to an inlet of the compartment such that the compound is present in solution in an amount of greater than or equal to 0.2 wt %. In some embodiments, the method further comprises flowing the recirculated solution over and/or through at least the portion of the surface area of the electrode. In some embodiments, the method further comprises withdrawing at least a portion of the solution comprising the electrogenerated compound. In some embodiments, the compound is hydrogen peroxide. In some embodiments, the method further comprises at least one gas manifold and at least one liquid manifold, wherein the at least one gas manifold and at least one liquid manifold feeds only one intersection of a gas and liquid inlet within a cathode or anode flow plate and/or flow frame within a cell. In some embodiments, the electrode comprises a substrate including non-woven fibers comprising carbon. In some embodiments, a hydrophobic polymer and/or a catalyst layer is on the substrate. In some embodiments, the electrode is a cathode in a system. In some embodiments, the hydrophobic polymer is a first hydrophobic polymer and the catalyst layer comprises a second hydrophobic polymer and/or an active material comprising carbon, and the catalyst layer is formed on at least a portion of the non-woven substrate and/or the first hydrophobic polymer. In some embodiments, the active material has a surface area of greater than or equal to 5 $m^2/g$ and less than or equal to 5000 $m^2/g$. In some embodiments, the first and/or second hydrophobic polymer comprises PTFE particles. In some embodiments, the catalyst layer comprises less than or equal to 0.01 wt % metal.

Still other aspects are related to methods. In some cases, a method of modifying an electrode comprises providing the electrode comprising a non-woven substrate including fibers comprising carbon; pretreating the electrode by applying a first solution comprising a liquid having a vapor pressure of greater than or equal to 1 kPa and a first hydrophobic polymer to the electrode; and applying a second solution comprising a second hydrophobic polymer and/or PTFE binder and an active material comprising carbon to the electrode. In some embodiments, the liquid in the first solution comprises an organic solvent. In some embodiments, the liquid in the first solution comprises a polar organic solvent. In some embodiments, the liquid in the first solution comprises an alcohol. In some embodiments, the liquid in the first solution comprises isopropyl alcohol. In some embodiments, the second solution comprises water. In some embodiments, the second solution comprises a surfactant. In some embodiments, the non-woven substrate comprises a carbon felt. In some embodiments, the method further comprises heating the electrode. In some embodiments, heating the electrode occurs in an atmosphere having a temperature of greater than or equal to 380 degrees C. In some embodiments, heating the electrode occurs in a non-oxidative atmosphere. In some embodiments, the non-oxidative atmosphere contains less than or equal to 1 wt % oxygen. In some embodiments, heating the electrode occurs in an atmosphere comprising $N_2$ and/or Ar. In some embodiments, the method further comprises repeating the step of pretreating the electrode.

In some embodiments, the liquid in the first solution has a vapor pressure of less than or equal to 30 kPa. In some embodiments, the first hydrophobic polymer comprises polytetrafluoroethylene (PTFE) particles. In some embodiments, the second hydrophobic polymer comprises polytetrafluoroethylene (PTFE) particles. In some embodiments, the polytetrafluoroethylene (PTFE) particles of the first and/or second hydrophobic polymer are from a PTFE powder and/or micropowder.

Some aspects are related to methods. In some cases, the method of electrochemically generating a compound comprises purging an electrode stack by flowing gas through an electrode stack; flowing deionized water through the electrode stack; flowing an electrolyte through the electrode stack for greater than or equal to 1 minute while an absolute magnitude of an applied current is less than or equal to 0.1 $mA/cm^2$; increasing the absolute magnitude of the applied current density by 30 $mA/cm^2$ every 5 minutes until the applied current density reaches at least 150 $mA/cm^2$; electrochemically generating a compound in the electrode stack and heating the electrode stack to at least 35 degrees C. while the applied current remains at least at 150 $mA/cm^2$; and increasing the absolute magnitude of the applied current to at least 300 $mA/cm^2$. In some embodiments, the compound is hydrogen peroxide. In some embodiments, heating the electrode stack comprises joule heating. In some embodiments, heating the electrode stack comprises heating the electrolyte solution. In some embodiments, heating the electrolyte solution comprises joule heating. In some embodiments, heating the electrolyte solution comprises using a resistive heating coil. In some embodiments, heating the electrolyte solution comprises using a heat exchanger. In some embodiments, an average temperature of the electrolyte solution is at least 35 degrees C. when flowing into and/or through the electrode stack. In some embodiments, the absolute magnitude of the applied current density is increased by less than or equal to 10 $mA/cm^2/min$.

In some embodiments, electrochemically generating a compound occurs at an electrode in the electrode stack. In some embodiments, the electrode comprises a substrate including non-woven fibers comprising carbon. In some embodiments, the electrode further comprises a first hydrophobic polymer formed on at least a portion of the substrate. In some embodiments, the electrode further comprises a catalyst layer comprising a second hydrophobic polymer and/or an active material on at least a portion of the substrate. In some embodiments, the first hydrophobic polymer comprises polytetrafluoroethylene (PTFE) particles. In some embodiments, the second hydrophobic polymer comprises polytetrafluoroethylene (PTFE) particles. In some embodiments, the active material comprises carbon. In some embodiments, the active material comprises less than or equal to 0.01 wt % metal. In some embodiments, the substrate comprises a carbon felt.

Some aspects are related to methods. In some cases, the method of shutting down an electrode stack comprises electrochemically generating a compound in the electrode stack; decreasing an absolute magnitude of an applied current to the electrode stack to less than or equal to 0.1 $mA/cm^2$; flowing liquid through the electrode stack for greater than or equal to 1 minute while the absolute magnitude of the applied current less than or equal to 0.1 $mA/cm^2$; flowing gas through the electrode stack to purge the electrode stack of liquid; and optionally flowing deionized (DI) water through the electrode stack. In some embodiments, the gas and the DI water are flowed through the electrode stack at the same time in the form of a two-phase solution.

Some aspects are related to methods. In some cases, the method of cleaning an electrode stack comprises electrochemically generating a compound in the electrode stack; decreasing an absolute magnitude of an applied current to the electrode stack to less than or equal to 0.1 $mA/cm^2$; removing a precipitate from the electrode stack by flowing a solution comprising a reducing agent and/or a chelating agent for less than or equal to 5 minutes; and flowing deionized (DI) water through the electrode stack for greater than or equal to 30 minutes. In some embodiments, the electrode stack is cleaned at least once a year. In some embodiments, the method further comprises flowing a gas through the electrode stack to dry the electrode stack. In some embodiments, the gas and the DI water are flowed through the electrode stack at the same time in the form of a two-phase solution. In some embodiments, prior to flowing through the electrode stack, the gas is passed through a liquid ring compressor. In some embodiments, a lifetime of the electrode stack that is cleaned at least once a year is greater than or equal to 10,000 hours of continuous operation.

In some embodiments, electrochemically generating a compound occurs at an electrode in the electrode stack. In some embodiments, the electrode comprises a substrate including non-woven fibers comprising carbon. In some embodiments, the electrode further comprises a first hydrophobic polymer formed on at least a portion of the substrate. In some embodiments, the electrode further comprises a catalyst layer comprising a second hydrophobic polymer and/or an active material on at least a portion of the substrate. In some embodiments, the first hydrophobic polymer comprises polytetrafluoroethylene (PTFE) particles. In some embodiments, the second hydrophobic polymer comprises polytetrafluoroethylene (PTFE) particles. In some embodiments, the active material comprises carbon. In some embodiments, the active material comprises less than or equal to 0.01 wt % metal. In some embodiments, the substrate comprises a carbon felt. In some embodiments, the reducing agent comprises sodium hydrosulfite, sodium metabisulfite, and/or sodium sulfite. In some embodiments, the chelating agent comprises citric acid.

Other advantages and novel features of the present disclosure will become apparent from the following detailed description of various non-limiting embodiments of the disclosure when considered in conjunction with the accompanying figures. In cases where the present specification and a document incorporated by reference include conflicting and/or inconsistent disclosure, the present specification shall control.

BRIEF DESCRIPTION OF THE DRAWINGS

Non-limiting embodiments of the present disclosure will be described by way of example with reference to the accompanying figures, which are schematic and are not intended to be drawn to scale unless otherwise indicated. In the figures, each identical or nearly identical component illustrated is typically represented by a single numeral. For purposes of clarity, not every component is labeled in every figure, nor is every component of each embodiment of the disclosure shown where illustration is not necessary to allow those of ordinary skill in the art to understand the disclosure. In the figures.

DETAILED DESCRIPTION

Figure 1:
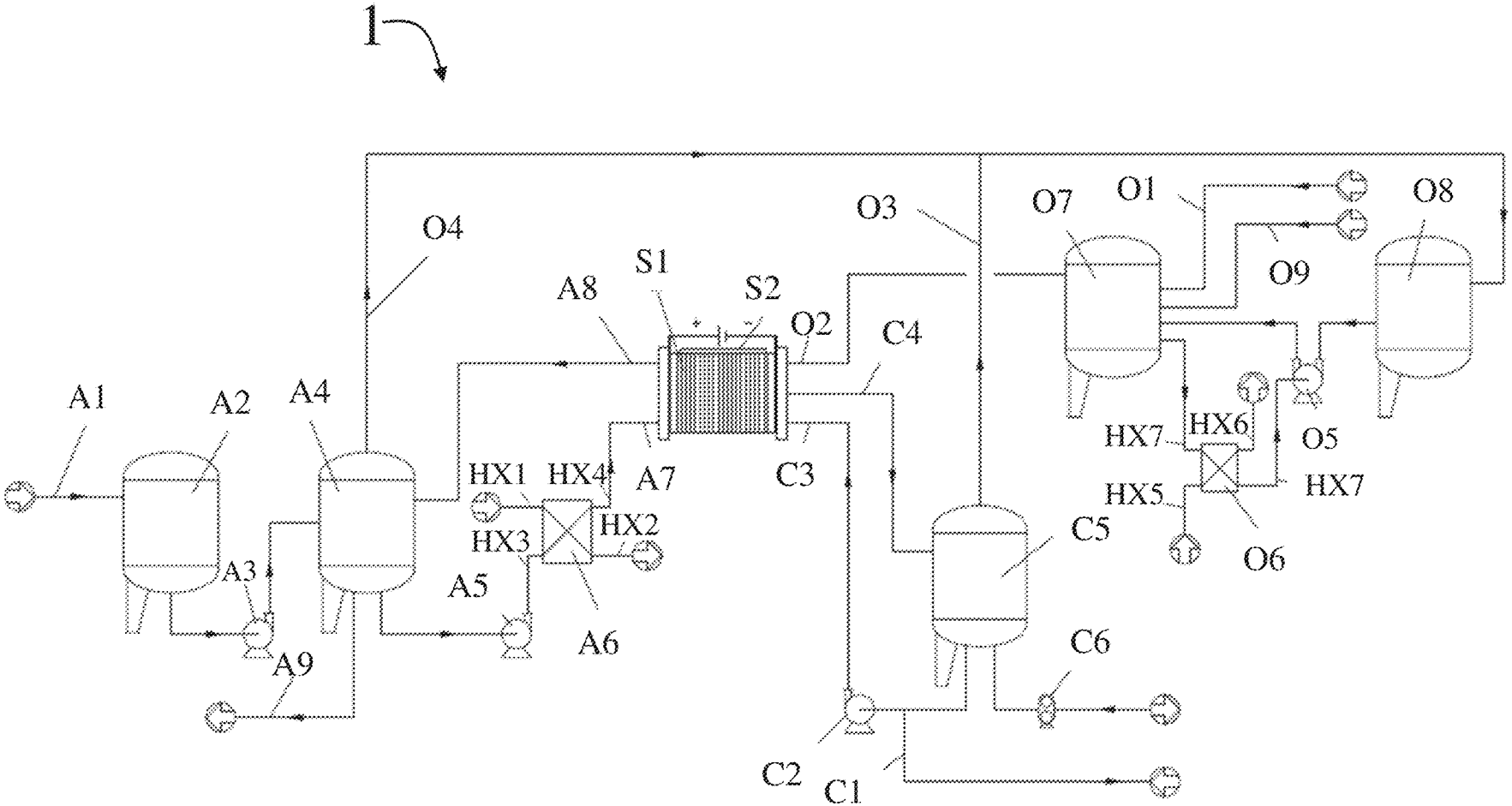
FIG. 1 is a schematic diagram of an electrochemical system, according to some embodiments.

Some aspects of the present disclosure are generally directed to systems for electrochemically generating compounds (e.g., hydrogen peroxide) or other applications. In some cases, the systems may include electrodes containing a substrate comprising non-woven fibers comprising carbon, hydrophobic particles (e.g., PTFE particles) on at least a portion of the substrate, and/or a catalyst layer comprising an active material (e.g., carbon particles) and/or hydrophobic particles on at least a portion of the substrate. In some embodiments, the systems may generate and/or flow a two-phase solution over and/or through at least a portion of an electrode. Some systems using the electrode structures and/or two-phase solution may promote the formation of three-phase boundaries, and thus may facilitate the electrocatalytic generation of certain compounds at the three-phase boundaries. Still other aspects are directed to methods of making and/or using the systems, or the like.

Certain electrocatalytic reactions involve gaseous and liquid reactants, some of which are believed to occur at three-phase boundaries that form between the gaseous reactant, the liquid reactant, and the solid electrode. Accordingly, the formation (e.g., or lack thereof) of such three-phase boundaries may limit the rate at which the electrocatalytic reaction may proceed in conventional systems. Moreover, in some cases, the reaction rate of such reactions in conventional systems may be limited by the mass transport of the reactants to the electrode surface, for example, the gaseous reactant, and thus some reactants may be present in low concentrations at the electrode surface. The reaction rate of such reactions in conventional systems may be limited by the mass transport of reactants away from the electrode surface. Accordingly, some aspects of the present disclosure are related to improved electrodes, systems, and methods for performing electrocatalytic reactions.

Some aspects of the present disclosure are related to systems including electrodes. The electrode, according to some embodiments, may include a substrate having non-woven fibers comprising carbon, hydrophobic particles (e.g., PTFE particles) on at least a portion of the surface of the substrate and/or substrate fibers and/or infiltrating through at least a portion of the thickness of the substrate (e.g., a pretreatment), and a catalyst layer including an active material comprising carbon and/or hydrophobic particles on at least a portion of the substrate. In some cases, the preparation of the electrode may lead to hydrophobic and hydrophilic islands on the substrate of the electrode. For instance, applying hydrophobic particles (e.g., PTFE particles) on at least a portion of the non-woven substrate (e.g., from a pretreatment step) may provide a hydrophobic electrode structure. Thereafter, applying a catalyst layer comprising an active material and/or hydrophobic particles may produce an electrode structure having relatively hydrophilic regions (e.g., the active material) and the relatively hydrophobic regions (e.g., the hydrophobic particles from the pretreatment and/or in the catalyst layer). In some such cases, the presence of hydrophilic and hydrophobic regions may facilitate the formation of three-phase boundaries by having various hydrophilic/hydrophobic interfaces where liquid and gaseous reactants may favorably interact with each other and/or the electrode. Additionally, the relatively open macropore structure of the non-woven fibers may lead to relatively large and accessible surface areas that are available for electrocatalytic reactions. The open macropore structure also promotes effective mass transport with relatively minimal parasitic pressure drop.

In some cases, the system may generate and/or flow a two-phase solution over at least a portion of an electrode. A two-phase solution, as described in more detail elsewhere herein, may increase the concentration and/or amount of gaseous reactants transported to and/or present at the electrode surface, which may promote the formation of three-phase boundaries on an electrode surface. For example, in accordance with some embodiments, the electrodes of the system may be as described above, having a substrate including non-woven fibers comprising carbon, hydrophobic particles on at least a portion of the substrate and/or substrate fibers (e.g., PTFE particles from a pretreatment step), and a catalyst layer containing an active material and/or hydrophobic particles on at least a portion of the substrate. In some such cases, as described elsewhere herein, the substrate may have been pretreated with hydrophobic particles prior to adding the catalyst layer. According to some such embodiments, two-phase solution may be flowed over and/or through at least a portion of the electrode, which may promote three-phase boundaries on the electrode surface. The inventors have recognized in the context of the present disclosure that using such electrodes and/or flowing two-phase solutions may facilitate the electrocatalytic performance for the system (e.g., increase the efficiency of generating hydrogen peroxide or other reactions), for instance, by promoting the formation of three-phase boundaries.

Some aspects of the present disclosure are related to methods. For example, some methods are related to forming and using electrodes. In some cases, the methods are related to forming two-phase solutions for use in electrocatalytic systems. Still other aspects are related to methods involving flowing two-phase solution over electrode structures, which may help to facilitate electrocatalytic reactions, for example, such as electrocatalytically generating hydrogen peroxide or other compounds.

FIG. 1 is a schematic diagram of an exemplary peroxide generator system 1, according to some embodiments. The system 1 contains a stack S1 of electrochemical cells S2 (e.g., one or more pairs of anodes and/or cathodes). The electrode stack S1 includes an anolyte inlet A7, an anode multi-phase fluid outlet A8, a catholyte inlet C3, a cathode gas inlet O2 and cathode multi-phase fluid outlet C4. Although system 1 is described here as a peroxide generator system, it should be understood that the system components, electrode structure, and system configuration can in some instances be used for the electrochemical generation of other chemicals.

An anolyte pump A5 is configured to pump anolyte solution from anolyte reservoir A4 to heat exchanger A6 via inlet HX3. Anolyte solution flows from heat exchanger A6 outlet HX4 to anolyte inlet A7. Cooling water is provided to heat exchanger A6 via inlet HX1 and warm water is discharged from heat exchanger A6 via HX2. The anolyte solution pumped into the one or more anodes of cells S2 may be discharged along with product gas (e.g. oxygen) from the anolyte outlet A8 to the anolyte reservoir A4. From the anolyte reservoir A4, excess solution can be drained through the outlet A9. Fresh reactant solution (e.g. comprising 50 wt % NaOH) may be transferred from a storage tank A2 to anolyte reservoir A4 by pump A3.

A catholyte pump C2 is configured to pump catholyte solution from catholyte reservoir C5 to the catholyte inlet C3. The catholyte and gas pumped into the one or more cathodes of cells S2 of stack S1 may be discharged from the cathode multi-phase fluid outlet C4 to the catholyte reservoir C5 after the one or more cathodes electrogenerate a compound (e.g., $H_2O_2$). From the catholyte reservoir C5, solution containing the compound may be drained via catholyte compound pump C6. Fresh reactant solution (e.g., water) may be delivered to the catholyte reservoir C5 via reactant solution inlet CL. In some embodiments, fresh reactant solution (e.g., water) may be delivered to catholyte inlet C3 via catholyte pump C2.

The catholyte reservoir C5 and anolyte reservoir A4 have vents O3 and O4, respectively. Excess reactant gas (e.g., oxygen) from the headspace of catholyte reservoir C5 and/or product gas (e.g., oxygen) from the headspace of anolyte reservoir A4 may flow to collector O8 via vents O3 and O4. In some embodiments, product gases and/or excess reactant gases and the anode and/or cathode may be divided with their own recirculation loops or external venting. In some embodiments, no gas may be generated at the cathode and/or anode of each electrochemical cell in the electrochemical system. The gas is pumped to reactant reservoir O7 via liquid ring compressor O5. Gas flows from reactant reservoir O7 through cathode gas inlet O2 to the one or more cathodes of cells S2. In the exemplary embodiment shown, the gas flowed into the cells S2 and the catholyte solution flowed into the cells S2 from catholyte reservoir C5 may form a two-phase solution. In some embodiments, the gas flowed into the cells S2 and the anolyte solution flowed into the cells S2 from anolyte reservoir A4 may form a two-phase solution. In accordance with some embodiments, the two-phase solution may be formed within each cell S2 of the stack S1 before flowing through the one or more cathodes and/or the one or more anodes of the system 1. Additional reactant gas may be added through the inlet O1 to reactant reservoir O7. Reactant reservoir O7 contains gas and water. Water flows from reservoir O7 via inlet HX7 to heat exchanger O6 and returns back to reservoir O7 via outlet HX8. Cooling water is provided to heat exchanger O6 via inlet HX5 and warm water is discharged from heat exchanger O6 via HX6. Gas in reactant reservoir O7 may have a relatively high relative humidity (e.g., at least 50%, at least 75%, up to 100%, or the like as described elsewhere herein) after flowing through liquid ring compressor O5.

Generally, reactants are flowed into the system 1 and power is supplied to the system such that electrochemical reactions, e.g., generation of hydrogen peroxide at the cathode, occur within the electrolytic device S1. After the reactant solution flows through the electrode stack S1, the solutions containing electrogenerated compounds from the one or more anodes and/or one or more cathodes flow to the respective reservoirs A4 and C5. In some embodiments, the electrogenerated compound from the one or more cathodes may flow to the catholyte reservoir C5, where a portion of it may be withdrawn via pump C6 and/or recirculated into stack S1. Withdrawn solution, in some cases, may be ready for commercial use, sale, and/or for use in other applications or systems.

Figure 2A:
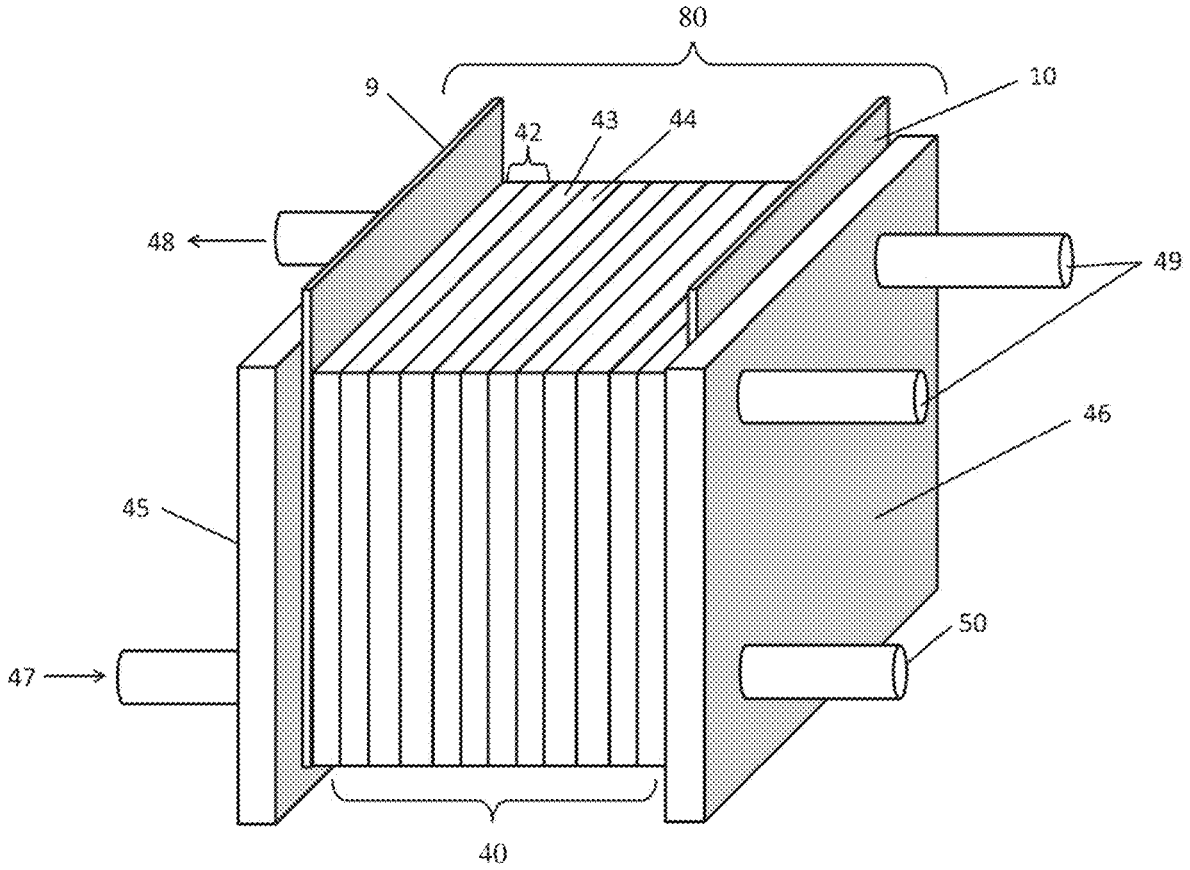
FIG. 2A is a schematic diagram of a component of an electrochemical system, according to some embodiments.

FIG. 2A shows a system 80 comprising electrode stack 40 containing electrochemical cells 42 having anode assemblies 43 and cathode assemblies 44, where at least some of the anode assemblies and cathode assemblies are separated by a separator. The anode assembly comprises an anode electrode material and a flow plate or flow frame which may contain channels and/or passages for delivery of reactants to the anode electrode from internal and/or external manifolds. The cathode assembly comprises a cathode electrode material and a flow plate and/or flow frame which may contain channels and/or passages for delivery of reactant to the cathode electrode from internal and/or external manifolds. The stack 40 of cells 42 may be compressed with plates 45 and 46, while current collectors 9 and 10 may be present to apply voltages and/or currents to the stack 40. Anode inlet 47 and outlet 48, as well as cathode inlet 49 and outlet 50, may be configured to deliver electrolyte solution and/or reactant gases (e.g., the anode inlet and outlet are configured with the anodes and the cathode inlet and outlet are configured with the cathodes) to each electrochemical cell 42 in the stack 40. Each inlet may be configured to deliver two-phase solution, in some cases, to each of the electrochemical cells. In some embodiments, gas inlet ports and liquid inlet ports intersect within the flow plate or flow frames within a cathode or anode assembly upstream of at least one electrode within an electrochemical cell so as to generate the two-phase solution that is flowed through the at least one electrode. For example, two cathode inlets 49 are showed, one for delivering gas and one for delivering liquid, where the gas and liquid are to be mixed to form a two-phase solution within a cathode assembly 44 before being delivered to each cathode electrode within a cathode assembly 44 in the stack 40. In some cases, each cathode and/or anode flow plate and/or flow frame within an electrochemical cell in an electrode stack contains at least one such intersection wherein two-phase solution may be generated to flow over the cathode and/or anode electrode of the electrochemical cell. According to some embodiments, as the embodiment shown in FIG. 2A, only the cathode cells are fluidically connected with such intersections wherein two-phase solution may be generated. Example embodiments of such inlets are shown in FIGS. 3-4.

Figure 2B:
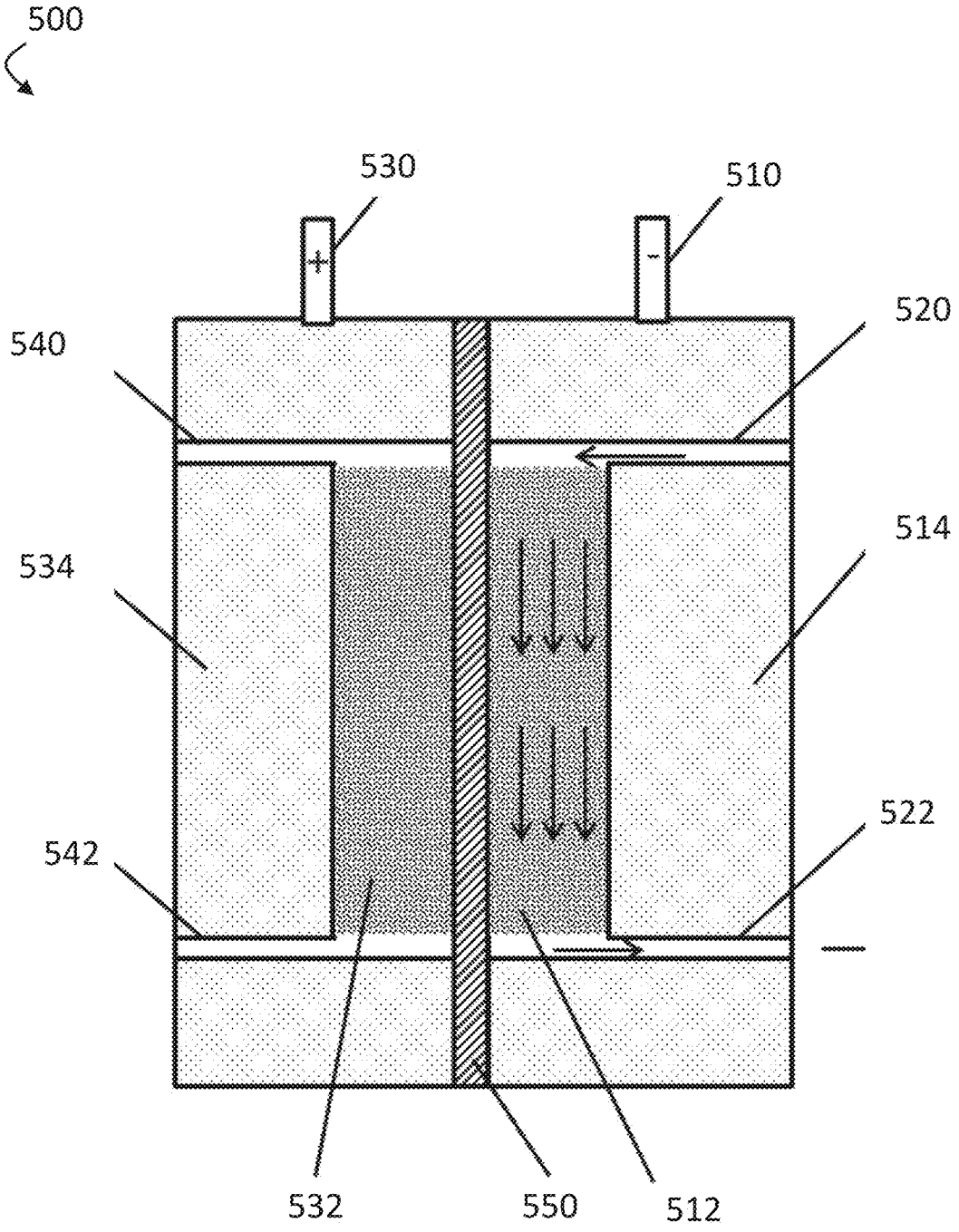
FIG. 2B is a schematic diagram of a component of an electrochemical system, according to some embodiments.

FIG. 2B is a schematic diagram showing a cross-sectional view of an electrochemical cell 500. The diagram shows electrical contacts 510 and 530 to connect to the cathode 514 and anode 534, respectively. Solution flows through the cathode substrate 512 of the electrochemical cell 500, as illustrated with the arrows, from inlet 520 to outlet 522. Solution flows over and/or through anode substrate 532 from anode inlet 540 to anode outlet 542. Additionally, the anode block and the cathode block have a separator 550 separating them, wherein the separator allows for ionic flow therebetween.

Figure 3:
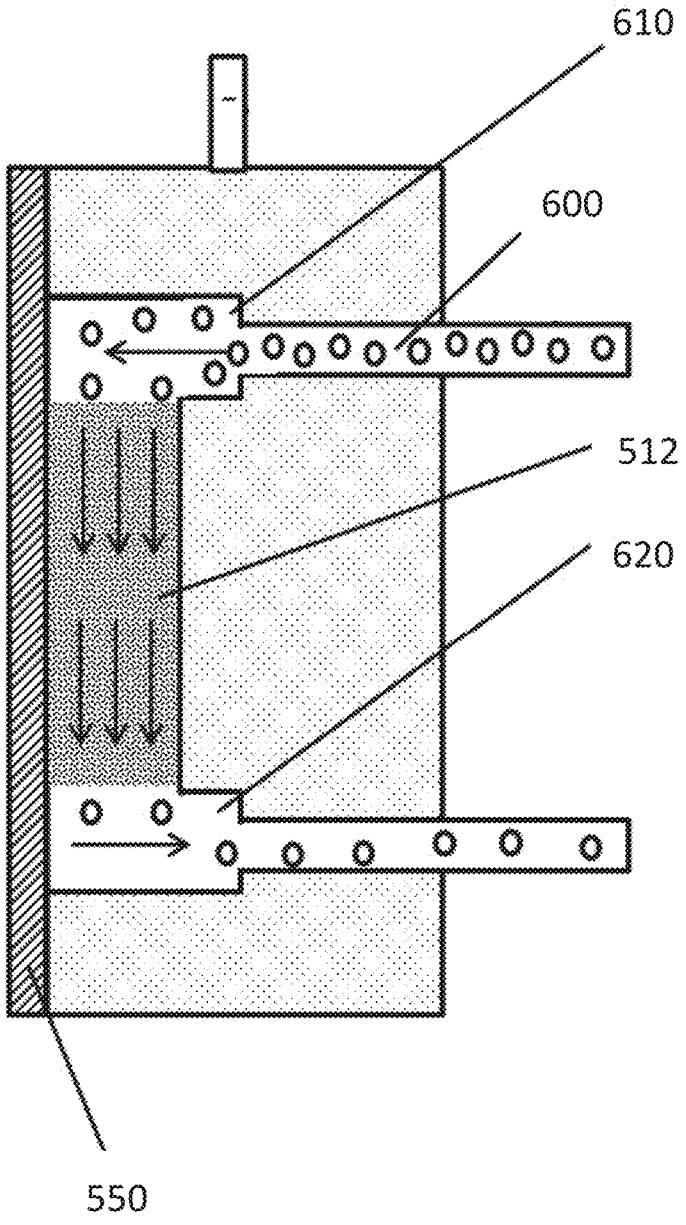
FIG. 3 is a schematic diagram of a component of an electrochemical system, according to some embodiments.
Figure 4A:
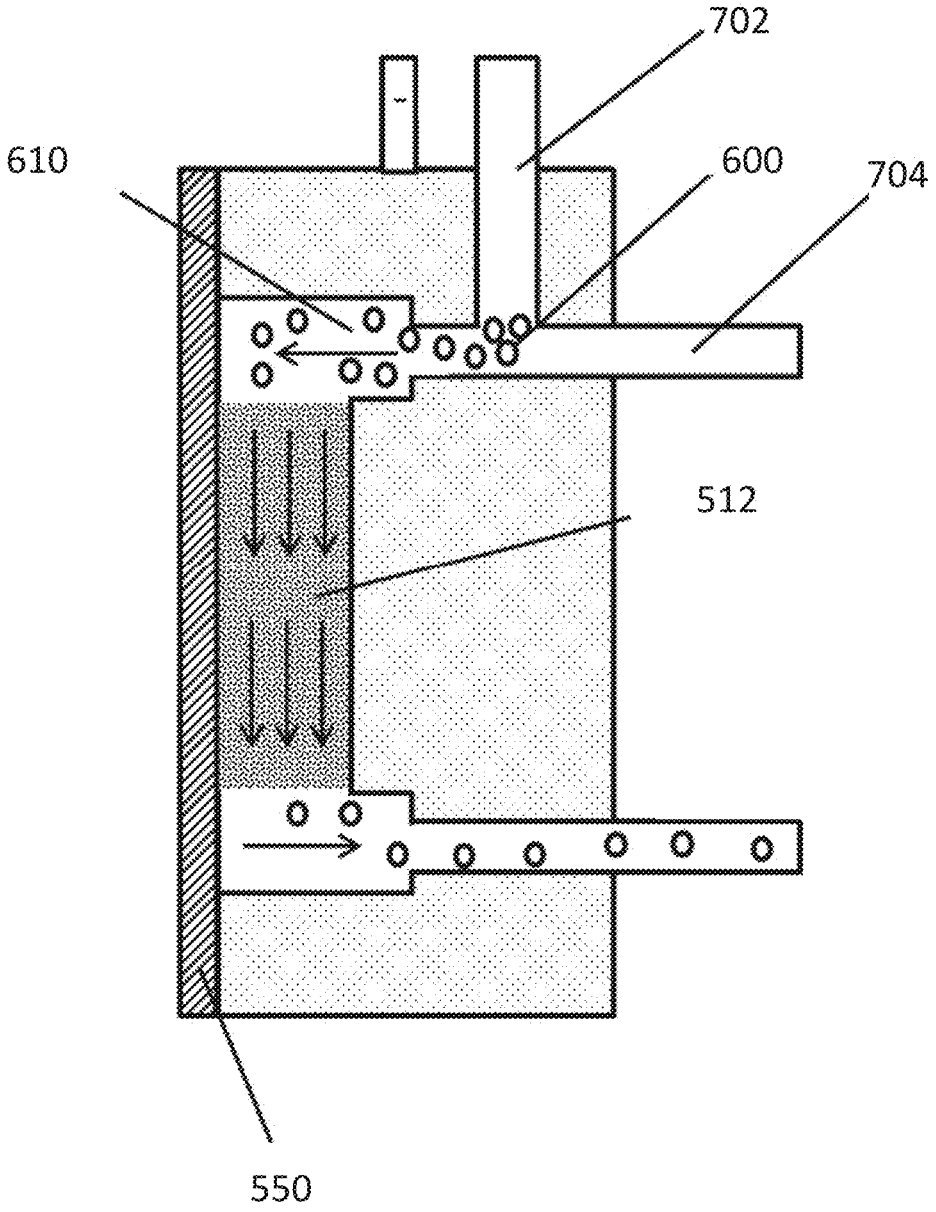
FIG. 4A is a schematic diagram of a component of an electrochemical system, according to some embodiments.

FIG. 3 is a schematic diagram illustrating the use of two-phase solution in the cathode block of an electrochemical cell. Here, a two-phase solution 600 is flowed through the inlet manifold 610, through cathode substrate 512, and out of the outlet manifold 620. Note that the concentration of the gaseous species decreases after passing through the cathode substrate 512 due to the participation of the gaseous species in the reaction of interest (e.g., hydrogen peroxide generation). Another embodiment of the cathode block is shown in FIG. 4A. In this case, gas 702 and liquid 704 are injected separately to form a two-phase solution 600 at an intersection upstream of the cathode 510. In some cases, the two-phase solution may be distributed over the cathode via an inlet manifold (e.g., an array of branched and/or parallel inlets) to substantially uniformly introduce two-phase solution to the cathode. In some cases, the two-phase solution may be created at multiple intersections fed from different manifolds and injected into portions of the electrode. Similar structures are similarly possible in the anode, in accordance with some embodiments.

Figure 4B:
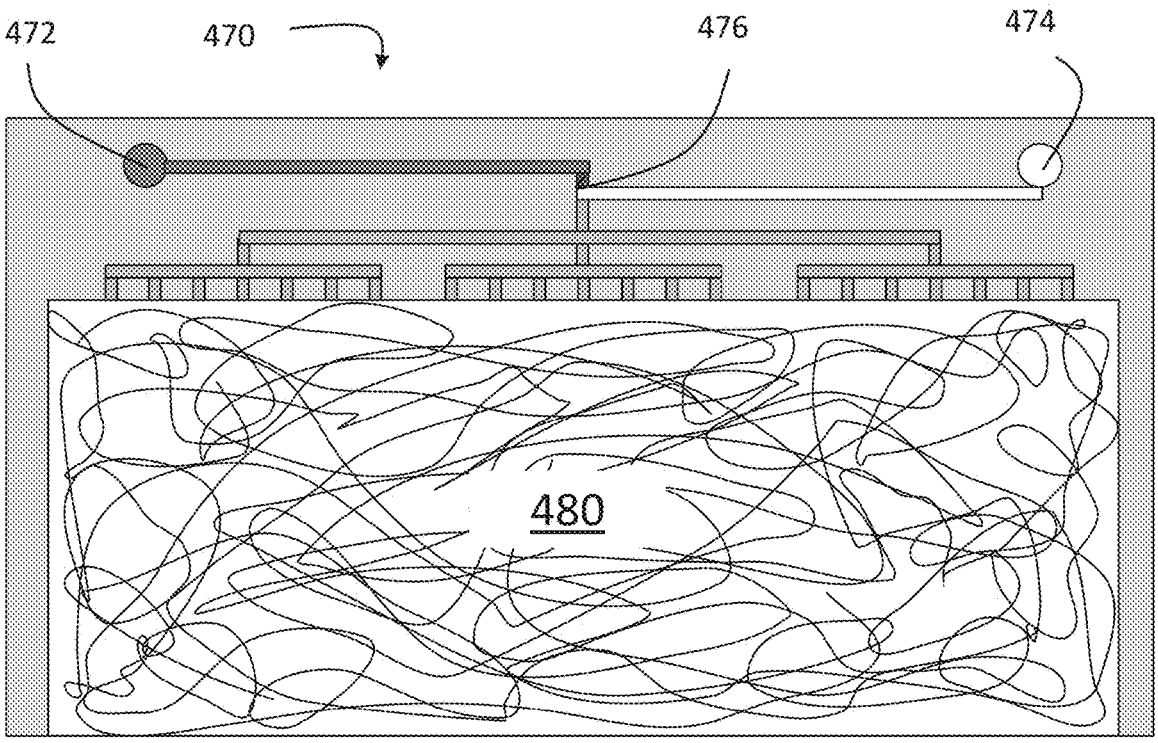
FIG. 4B is a schematic diagram of a component of an electrochemical system, according to some embodiments.
Figure 4C:
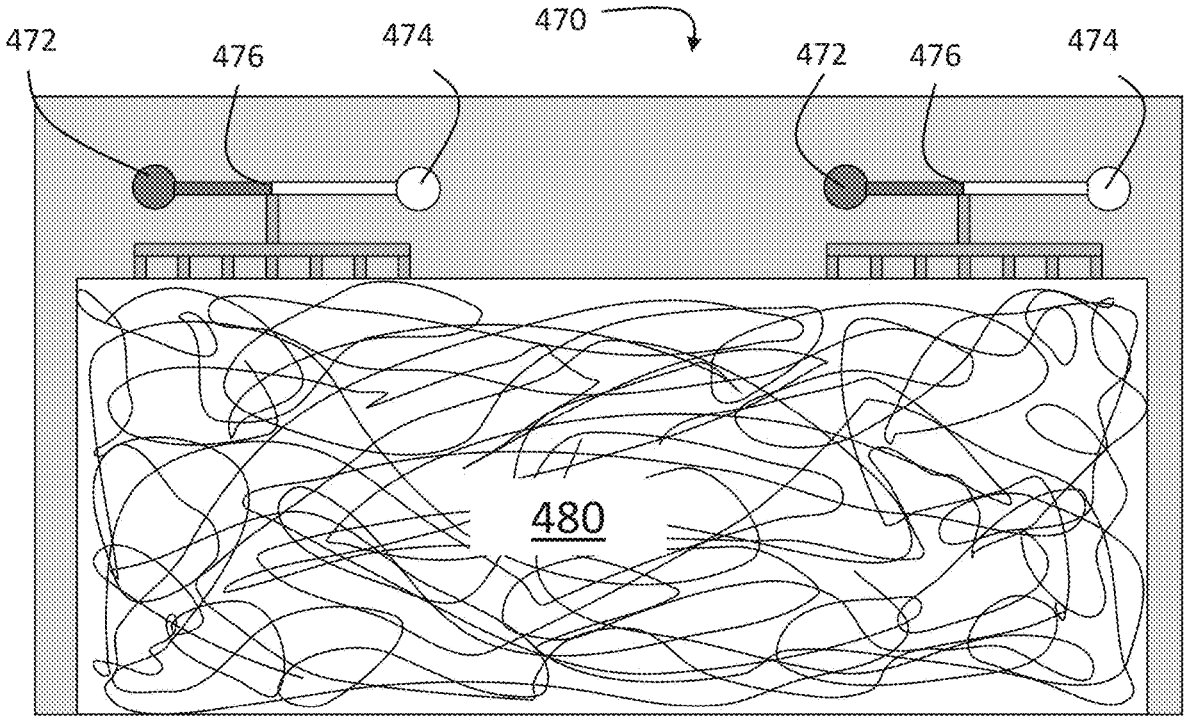
FIG. 4C is a schematic diagram of a component of an electrochemical system, according to some embodiments.
Figure 4D:
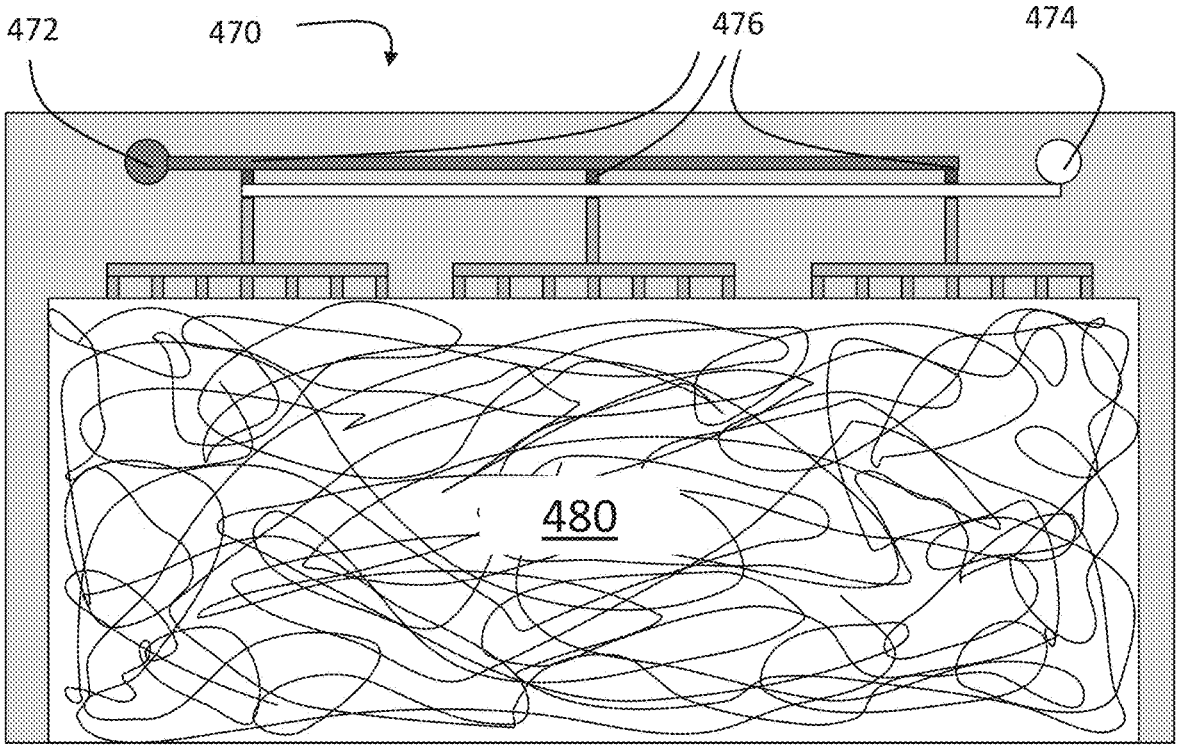
FIG. 4D is a schematic diagram of a component of an electrochemical system, according to some embodiments.
Figure 4E:
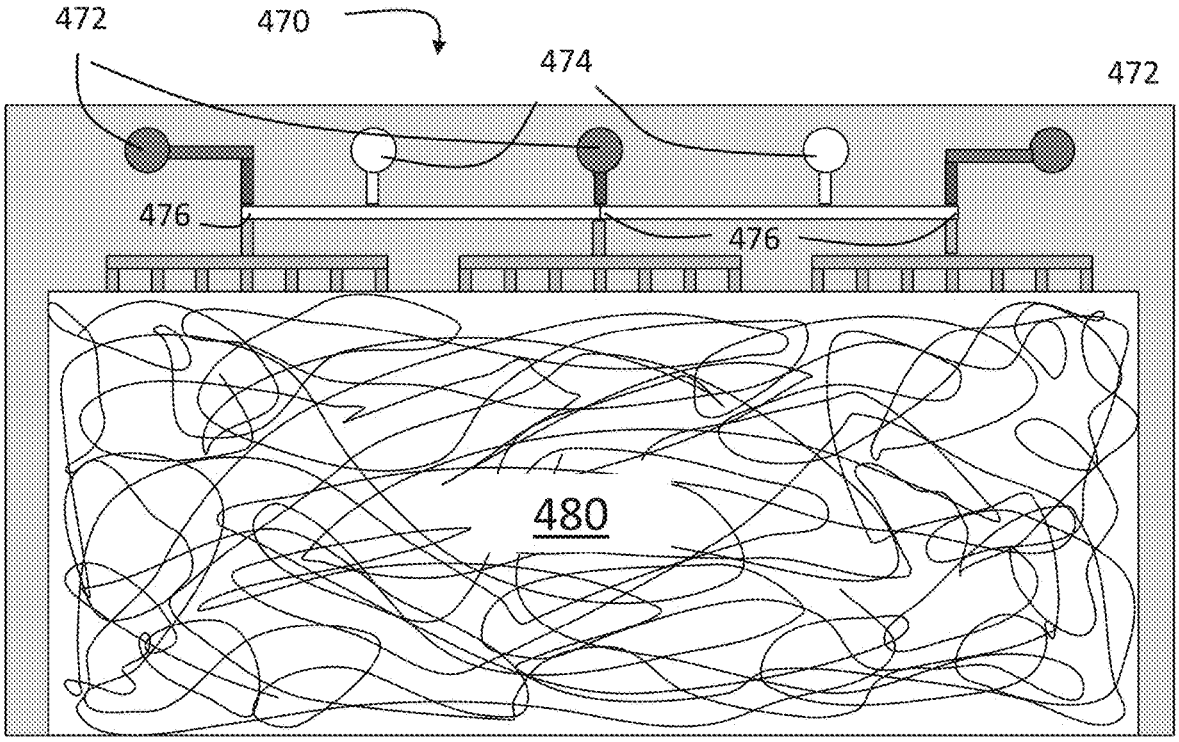
FIG. 4E is a schematic diagram of a component of an electrochemical system, according to some embodiments.

According to some embodiments, each gas and/or liquid manifold within the stack feeds only one intersection of a gas and liquid inlet within a cathode or anode flow plate and/or flow frame within a cell, In some embodiments, each intersection of a gas and liquid inlet within a cathode or anode flow plate and/or flow frame within a cell is fed only by a single gas and/or liquid manifold within the stack. For example, consider FIGS. 4B-4C. FIG. 4B shows an exemplary cathode assembly 470 including cathode substrate 480 with liquid manifold 472 and gas manifold 474. The liquid and gas manifolds 472 and 474 intersect at a single point 476 to form two-phase flow. FIG. 4C shows a similar, alternative embodiment where there are multiple pairs of liquid and gas manifolds 472 and 474, but each only intersects at a single point 476. Such embodiments may provide advantages related to generating relatively uniform two-phase solution to flow over cathode substrate 480. FIGS. 4D-4E also show embodiments of exemplary cathode assemblies 470 including cathode substrate 480 with liquid manifolds 472 and gas manifolds 474. In these cases, the liquid and gas manifolds 472 and 474 feed multiple intersection points 476, and the two-phase solution generated in these cases may not be as uniform as in the assemblies shown in FIGS. 4B-4C.

Figure 5A:
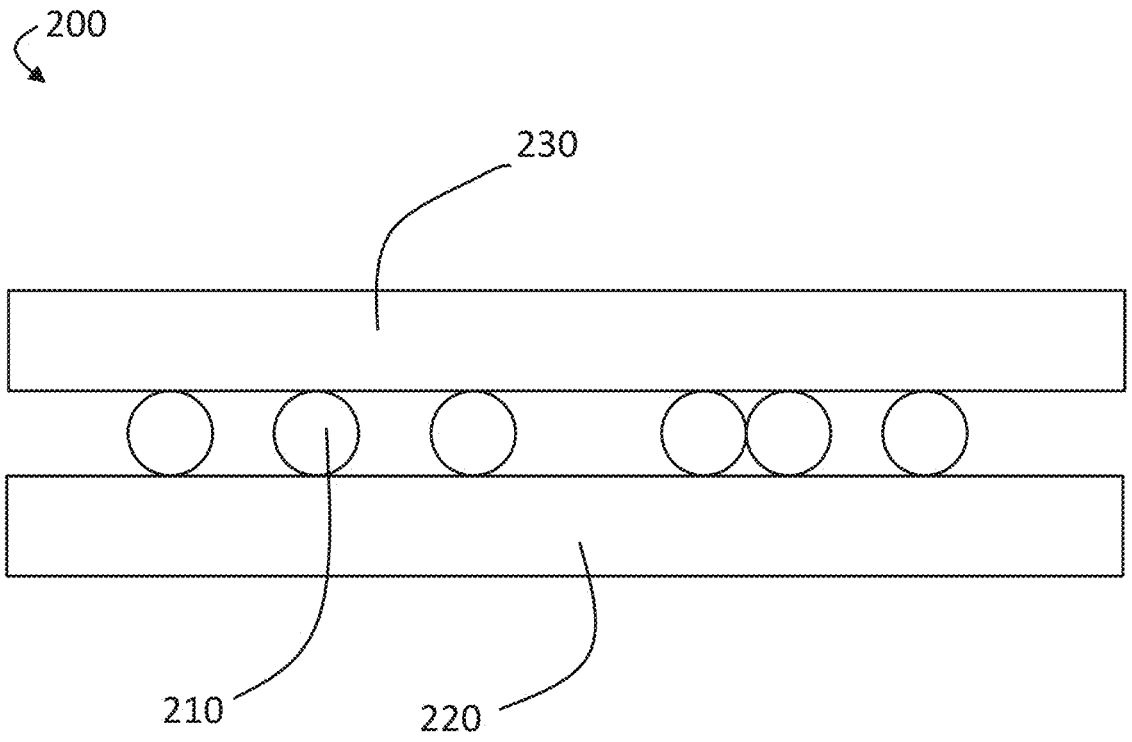
FIG. 5A is a schematic diagram of an electrode, according to some embodiments.

FIG. 5A shows an exemplary electrode structure 200 that may be used in some of the systems described herein. The electrode 200 may comprise a substrate 220 with a coating of particles of hydrophobic polymer 210. A catalyst layer 230 may then be formed over the particles of hydrophobic polymer 210 and the substrate 220. In some embodiments, the electrode structures may promote the electrocatalytic generation of a desired compound, such as hydrogen peroxide, when used as an electrode (e.g., a cathode) in the systems. While FIG. 5A shows the substrate as a planar substrate, it should be understood that this is a simplified schematic diagram, for example, of a magnified view of a substrate. For instance, FIG. 5A, in some cases, may illustrate a single surface of a single fiber of a non-woven substrate comprising fibers.

While much of the present disclosure describes embodiments directed to systems and methods related to the electrocatalytic generation of $H_2O_2$, it should be understood that other electrocatalytic reactions are contemplated. Any of a variety of other compounds may be electrogenerated. In some cases, it may be advantageous to use the systems and/or methods as disclosed herein for electrocatalytic reactions, for example, due to the forming of three-phase boundaries or the introduction of two-phase solutions. Exemplary electrocatalytic processes of interest include, but are not limited to, oxygen reduction (e.g., four electron pathway to form water or $OH^-$ ions, and/or two electron pathway to form $H_2O_2$ and possibly $OH^-$ ions; both cases are pH dependent), nitrogen fixation, the chlor-alkali process, and $CO_2$ reduction.

In some cases, the electrodes of the systems disclosed herein are believed to improve the formation of three-phase boundaries, which may improve the faradaic efficiency and/or reduce activation and/or concentration polarization at the electrode during certain electrochemical reactions. In some embodiments, the electrode structures in the systems may preferentially catalyze certain electrocatalytic reactions via certain pathways (e.g., two-electron reduction of oxygen to hydrogen peroxide vs. the four-electron pathway of oxygen to water). The electrode structures described herein may generally be used as a cathode in systems, in some cases. For example, in some embodiments, each cathode in an electrode stack may comprise the electrode structures described herein.

According to some embodiments, the electrode structures may comprise a substrate. For example, again consider FIG. 5A, which shows an illustrative diagram of a substrate 220 of an electrode 200. In some cases, the substrate comprises a non-woven fiber. In some embodiments, the substrate comprises a non-woven fiber comprising carbon. In some embodiments, the substrate comprises a non-woven fiber comprising elemental carbon. In some cases, the substrate comprises a non-woven fiber comprises graphitized carbon. In some embodiments, the substrate comprises non-woven carbon fiber. According to some embodiments, the substrate consists of a non-woven carbon fiber. In some cases, the substrate comprises a felt, for example, a carbon felt. In some cases, instead of being woven, the fibers may be entangled by being needled, matted, condensed, pressed together, or other common methods like wet laying the fibers and/or electrospinning and/or suction deposition onto a porous substrate. Other methods are also possible.

Figure 6:
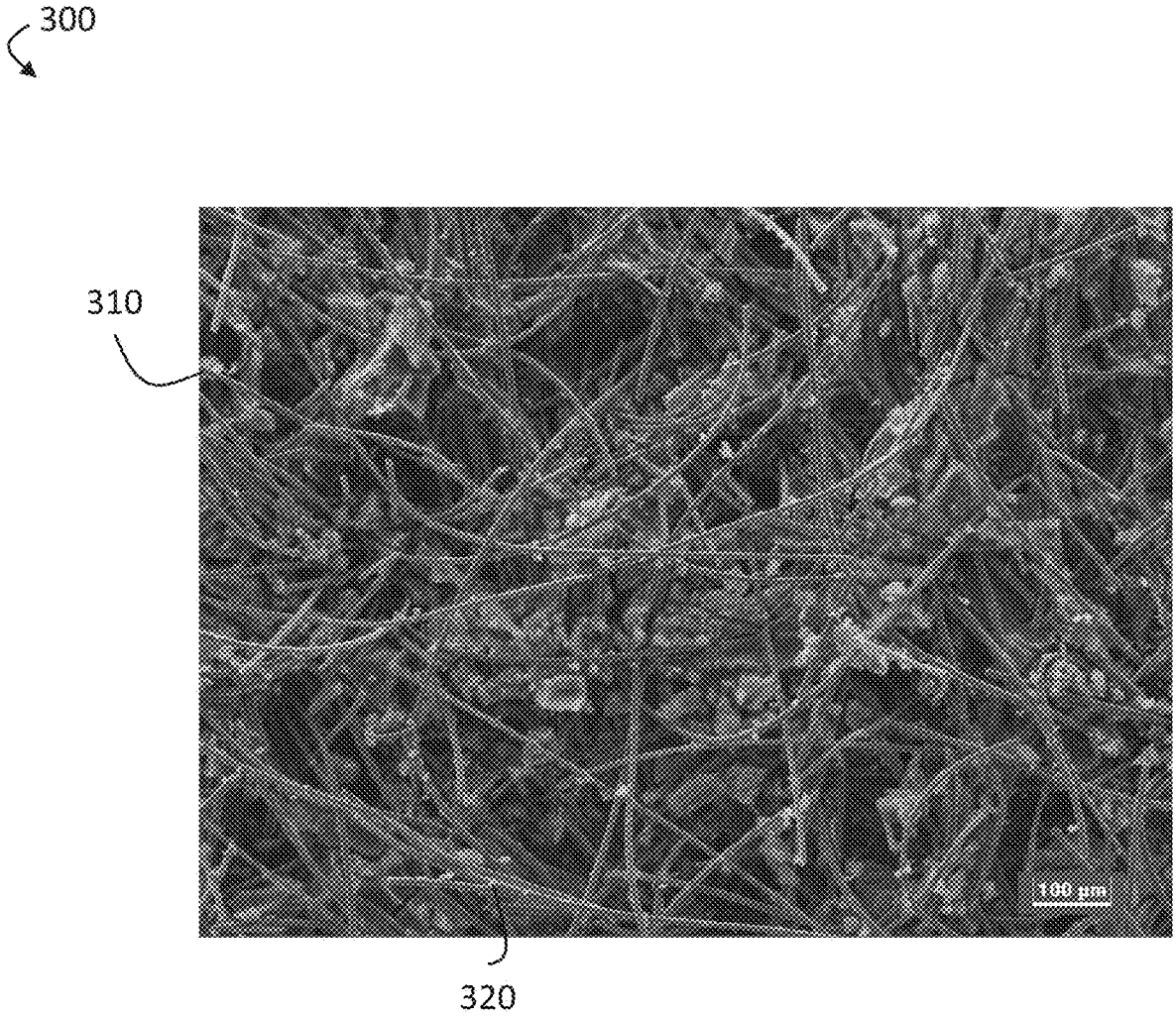
FIG. 6 is an image of an electrode, according to some embodiments.

For example, while FIG. 5A shows the substrate as a planar substrate, FIG. 6 is an SEM image of an electrode 300 comprising a coated substrate. The substrate comprises non-woven fibers 310.

Advantageously, substrates comprising non-woven fibers may be relatively porous and/or may have relatively thick, three-dimensional structures. Each of factors, in some cases, may promote the mixing and/or not promote phase separation of gas and liquid of the two-phase solution when flowing over and/or through a portion of the substrate as compared to other, woven substrates or paper substrates. Combined with a high surface area catalyst, the open pore structure may facilitate an accessible and relatively large surface area on which electrocatalytic reactions may occur, in some cases. In some cases, the relatively thick, three-dimensional structures of the non-woven fibers of the substrate may contain relatively large active zones when used in electrocatalytic applications. According to some embodiments, the use of electrodes including substrates containing non-woven fibers with large open pores may lead to electrode structures that do not wet at significant rates (e.g., may maintain a certain hydrophobicity), which may extend the lifetime of the electrode depending on the application, for example, when compared to systems using electrodes comprising carbon cloths, papers, or other woven materials having relatively smaller pores which may flood more easily. Moreover, the non-woven aspect of certain substrates, according to some embodiments, may advantageously provide relatively open volumes within the substrate through which solution may flow. As described in more detail later, in some cases, solutions, such as two-phase solutions, may flow through the open volumes of the substrate. In some embodiments, open volumes may increase the surface area on which an electrocatalytic reaction may proceed.

Still other embodiments include substrates comprising woven fabrics and/or paper. For example, woven cloths comprising carbon and/or paper comprising carbon may be used as substrates, in accordance with some embodiments.

Any of a variety of fibers may be used in the non-woven substrate, in accordance with some embodiments. In some cases, the fibers may comprise carbon. In some cases, the fibers may comprise graphitized carbon. In some cases, the fibers may comprise amorphous carbon. In some embodiments, the precursor of the carbon fibers may be (polyvinyl chloride) PVC, polyvinylidene chloride (PVDC), and/or polyacrylonitrile (PAN). Other precursors are possible.

The substrate of the electrode may be relatively thick, for example, when compared to common substrate materials such as woven cloths (e.g., cloth comprising woven fibers) or paper, in accordance with some embodiments. The relatively high thickness of the substrate comprising non-woven fibers, in some cases, may result in relatively accessible and/or high surface areas over which electrocatalytic reactions may occur.

The substrate of the electrode of the system may have any of a variety of suitable thicknesses, according to some embodiments. In some embodiments, the average shortest dimension of the substrate is greater than or equal to 100 microns, greater than or equal to 500 microns, greater than or equal to 750 microns, greater than or equal to 1 millimeter, or greater than or equal to 3 millimeters. In some cases, the average shortest dimension of the substrate is less than or equal to 5 millimeters, less than or equal to 3 millimeters, less than or equal to 1 millimeter, less than or equal to 750 microns, or less than or equal to 500 microns. Combinations of the foregoing ranges are possible (e.g., greater than or equal to 500 microns and less than or equal to 5 millimeters). Other ranges are also possible.

The substrates including non-woven fibers, in accordance with some embodiments, may have a surface area of greater than or equal to 0.01 $m^2/g$, greater than or equal to 0.05 $m^2/g$, greater than or equal to 0.1 $m^2/g$, greater than or equal to 0.5 $m^2/g$, or greater than or equal to 1 $m^2/g$. In some cases, the substrate including non-woven fibers may have a surface area of less than or equal to 2 $m^2/g$, less than or equal to 1 $m^2/g$, less than or equal to 0.5 $m^2/g$, less than or equal to 0.1 $m^2/g$, or less than or equal to 0.05 $m^2/g$. Combinations of the foregoing ranges are possible. Other ranges are also possible.

In accordance with some embodiments, the substrate may have any of a variety of porosities. In some cases, the porosity may be measured by mercury porosimetry. According to some embodiments, the substrate may have a porosity of greater than or equal to 0.1, greater than or equal to 0.2, greater than or equal to 0.3, greater than or equal to 0.4, greater than or equal to 0.5, greater than or equal to 0.6, greater than or equal to 0.7, greater than or equal to 0.8, greater than or equal to 0.85, greater than or equal to 0.9, greater than or equal to 0.94, or greater than or equal to 0.95. In some cases, the substrate may have a porosity of less than or equal to 0.99, less than or equal to 0.95, less than or equal to 0.94, less than or equal to 0.9. less than or equal to 0.85, less than or equal to 0.8, less than or equal to 0.7, less than or equal to 0.6, less than or equal to 0.5, less than or equal to 0.4. less than or equal to 0.3, or less than or equal to 0.2. Combinations of the foregoing ranges are possible (e.g., greater than or equal to 0.2 and less than or equal to 0.5). Other ranges are also possible.

In some embodiments, the substrate may have an open macropore structure. In some embodiments, the average smallest cross-sectional dimension of a pore in the substrate is less than or equal to 200 microns, less than or equal to 100 microns, less than or equal to 50 microns, or less than or equal to 10 microns. In some embodiments, the average smallest cross section dimension of a pore in the substrate is greater than or equal to 1 micron, greater than or equal to 10 microns, greater than or equal to 50 microns, or greater than or equal to 100 microns. Combinations of the foregoing ranges are possible. Other ranges are also possible.

A first hydrophobic polymer may be deposited on at least a portion of the substrate (e.g., as a pretreatment step). In some cases, the first hydrophobic polymer may infiltrate into the void space of the substrate and/or form a coating on at least a portion of some of the fibers of the substrate. In some cases, the first hydrophobic polymer may infiltrate and coat at least a portion of the depth of the substrate. In some cases, the coating may infiltrate and/or coat all of the depth of the substrate (e.g., particles of the first hydrophobic polymer may be present on at least some fibers at each depth of the substrate). The hydrophobic polymer may comprise any of a variety of hydrophobic polymers. In some cases, the hydrophobic polymer may comprise a fluorinated polymer. Exemplary hydrophobic polymers include, but are not limited to, ethylene tetrafluoroethylene (ETFE), polyvinylidene fluoride (PVDF), perfluoroalkoxy alkane (PFA), fluorinated ethylene propylene (FEP), and polytetrafluoroethylene (PTFE). In some embodiments, the hydrophobic polymer comprises PTFE.

The first hydrophobic polymer may be applied as a pretreatment. It should be understood that pretreatment is a term used for convenience and is not intended to necessarily imply any order in which the first polymer must be applied to the substrate. In some cases, the hydrophobic polymer may form a coating on at least a portion of the surface of the substrate, in some cases. In some embodiments, the hydrophobic polymer pretreatment may be present on the electrode as particles of the hydrophobic polymer. In accordance with some embodiments, the particles of the hydrophobic polymer may form a partial and/or conformal coating on the surface of the substrate.

In some cases, the hydrophobic polymer may be deposited on the substrate as particles of the hydrophobic material. For example, consider FIG. 5A, which illustrates a substrate 220 of an electrode 200, where hydrophobic particles 210 may form a partial layer on the substrate 220. Consider FIG. 5B, which illustrates a substrate 580, where hydrophobic particles 586 may infiltrate the complete depth on the substrate 580.

In some cases, the particles of the first hydrophobic polymer may infiltrate at least 5%, at least 10%, at least 20%, at least 25%, at least 30%, at least 40%, at least 50%, at least 60%, at least 70%, at least 80%, or at least 90% of the depth of a thickness of the substrate. In some cases, the polymer infiltrates in the whole depth, no more than 90%, no more than 80%, no more than 70%, no more than 60%, no more than 50%, no more than 40%, no more than 30%, no more than 25%, no more than 20%, or no more than 10% of the depth of a thickness of the substrate.

Any of a variety of sizes of the hydrophobic particles (e.g., PTFE particles) may be suitable for use during the pretreatment of the substrate of the electrode, according to some embodiments. In some cases, hydrophobic particles may be used such that they do not aggregate and maintain a relatively large hydrophobic surface area. In some embodiments, powders and/or micropowders of the hydrophobic polymers (e.g., PTFE powders) may be suspended in a solvent and may be used such that they do not aggregate and maintain a relatively large hydrophobic surface area. Conventional PTFE dispersions utilize surfactants to stabilize PTFE particles in the solvent to prevent aggregation of the particles. In some such instances, such dispersions may not achieve the desired uniform distribution of PTFE that infiltrate the depth of the substrate, for example, due to the presence of the surfactant, as the surfactant allows the PTFE to be mobile during drying. Accordingly, in some embodiments and as described in more detail elsewhere herein, the PTFE may be applied to the substrate in the absence of a surfactant.

According to some embodiments, the hydrophobic particles may have an average largest cross-sectional dimension that is greater than or equal to 100 nanometers, greater than or equal to 500 nanometers, greater than or equal to 1 micron, greater than or equal to 3 microns, greater than or equal to 5 microns, greater than or equal to 10 microns, greater than or equal to 25 microns, or greater than or equal to 50 microns. In some cases, the average largest cross-sectional dimension of the hydrophobic particles may be less than or equal to 100 microns, less than or equal to 50 microns, less than or equal to 25 microns, less than or equal to 10 microns, less than or equal to 5 microns, less than or equal to 3 microns, less than or equal to 1 micron, or less than or equal to 500 nanometers. Combinations of the foregoing ranges are possible (e.g., greater than or equal to 1 micron and less than or equal to 10 microns). Other ranges are also possible.

In some cases, the hydrophobic particles present on the surface of the substrate of the electrode may be relatively stable and/or may not significantly aggregate. According to some embodiments, the average largest cross-sectional dimension of the hydrophobic particles may not change and/or may change a relatively small amount after being deposited on the electrode and/or after surface treatments to the electrode are performed, as described in more detail elsewhere herein. In some embodiments, the average largest cross-sectional dimension of the hydrophobic particles may change by no more than 50%, no more than 25%, no more than 10%, or no more than 5% before using the electrode comprising the particles for, for example, electrocatalysis. This may be due to the hydrophobic particles remaining as initially suspended in solution and not aggregating.

In some cases, the substrate of the electrode may be pretreated with hydrophobic particles as described in more detail elsewhere herein. The hydrophobic particles on the electrode may, in some cases, form a partial layer on the electrode. In accordance with some embodiments, higher number densities of particles on the surface of the substrate may lead to more complete layers, for example, up to conformal layers. In some embodiments, wherein the substrate is a porous, three-dimensional substrate having a void space interspersed throughout its volume, the particles may be distributed throughout the volume of the substrate. In some such embodiments, the particles may be substantially uniformly distributed throughout the volume of the substrate.

According to some embodiments, using the methods described elsewhere herein, the hydrophobic particles (e.g., PTFE particles) used during the pretreatment may be on at least a portion of the surface area of the substrate. In some cases, when the substrate includes non-woven fibers (e.g., carbon felt), the hydrophobic particles may cover at least a portion of the surface of the substrate, including within an interior volume of the substrate (e.g., within the void space of the substrate). In some cases, the hydrophobic particles may deposit on the surface of the substrate relatively uniformly, for example, the particles may be uniformly distributed on a surface of the substrate in contact with the atmosphere and/or solution in which the substrate may be submersed. In some such cases, the particles may not aggregate significantly and/or may only cover a portion of the surface, as described elsewhere herein.

The concentration of hydrophobic particles (e.g., PTFE particles) used in a solution that is deposited on a substrate of an electrode may vary, in accordance with some embodiments. In some cases, the concentration of hydrophobic particles may be selected such that the particles form a layer that covers greater than or equal to 1%, greater than or equal to 10%, greater than or equal to 20%, greater than or equal to 30%, greater than or equal to 40%, or greater than or equal to 50% of the surface of the substrate. In some embodiments, the hydrophobic particles may form a layer that covers less than or equal to 60%, less than or equal to 50%, less than or equal to 40%, less than or equal to 30%, less than or equal to 20%, or less than or equal to 10% of the surface area of the substrate. Combinations of the foregoing ranges are possible. Other ranges are also possible.

According to some embodiments, the hydrophobic particles may be relatively homogeneously distributed over at least a portion of the surface area of the substrate (e.g., non-woven substrate) of the electrode, for instance, at least 5%, at least 25%, at least 50%, at least 75%, or more of the surface area of the substrate. In some cases, the hydrophobic particles may be relatively homogeneously distributed over the entirety of the substrate. To be relatively homogeneously distributed across the surface, the number density of particles distributed across the surface area of the electrode may vary by no more than 50%, no more than 25%, no more than 10%, or no more than 5% from an average number of particles, where the average number may be determined by analyzing SEM images of regions of exemplary electrodes.

In some embodiments, the hydrophobic polymer may be in the solution that is applied to the electrode in an amount of greater than or equal to 0.01 wt %, greater than or equal 0.1 wt %, greater than or equal 1 wt %, greater than or equal 2 wt %, greater than or equal 5 wt %, greater than or equal 10 wt %, greater than or equal 15 wt %, greater than or equal 20 wt %, greater than or equal 30 wt %, or greater than or equal 40 wt %. In some cases, the hydrophobic polymer may be in the solution that is applied to the electrode in an amount of less than or equal to 50 wt %, less than or equal to 40 wt %, less than or equal to 30 wt %, less than or equal to 20 wt %, less than or equal to 15 wt %, less than or equal to 10 wt %, less than or equal to 5 wt %, less than or equal to 2 wt %, less than or equal to 1 wt %, or less than or equal to 0.1 wt %. Combinations of the foregoing ranges are possible. Other ranges are also possible.

According to some embodiments, the hydrophobic polymer on the substrate may impart a level of hydrophobicity to the substrate of the electrode. The hydrophobicity of the substrate of the electrode after the hydrophobic polymer is applied (e.g., via pretreatment and/or preparation of the electrode) to the substrate may be measured by any of a variety of methods, in accordance with some embodiments. In some cases, hydrophobicity of the substrate may be determined by measuring a water contact angle on the substrate. In some embodiments, a planar non-porous material may be prepared in an otherwise analogous manner and then a water contact angle of the substrate may be measured. According to some embodiments, the water contact angle of the substrate prior to any operation in a cell is greater than or equal to 90 degrees, greater than or equal to 100 degrees, greater than or equal to 110 degrees, or greater than or equal to 120 degrees. In some embodiments, the water contact angle prior to any operation in a cell of the substrate is less than or equal to 130 degrees, less than or equal to 120 degrees, less than or equal to 110 degrees, or less than or equal to 100 degrees. Combinations of the foregoing ranges are possible. Other ranges are also possible.

In some embodiments, the electrode may further comprise a catalyst layer deposited on the substrate. In some instances, a hydrophobic polymer pretreatment may be present on at least a portion of the substrate before the catalyst layer is deposited on the substrate. For example, again referring to FIG. 5A, catalyst layer 230 may be formed over the substrate 220 and the particles of hydrophobic polymer 210 present on at least a portion of the substrate. While not shown in FIG. 5A, the catalyst layer may contact the substrate on at least a portion of the substrate (e.g., no intervening hydrophobic polymer), in some cases. In other embodiments, the catalyst layer may not directly contact the substrate, as illustrated in FIG. 5A. This may be due to the presence of an intervening layer of particles of hydrophobic polymer on the substrate, in some cases, where the catalyst layer may be formed over the substrate but be in direct contact with the hydrophobic polymer. In some embodiments, the catalyst layer may be in direct contact with the substrate and/or the hydrophobic polymer on the substrate.

In some cases, the catalyst layer comprises an active material and/or a binder and/or additional hydrophobic particles. In accordance with some such embodiments, the binder may be a second hydrophobic polymer, wherein the composition of the second hydrophobic polymer may be as described above for the first hydrophobic polymer. For instance, the second hydrophobic polymer may be or comprise PTFE particles. The binder may be in the form of a commercially available PTFE dispersion or emulsion, in some cases. In some embodiments, the additional hydrophobic particles may be a different form of PTFE particles, e.g., PTFE powder or micropowders. In some embodiments, the additional hydrophobic particles may be a combination of binder and powder or micropowder. According to some embodiments, the active material may be or comprise carbon. In some embodiments, the active material may comprise carbon nanoparticles, carbon microparticles, carbon flakes, carbon allotropes (e.g., graphite, graphene, amorphous carbon), or the like. In some embodiments, an active material may facilitate a catalytic reaction, for example, the oxygen reduction reaction, $CO_2$ reduction reaction, or the like, at a relatively lower voltage relative to a voltage needed in the absence of the active material.

In some embodiments, the size of the active material may be any of a variety of suitable sizes. In some cases, the average largest dimension of a particle of active material is at least 10 nm, at least 100 nm, at least 1 micron, or at least 10 microns. In some embodiments, the average largest dimension of a particle of active material is no more than 100 microns, no more than 10 microns, no more than 1 micron, or no more than 100 nanometers. Combinations of the foregoing ranges are possible. Other ranges are also possible.

In accordance with some embodiments, the active material (e.g., carbon) may have a relatively high surface area. In some cases, the relatively high surface area may facilitate the formation of many and/or various types of interfaces, for example, three-phase boundaries at and/or near an interface between the solution (e.g., a two-phase solution as described elsewhere herein), the active material, and/or hydrophobic polymer present in the catalyst layer and/or present on the substrate. In some cases, the surface area of the active material may be greater than or equal to 0.5 $m^2/g$, greater than or equal to 1 $m^2/g$, greater than or equal to 5 $m^2/g$, greater than or equal to 10 $m^2/g$, greater than or equal to 50 $m^2/g$, greater than or equal to 100 $m^2/g$, greater than or equal to 500 $m^2/g$, greater than or equal to 1000 $m^2/g$, greater than or equal to 2000 $m^2/g$, greater than or equal to 3000 $m^2/g$, or greater than or equal to 4000 $m^2/g$. In some embodiments, the surface area of the active material may be less than or equal to 5000 $m^2/g$, less than or equal to 4000 $m^2/g$, less than or equal to 3000 $m^2/g$, less than or equal to 2000 $m^2/g$, less than or equal to 1000 $m^2/g$, less than or equal to 500 $m^2/g$, less than or equal to 100 $m^2/g$, less than or equal to 50 $m^2/g$, less than or equal to 10 $m^2/g$, less than or equal to 5 $m^2/g$, or less than or equal to 1 $m^2/g$. Combinations of the foregoing ranges are possible. Other ranges are also possible.

In some embodiments, the active material may be in the solution that is applied to the electrode in an amount of greater than or equal to 0.01 wt %, greater than or equal 0.1 wt %, greater than or equal 1 wt %, greater than or equal 2 wt %, greater than or equal 5 wt %, greater than or equal 10 wt %, greater than or equal 15 wt %, greater than or equal 20 wt %, greater than or equal 30 wt %, or greater than or equal 40 wt % of the solution. In some cases, the active material may be in the solution that is applied to the electrode in an amount of less than or equal to 50 wt %, less than or equal to 40 wt %, less than or equal to 30 wt %, less than or equal to 20 wt %, less than or equal to 15 wt %, less than or equal to 10 wt %, less than or equal to 5 wt %, less than or equal to 2 wt %, less than or equal to 1 wt %, or less than or equal to 0.1 wt % of the solution. Combinations of the foregoing ranges are possible. Other ranges are also possible.

In some embodiments, the active material (e.g., carbon) may added in an amount to the catalyst layer in any of variety of suitable amounts. In some embodiments, the active material is added such that it is present in an amount of greater than or equal to 0.1 $mg/cm^2$, greater than or equal to 0.25 $mg/cm^2$, greater than or equal to 0.5 $mg/cm^2$, greater than or equal to 1 $mg/cm^2$, greater than or equal to 1.5 $mg/cm^2$, greater than or equal to 2 $mg/cm^2$, greater than or equal to 2.5 $mg/cm^2$, greater than or equal to 3 $mg/cm^2$, greater than or equal to 3.5 $mg/cm^2$, greater than or equal to 4 $mg/cm^2$, or greater than or equal to 4.5 $mg/cm^2$ of geometric area of the substrate. In some embodiments, the active material is added such that it is present in an amount of less than or equal to 5 $mg/cm^2$, less than or equal to 4.5 $mg/cm^2$, less than or equal to 4 $mg/cm^2$, less than or equal to 3.5 $mg/cm^2$, less than or equal to 3 $mg/cm^2$, less than or equal to 2.5 $mg/cm^2$, less than or equal to 2 $mg/cm^2$, less than or equal to 1.5 $mg/cm^2$, less than or equal to 1 $mg/cm^2$, or less than or equal to 0.5 $mg/cm^2$ of geometric area of the substrate. Combinations of the foregoing ranges are possible. Other ranges are also possible.

In accordance with some embodiments, the catalyst layer does not comprise a substantial amount of metal (e.g., no measurable amount, for example, as measured by EDS). This may be advantageous, according to some embodiments, for the metal, when present, may decompose an electrogenerated compound (e.g., hydrogen peroxide) and/or the metal may be costly. In some embodiments, metals may not provide any advantages regarding the efficiency of the reaction, e.g., when the electrogenerated compound is hydrogen peroxide and the reaction occurs in an alkaline solution.

In other embodiments, the catalyst layer comprises an active material comprising a metal. For example, the amount of metal present in the active material may be at least 0.0001 wt %, at least 0.001 wt %, at least 0.01 wt %, at least 0.1 wt %, at least 1 wt %, at least 5 wt %, at least 10 wt %, at least 20 wt %, at least 30 wt %, at least 40 wt %, or at least 50 wt % of the active material. In some embodiments, metals may be present in the active material in an amount of less than or equal to 60 wt %, less than or equal to 50 wt %, less than or equal to 40 wt %, less than or equal to 30 wt %, less than or equal to 20 wt %, less than or equal to 10 wt %, less than or equal to 5 wt %, less than or equal to 1 wt %, less than or equal to 0.1 wt %, less than or equal to 0.01 wt %, or less than or equal to 0.001 wt % of the active material. In some embodiments, the metals may only be present in trace amounts. In accordance with some embodiments, the metals of the active material may include, but are not limited to, iron, nickel, cobalt, gold, platinum, iridium, palladium, silver, rhodium, copper, zinc, oxides thereof, salts thereof, and/or metal-organic complexes thereof such as porphyrins, etc. Other metals and metal-containing compounds are possible.

In some embodiments, for example for use in electrocatalytic reactions such as the 2-electron oxygen reduction, $CO_2$ reduction, nitrogen fixation, and/or 4-electron oxygen reduction, or others, the catalyst layer may comprise active materials comprising metals. For example, in some embodiments, the active material may further comprise metal nanoparticles. The average largest cross-sectional dimension of the nanoparticles in the active material, in some cases, may be no more than 100 nanometers, no more than 50 nanometers, no more than 20 nanometers, or no more than 10 nanometers. In some embodiments, the average largest cross-sectional dimension of the nanoparticles in the active material may be at least 5 nanometers, at least 10 nanometers, at least 20 nanometers, or at least 50 nanometers. Combinations of the foregoing ranges are possible. Other ranges are also possible. Additionally, other forms of metals, such as dopants, single atoms, and microparticles, may be present in the catalyst layer.

Once the catalyst layer is deposited, in some cases, islands of hydrophobicity, some of which may be at least partially surround by hydrophilic surfaces, may form on at least a portion of the surface of the electrode. In some embodiments, islands of hydrophobicity across the surface of the electrode may be determined from images collected using an SEM and elemental analysis via energy dispersive x-ray spectroscopy (EDS). For example, referring again to FIG. 6, the SEM image shows an electrode 300 comprising a substrate of non-woven fibers 310. On a portion of the surface of substrate, aggregates of the catalyst layer 320 can be observed.

Figure 7A:
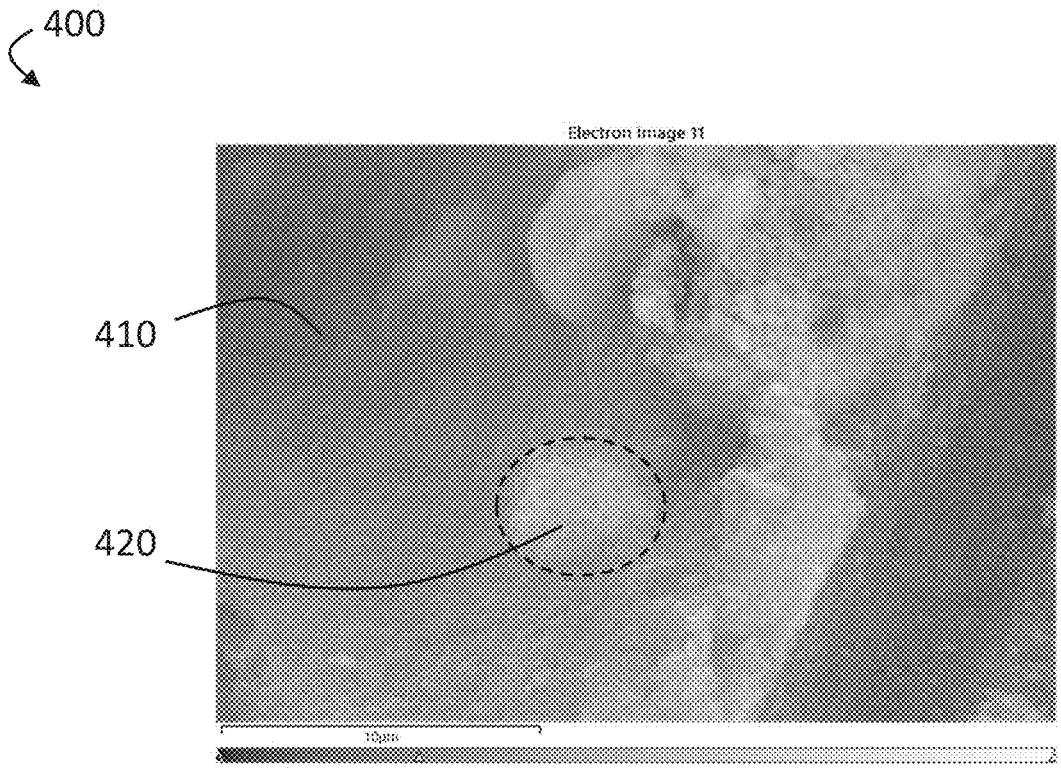
FIG. 7A is an image of an electrode, according to some embodiments.
Figure 7B:
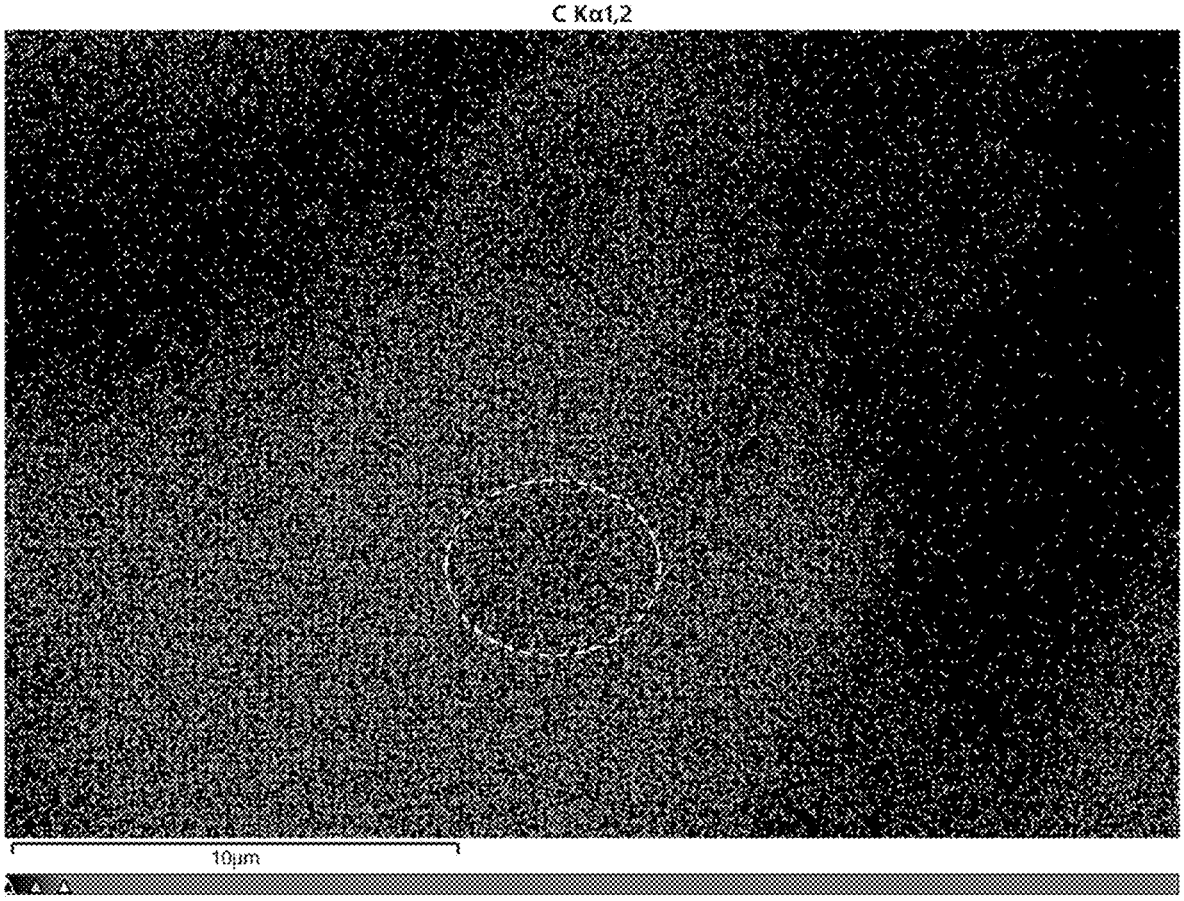
FIGS. 7B-7C are elemental maps of the electrode shown in FIG. 7A, according to some embodiments.
Figure 7C:
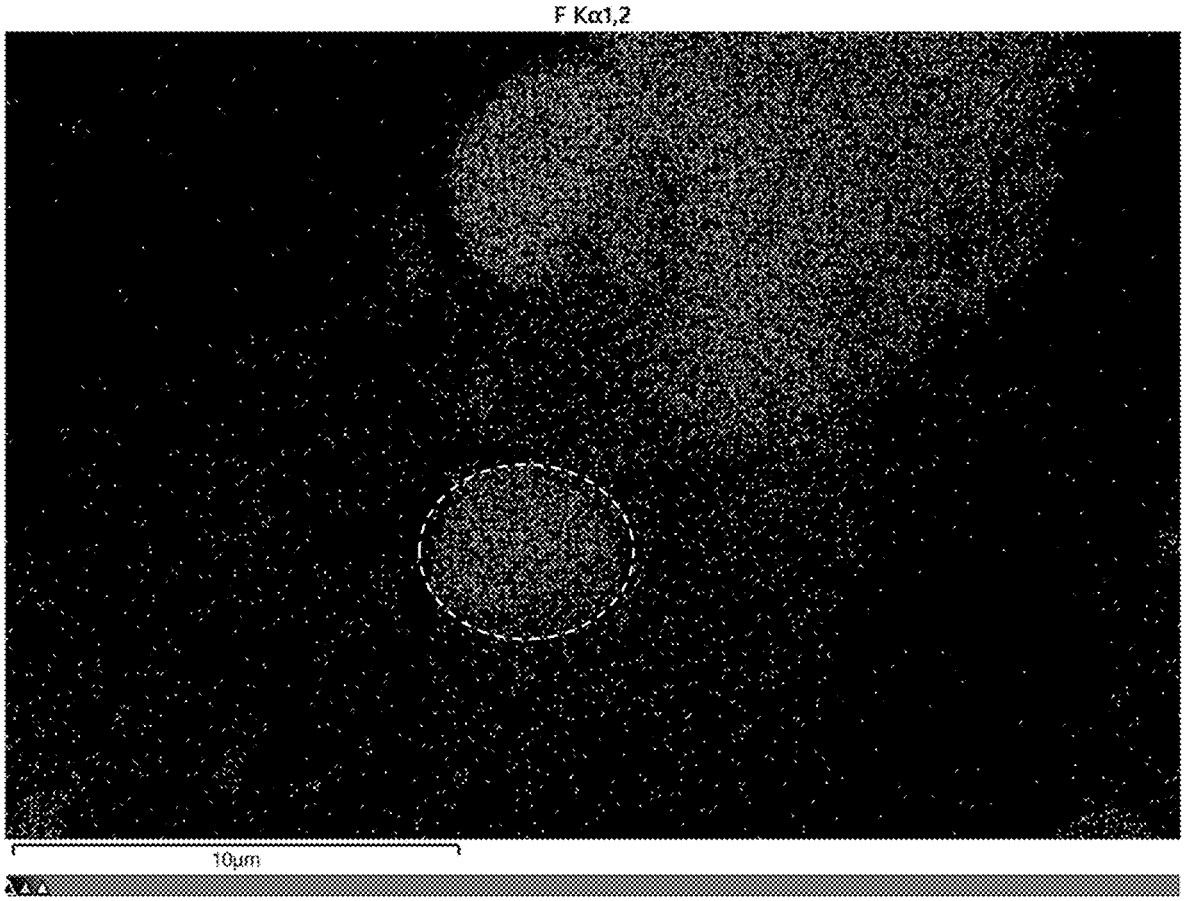

FIG. 7A is another image collected using an SEM that is taken at a higher magnification than FIG. 6, and FIGS. 7B-7C are corresponding elemental maps collected using EDS. The image in FIG. 7A is an exemplary electrode structure 400 comprising an active material 410 and PTFE particles 420. FIG. 7B shows an elemental map of the carbon distribution and FIG. 7C shows an elemental map of the fluorine distribution from the image of FIG. 7A. The distribution of carbon and fluorine are complementary in FIGS. 7B-7C. For example, consider the particle outlined in FIG. 7A with the dotted black circle. This location corresponds to dotted white circles in FIGS. 7B-7C, which show a decrease in carbon intensity in FIG. 7B and a prevalence of fluorine in FIG. 7C. The images show the localization of fluorine to the visible particles, indicating the presence of relatively hydrophobic regions (e.g., collocated to the presence of the PTFE particles). Regions where fluorine is absent comprise relatively hydrophilic regions, where the substrate and/or the active material (e.g., carbon) are present.

In some cases, such hydrophobic regions may be at least partially surrounded by hydrophilic regions on the substrate. In some embodiments, at least a portion of the hydrophobic regions are at least partially surrounded by hydrophilic regions. In some embodiments, at least a portion of the hydrophobic regions are completely surrounded by hydrophilic regions. In some embodiments, the hydrophobic regions correspond to the hydrophobic particles (e.g., PTFE particles). Accordingly, in some embodiments, the size and distribution of the hydrophobic regions on the substrate of the electrode correspond to size and distribution of the hydrophobic particles forming the layer. In some cases, the hydrophilic and hydrophobic regions may be generally observed with an SEM and complementary elemental mapping via EDS, as shown in FIGS. 7B-7C.

According to some embodiments, the electrode used in the system may be formed by any of a variety of methods. For example, in some cases, the substrate of the electrode may be pretreated. According to some embodiments, an active material may be applied to the substrate of the electrode. In some cases, after pretreatment, the electrode may be heated in an inert gas environment, for example, a non-oxidative environment, in order to sinter particles on the electrode/or to remove a surfactant from the surface of the electrode. In some cases, the hydrophobic particles are sintered.

A substrate, for example, a non-woven substrate may be pretreated, in accordance with some embodiments. Pretreating the electrode may include applying a solution to the substrate, where the solution comprises hydrophobic particles, for example, PTFE particles. In some cases, a PTFE powder and/or micropowder may be used to pretreat the substrate, as opposed to a PTFE dispersion. In other cases, the PTFE particles may originate from a PTFE dispersion. In some embodiments, pretreating the electrode may make the electrode more hydrophobic and/or may facilitate further deposition of, for instance, a catalyst layer onto the substrate. In some cases, the hydrophobic particles that are used to pretreat the electrode may be applied to the electrode in a solvent.

Any of a variety of solvents may be used for applying the hydrophobic particles when pretreating the substrate of the electrode, in accordance with some embodiments. In some cases, the solvent may comprise an organic solvent. According to some embodiments, the solvent may comprise a polar organic solvent. In other cases, the solvent may comprise a nonpolar organic solvent. According to some embodiments, the solvent may comprise a protic polar organic solvent. Examples of protic polar organic solvents include, but are not limited to, methanol, ethanol, propanol, butanol, isopropyl alcohol, isobutyl alcohol, or the like. In some cases, it may be advantageous to use a solvent comprising isopropanol. In some embodiments, other solvents such as acetone, hexanes, chloroform, and/or diethyl ether may be used as the solvent during pretreatment of the substrate of the electrode. In some cases, the solvent may be aqueous, and thus may contain water. Other solvents are also possible. Additionally, mixed solvent systems may also be used, for example, a 50/50 mix of ethanol and isopropanol. In some instances, a mixed solvent system comprising water and an alcohol (e.g., IPA) may be used. Other ratios, combinations of solvents, and number of solvents of the solvent system (e.g., at least 1 constituent solvent, at least 2 constituent solvents, at least 3 constituent solvents, and so forth) are contemplated, as this disclosure is not so limited.

Some aspects of selecting a solvent may be related to the vapor pressure of the solvent. For example, in some cases, solvents having relatively high vapor pressures may evaporate quickly upon pretreating the electrode, which may lead to relatively uniform depositions and associated distributions of any hydrophobic particles (e.g., PTFE particles) on the substrate following pretreatment when compared to particle distributions obtained when pretreating using relatively less volatile solvents (e.g., water). In some embodiments, the vapor pressure of the solvent at 25 degrees C. may be greater than or equal to 0.1 kPa, greater than or equal to 1 kPa, greater than or equal to 5 kPa, greater than or equal to 10 kPa, greater than or equal to 15 kPa, greater than or equal to 20 kPa, greater than or equal to 25 kPa, or greater than or equal to 30 kPa. In some embodiments, the vapor pressure of the solvent at 25 degrees C. may be less than or equal to 35 kPa, less than or equal to 30 kPa, less than or equal to 25 kPa, less than or equal to 20 kPa, less than or equal to 15 kPa, less than or equal to 10 kPa, less than or equal to 5 kPa, or less than or equal to 1 kPa. Combinations of the foregoing ranges are possible (e.g., greater than or equal to 1 kPa and less than or equal to 10 kPa). Other ranges are also possible.

According to some embodiments, the solution applied to pretreat the electrode may consist of the solvent and the hydrophobic particles. For example, in some such cases, the solution used to pretreat the electrode may consist of isopropanol and PTFE particles. According to some cases, surfactants may be absent from the solution. In some such cases, using a relatively volatile solvent and/or no surfactant may result in a relatively uniform infiltration and resulting distribution of hydrophobic particles on the surface of the substrate after the solvent evaporates. In other embodiments, additional components may be in the solution used for pretreating the electrode, such as surfactants, multiple solvents, binders, and/or other types of particles. In some embodiments, the substrate may not be pretreated.

Figure 5B:
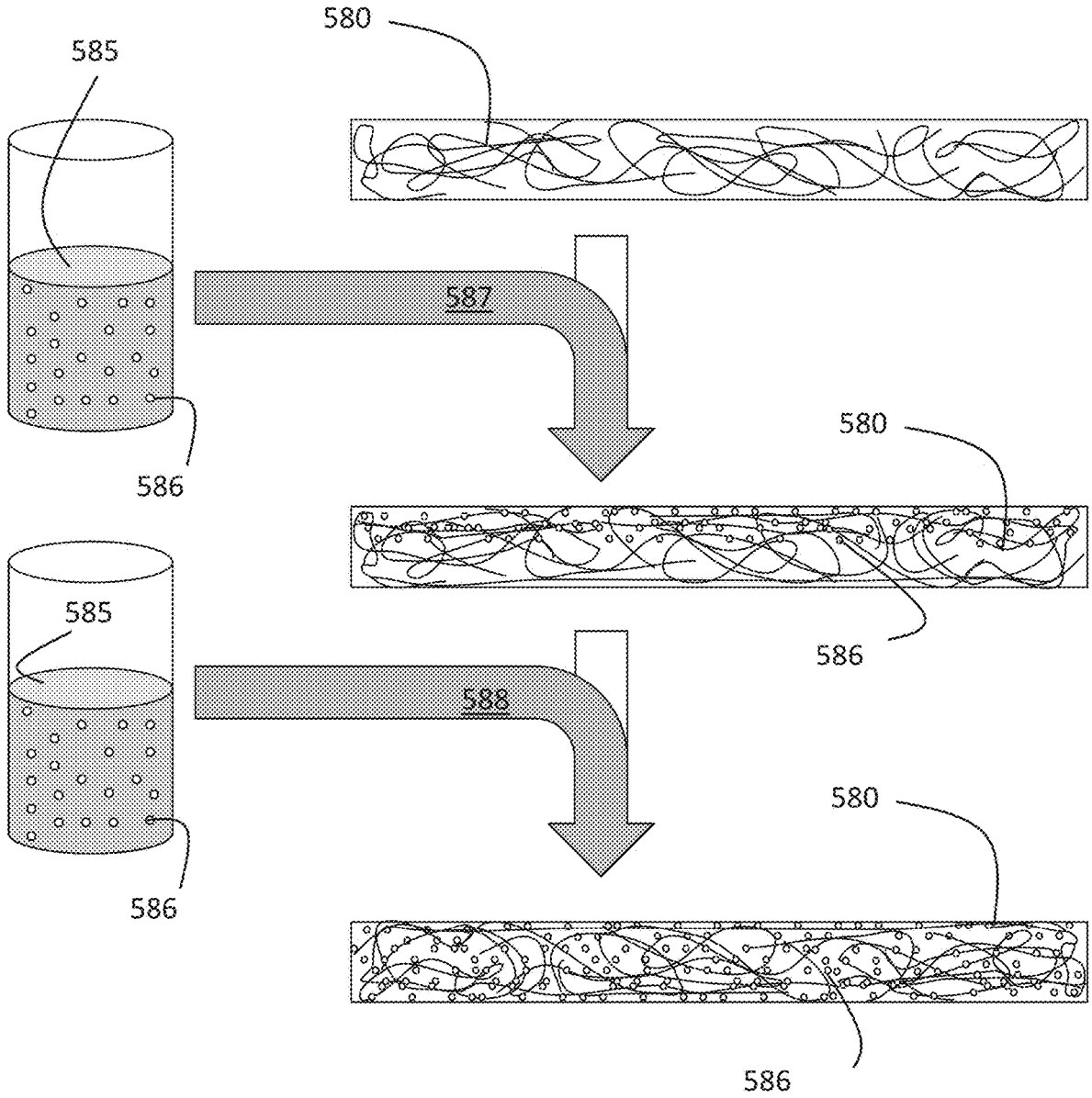
FIGS. 5B-F are a schematic diagrams related to making electrodes, according to some embodiments.
Figure 5C:
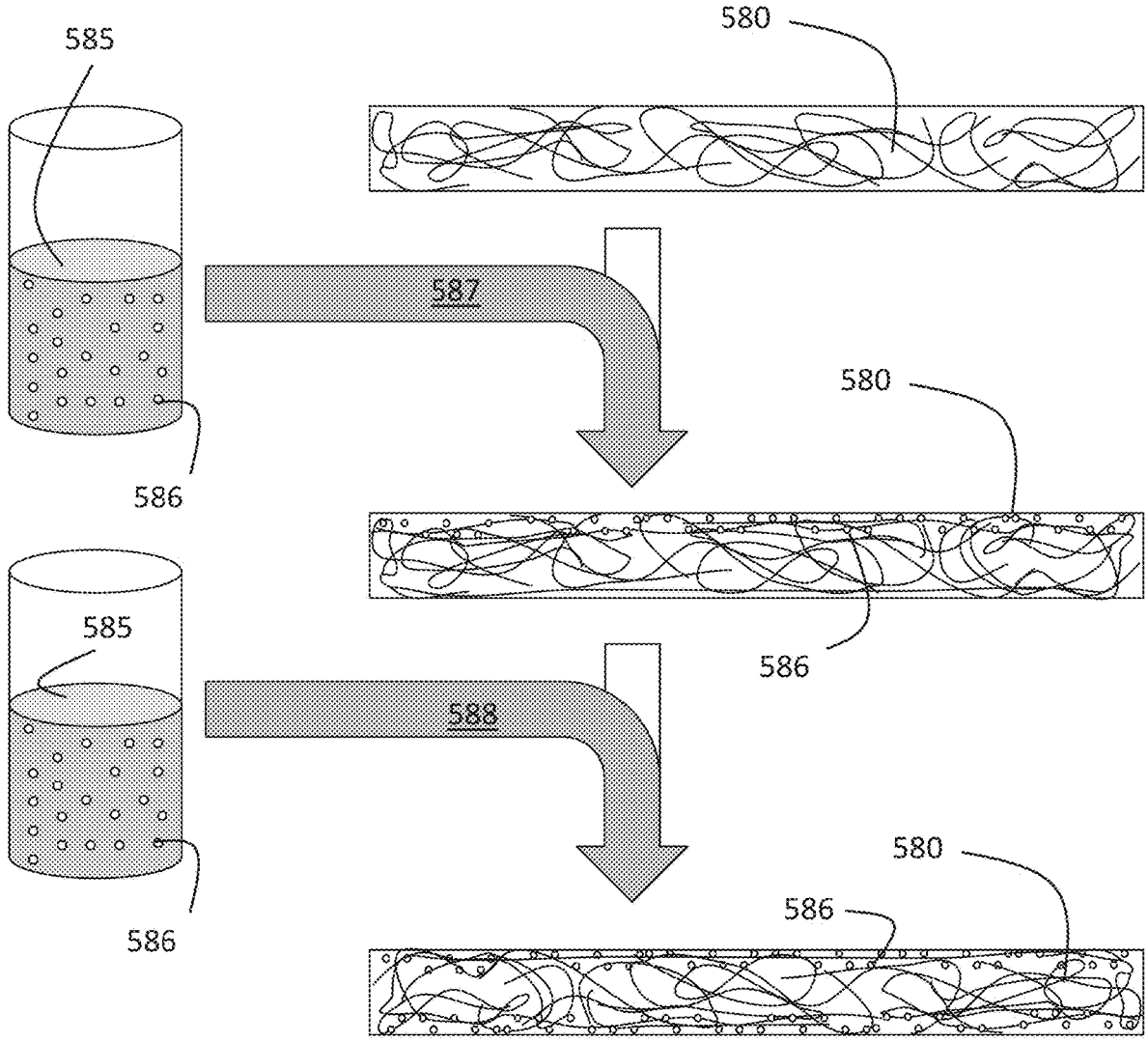

For example, consider FIG. 5B, which shows the pretreatment of a substrate 580. A pretreatment solution 585 comprising a first hydrophobic polymer 586 may be applied 587 to the substrate 580. In some embodiments, multiple applications 588 of the pretreatment solution 585 (e.g., two times, three times, four times, and so forth) may result in a further infiltration depth of the hydrophobic polymer 586 into substrate 580 to form a pretreated substrate. It should be understood that a pretreatment solution does not necessarily need to be applied directly to another untreated electrode. In some embodiments, the pretreatment solution may not be applied and/or may be applied to an electrode that has been modified by another material, for example, a catalyst layer. In some cases, as shown in FIG. 5C, the pretreatment solution is applied to both sides of the substrate such that the hydrophobic polymer may further infiltrate into the substrate and/or infiltrate from both sides of the substrate.

A catalyst layer comprising an active material may be applied to the substrate of an electrode, in accordance with some embodiments. The active material, as described elsewhere herein in more detail, may be applied to the electrode to provide a catalyst for certain electrochemical reactions. According to some embodiments, the catalyst layer may be applied after pretreating the electrode. In other cases, the catalyst layer may be applied to the electrode during pretreatment of the electrode. In some embodiments, the active material may be directly applied to the electrode, for example, as a powder. In some cases, dispersions of the active material may be deposited on the electrode, for example, to form a catalyst layer. The active material, in accordance with some embodiments, may be applied to the substrate of the electrode in the form of a slurry.

When applying the catalyst layer to the substrate, in accordance with some embodiments, the materials of the catalyst layer may be initially present in a solution, suspension, dispersion, or slurry. For example, according to some cases, the solution for applying the catalyst layer may consist of a solvent and the active material. In some cases, the solution may comprise the solvent, the active material, and other components. Solvents such as the solvents used during electrode pretreatment may be used to apply the catalyst layer. Examples of other components include, but are not limited to, hydrophobic polymers, surfactants, and/or binders. In some cases, particles of hydrophobic polymer, e.g., PTFE particles, may be supplied in the form of a dispersion or emulsion which may act as a binder and/or hydrophobicity agent in the catalyst layer. In some cases, particles of hydrophobic polymer, e.g., PTFE particles supplied in the form of a dry powder added to the solution, suspension, dispersion, or slurry, may act as a hydrophobicity agent and or binder. Some or all of such components may be present in the solution to be applied to the substrate, in some embodiments. In some such cases, the solution may be a slurry.

Figure 5D:
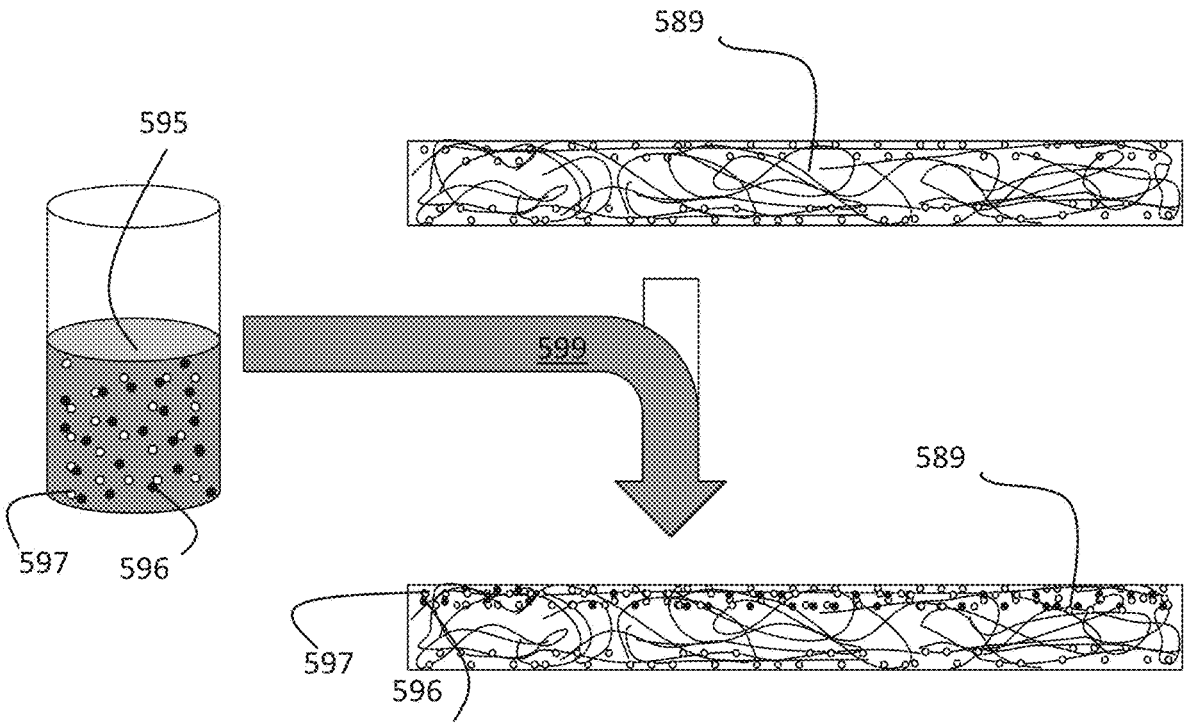
Figure 5E:
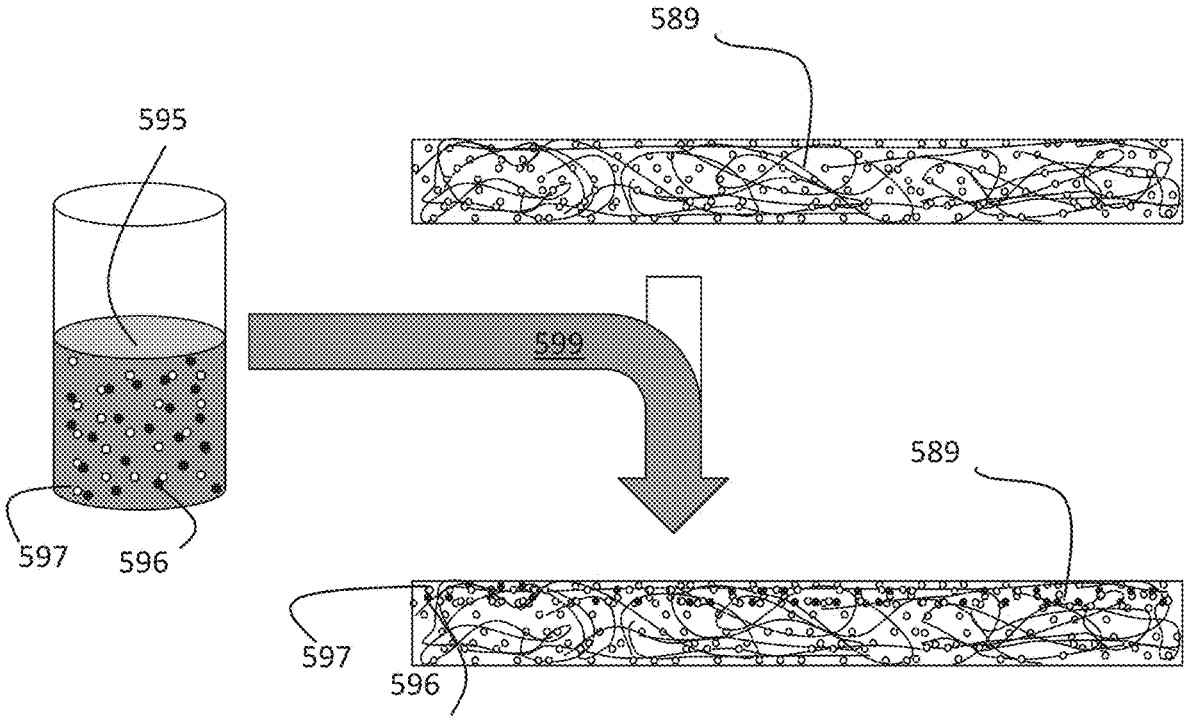
Figure 5F:
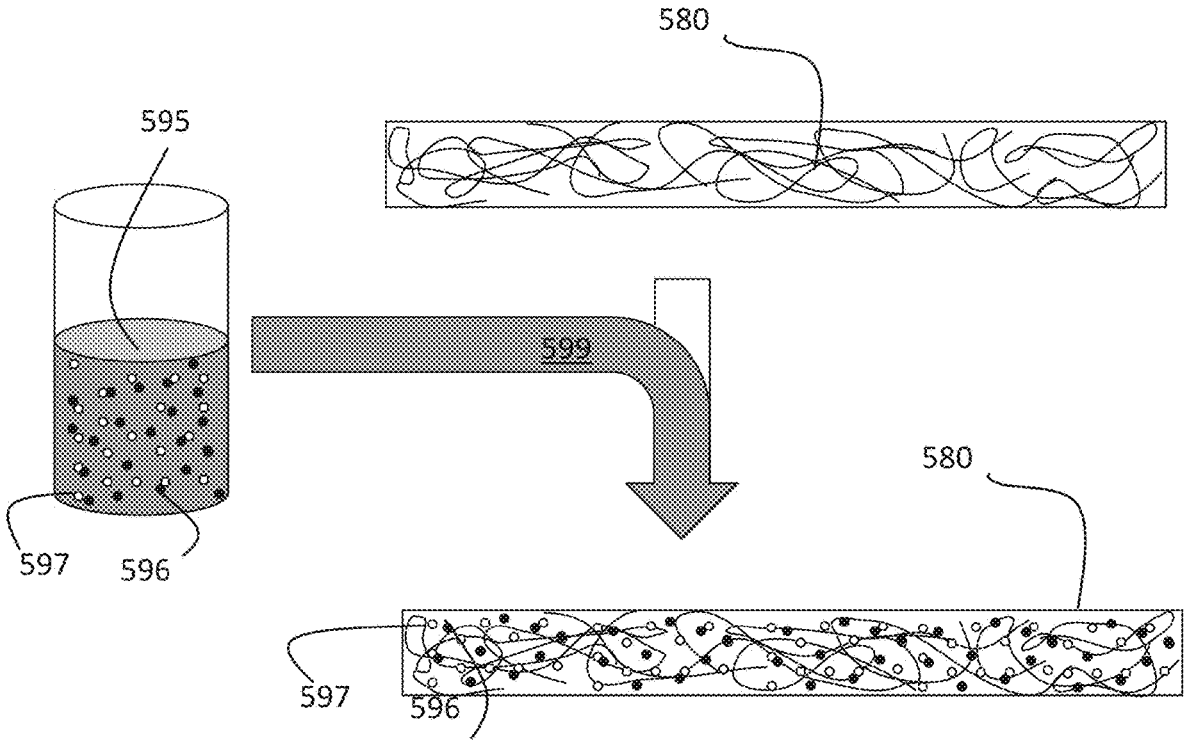

FIGS. 5D-5F show embodiments wherein substrates are treated with active materials. In some cases, such as shown in FIGS. 5D-5E, pretreated electrodes may then have a solution 595 comprising active material 596 and a second hydrophobic polymer 597 applied 599 to deposit a catalyst layer on to the pretreated substrate 589. In some cases, the pretreated electrode may comprise a first hydrophobic polymer before applying the active material and the second hydrophobic polymer. In some such cases, the first and second hydrophobic polymers are the same polymer. In other such cases, the first and second hydrophobic polymers are different. According to some embodiments, such as shown in FIG. 5F, the active material 596 and second hydrophobic polymer may be applied to an otherwise untreated substrate 580. Still other embodiments are contemplated where a substrate may be treated with only an active material (e.g., no hydrophobic polymer).

The electrode may be heated, in some embodiments. In some embodiments, the electrode may be heated in a non-oxidative atmosphere. It has been realized that in some instances, heating in an oxidative environment may yield a relatively hydrophilic substrate, which may be undesirable and lead to electrode flooding. In some cases however, the electrode may be heated in an oxidative environment. In some cases, the electrode may be heated before pretreatment, after pretreatment, and/or after applying the material of the catalyst layer to the substrate of the electrode. Heating the electrode, in accordance with some embodiments, may provide any of a variety of benefits to the electrode. In some cases, heating the electrode may remove a surfactant and/or a solvent from the surface of the substrate of the electrode, which may minimize or prevent the electrode from flooding. Without wishing to be bound by any particular theory, it is believed that heating the electrode and removing a surfactant and/or a solvent from the surface of the substrate of the electrode may make at least a portion of the surface of the electrode more hydrophobic (e.g., any hydrophobic particles present on the substrate may no longer be coated by a relatively hydrophilic surfactant and/or solvent). In some embodiments, heating the electrode in a non-oxidative atmosphere may reduce components of the electrode, such that portions of the surface may be relatively hydrophobic and facilitate the formation of three phase boundaries. According to some embodiment, heating the electrode may sinter particles present on the substrate of the electrode, which may provide advantages related to the surface hydrophobicity and/or may promote adhesion of the particles on the surface of the electrode.

The electrode, in accordance with some embodiments, may be heated to any of a variety of temperatures. In some cases, the electrode may be heated to relatively high temperatures, for example, to obtain more hydrophobicity of the substrate, better adhesion of the particles to the substrate, and/or better removal of the surfactant from the electrode. For example, in some embodiments, the electrode may be heated in an atmosphere having an average temperature of greater than or equal to 50 degrees C., greater than or equal to 100 degrees C., greater than or equal to 150 degrees C., greater than or equal to 200 degrees C., greater than or equal to 250 degrees C., greater than or equal to 300 degrees C., greater than or equal to 350 degrees C., or greater than or equal to 380 degrees C. In some cases, the electrode may be heated in an atmosphere having an average temperature of less than or equal to 400 degrees C., less than or equal to 380 degrees C., less than or equal to 350 degrees C., less than or equal to 300 degrees C., less than or equal to 250 degrees C., less than or equal to 200 degrees C., less than or equal to 150 degrees C., or less than or equal to 100 degrees C. Combinations of the foregoing ranges are possible. Other ranges are also possible.

The atmosphere in which the electrode is heated, in accordance with some embodiments, may comprise any of a variety of compositions. In some cases, the atmosphere may be non-oxidative. For example, in some cases, the atmosphere in which the electrode is heated contains less than or equal to 1 wt %, less than or equal to 0.1 wt %, less than or equal to 0.01 wt % of oxygen in the atmosphere. In some cases, the atmosphere contains substantially no oxygen. In some cases, the atmosphere may be a reducing atmosphere. In some embodiments, the atmosphere may be dry. Exemplary gases that may be present in the atmosphere include, but are not limited to, $N_2$, CO, $H_2$, and Ar. Steam may be used in combination with exemplary gases. Combinations and gases having different ratios of constituent gases are possible in the atmosphere when heating the electrode, in accordance with some embodiments. In some cases, the electrode may be heated in a vacuum (e.g., having a pressure of no more than 10 kPa, no more than 1 kPa, no more than 100 Pa, no more than 10 Pa, or no more than 1 Pa before being heated).

As described elsewhere herein, hydrophobic particles present on the substrate of the electrode may have any of a variety of sizes, in some embodiments. In some cases, heating the electrode may sinter the particles present on the substrate. According to some embodiments, the average largest cross-sectional of the hydrophobic particles may grow after heating the electrode. In some cases, the average largest cross-sectional dimension of the hydrophobic particles may grow by at least 10%, at least 20%, at least 30%, or at least 40% of the initial average largest cross-sectional dimension of the particle distribution. In some embodiments, the average largest cross-sectional dimension of the hydrophobic particles may grow by no more than 50%, no more than 40%, no more than 30%, or no more than 20% of the initial average largest cross-sectional dimension of the particle distribution. Combinations of the foregoing ranges are possible. Other ranges are also possible. In some cases, heating the electrode may not cause any observable (e.g., measurable) growth of the hydrophobic particles.

According to some embodiments, after sintering, the hydrophobic particles may grow to have an average largest cross-sectional dimension that is greater than or equal to 100 nanometers, greater than or equal to 500 nanometers, greater than or equal to 1 micron, greater than or equal to 3 micron, greater than or equal to 5 microns, greater than or equal to 10 microns, greater than or equal to 25 microns, or greater than or equal to 50 microns. In some cases, the average largest cross-sectional dimension of the hydrophobic particles may be less than or equal to 100 microns, less than or equal to 50 microns, less than or equal to 25 microns, less than or equal to 10 microns, less than or equal to 5 microns, less than or equal to 3 microns, or less than or equal to 1 micron. Combinations of the foregoing ranges are possible (e.g., greater than or equal to 1 micron and less than or equal to 10 microns). Other ranges are also possible.

Described in the context of FIG. 1 elsewhere herein, the disclosed electrodes may be used in an electrochemical system. For example, the electrodes described above, may be used as the cathode in an electrochemical system (e.g., in each electrochemical cell of an electrode stack). According to some embodiments, electrochemical systems comprising the electrode structures described herein may further comprise other components to electrochemical systems.

For example, in some cases, the electrochemical systems may further comprise a second electrode, e.g., an anode. The anode material may comprise any of a variety of materials. For example, the anode may comprise carbon (e.g., graphite), noble metals and oxides or salts (e.g., Pt, Au, Ag), transition metals and oxides or salts (e.g., Ni, Co, Fe), and/or alloys (e.g., stainless steel), Raney nickel, or flame-sprayed. Other anode materials are also possible.

In some cases, the electrochemical system may further comprise a separator to minimize and/or prevent crossover of the electrolyte between the anodic and cathodic electrodes of the cell. In some embodiments, the separator may be a cation exchange membrane. In some cases, the separator may be an anion exchange membrane. In some cases, using a cation exchange membrane as a separator may be advantageous because it may minimize and/or prevent crossover of anions present in basic solution of the electrochemical cell (e.g., perhydroxyl anions, polyatomic anions containing metals such as zincate). In some cases, using an anion exchange membrane as a separator may be advantageous to minimize and/or prevent crossover of ions present in acidic solution of the electrochemical cell (e.g., metallic cations). In some cases, the separator may comprise polyethylene, PTFE, polyvinyl chloride, ceramics, or fluorinated polymers (e.g., perfluorosulfonic acid (PFSA), Nafion). Other separator materials are possible, as this disclosure is not so limited.

The electrochemical system may further comprise a solvent system and/or an electrolyte, in some embodiments. In some cases, the solvent system may be organic. In other cases, the solvent system may be aqueous. Any of a variety of electrolytes may be used, in accordance with some embodiments, for example, metallic ions, halides, acids, bases and/or polyatomic ions. Exemplary cations include, but are not limited to, $H^+$, $NH_4^+$, $Li^+$, $Na^+$, $K^+$, $Ca^{2+}$, and $Mg^{2+}$. Example anions may include, but are not limited to, $F^-$, $Cl^-$, $Br^-$, $I^-$, $OH^-$, $SO_4^{2-}$, $CO_3^{2-}$, $NO_3^-$, perhydroxyl anion, and $PO_4^{3-}$. Other ions are possible. In some embodiments, certain reduction reactions may proceed more efficiently at relatively basic pH values. According to some cases, relatively basic solution may also be used on the anodic side of the electrochemical cell. In some such cases, electrogenerated compounds from the anode may be anions and/or form anionic complexes after oxidation at the anode. In some such embodiments, electrogenerated compounds from the anode that accumulate a negative charge due to the conditions of the electrolyte may not crossover the separator into the cathode side of the electrochemical cell when using a cation exchange membrane.

Any of a variety of concentrations of ions in the electrolyte solutions used in the anode and/or the cathode may be used. For example, in some cases, ions present in the electrolyte may be present in a concentration of at least 100 mM, at least 500 mM, at least 1 M, at least 1.5 M, at least 2 M, at least 2.5 M, at least 3 M, at least 4 M, at least 5 M, or at least 8 M. In some cases, the electrolyte may be present in a concentration of no more than 10 M, no more than 8 M, no more than 5 M, no more than 4 M, no more than 3 M, no more than 2.5 M, no more than 2 M, no more than 1.5 M, no more than 1 M, or no more than 500 mM. Combinations of the foregoing ranges are possible. Other ranges are also possible. The concentration of the electrolyte in the anodic cell and the cathodic cell of the electrochemical cell may not be the same. In some cases, the concentration of electrolyte may be selected such that any electrogenerated compounds do not react, precipitate, or otherwise decompose within the system.

According to some embodiments, the system may be configured to flow electrolyte solution across and/or through at least a portion of the electrode. In some cases, the system may be configured to flow electrolyte solution across and/or through at least a portion of each electrode in an electrode stack. In some cases, the electrolyte solution may be flowed over and/or through each cathode of each electrochemical stack. In some cases, flowing the electrolyte solution may minimize and/or prevent steep concentration gradients of electrogenerated compounds (e.g., hydrogen peroxide or associated ions, or other compounds) from forming throughout the electrochemical system, for example, near the separator and/or near the electrodes. In some such cases, avoiding such steep concentration gradients may minimize and/or prevent crossover of electrolyte between half cells (e.g., between the cathode and the anode) and/or from forming precipitates due to relatively high local concentrations of the electrogenerated compounds in the absence of flow. As described in more detail elsewhere herein, in some embodiments, the electrolyte may be recirculated throughout the system in order to further mitigate steep concentration gradients of electrogenerated compounds.

The electrolyte solution may be flowed through the system at any of a variety of flow rates, in accordance with some embodiments. In some cases, using relatively high flow rates may be advantageous, for example, for increasing mass transport of reactant species to the surface of the electrodes of the electrochemical system, for increasing mass transport of the electrogenerated compounds away from the surface of the electrodes, and/or flowing solution through pores of a relatively porous electrode (e.g., nonwoven fibers comprising carbon). Advantageously, in some embodiments, using the electrode structure described herein within an electrochemical system may facilitate relatively high faradaic efficiencies for certain electrogenerated compounds, and thus concentration gradients of the electrogenerated compounds may be relatively steep near the surface of the electrodes that are electrogenerating the compound. Accordingly, relatively high flow rates may facilitate the transport of the electrogenerated compound away from the electrode surface, which may minimize and/or prevent precipitation or species involving the electrogenerated compounds. According to some embodiments, to achieve the relatively high flow rates, pressure may be applied to achieve the relatively high flow rates.

In some cases, the linear flow velocity of the electrolyte solution flowing through the electrode may be greater than or equal to 1 millimeter per second, greater than or equal to 1 centimeter per second, greater than or equal to 5 centimeters per second, greater than or equal to 10 centimeters per second, or greater than or equal to 25 centimeters per second. In some embodiments, the linear flow velocity of the electrolyte solution flowing through the electrode may be less than or equal to 50 centimeters per second, less than or equal to 25 centimeters per second, less than or equal to 10 centimeters per second, less than or equal to 5 centimeters per second, or less than or equal to 1 centimeter per second. Combinations of the foregoing ranges are possible. Other ranges are also possible.

In some cases, the electrolyte solution may flow through a nominal cross section of the electrode at a rate of greater than or equal to 1 millimeter per second, greater than or equal to 2 millimeters per second, greater than or equal to 3 millimeters per second, greater than or equal to 5 millimeters per second, greater than or equal to 8 millimeters per second, greater than or equal to 1 centimeter per second, greater than or equal to 5 centimeters per second, greater than or equal to 10 centimeters per second, or greater than or equal to 25 centimeters per second. In some embodiments, the electrolyte solution may flow through a nominal amount of surface area of the electrode at a rate of less than or equal to 50 centimeters per second, less than or equal to 25 centimeters per second, less than or equal to 10 centimeters per second, less than or equal to 5 centimeters per second, less than or equal to 1 centimeter per second, less than or equal to 8 millimeters per second, less than or equal to 5 millimeters per second, less than or equal to 3 millimeters per second, or less than or equal to 2 millimeters per second. Combinations of the foregoing ranges are possible. Other ranges are also possible.

In some embodiments, the flow rates on separate sides of the electrochemical system (e.g., on the cathode side versus on the inner side) may differ, for example based on the electrode present on each side of the electrochemical system. For instance, in some cases, a higher flow rate may be used on the cathode side where a relatively porous electrode may be used in comparison to a lower flow rate on the anode side where a planar electrode may be used. Still other embodiments may have different electrode structures on either side of the electrochemical system and may utilize different flow rates based on the pressure drop associated with each electrode structure and the configuration of the electrochemical system. Different flow rates in different compartments of the electrochemical system may be achieved using multiple pumps, mass flow controllers, sensors, or the like, as described elsewhere herein.

According to some embodiments, the cathode side of an electrochemical cell may be fluidly connected to a recirculation tank. In some embodiments, each of the cathodes in an electrode stack may be fluidically connected to a recirculation tank. In some cases, the compounds that are electrocatalytically generated at the cathode flow from the cathode to the recirculation tank. In some such cases, where the absolute magnitude of the current density of the cathode is held constant, the amount of compound electrogenerated at the cathode may be relatively constant as a function of time. Thus, in some such cases, the solution flowing into the recirculation tank from the cathode may comprise a relatively constant amount of electrogenerated compound while the current density at the cathode is maintained. In some cases, the recirculation tank may further comprise a second inlet through which fresh catholyte solution (e.g., catholyte solution containing no electrogenerated compounds, for example, water) and/or an outlet from which solution containing the electrogenerated compound may be withdrawn therefrom.

In accordance with some embodiments, the volume of the solution in the recirculation tank may be maintained at a constant level, the concentration of the compounds in the recirculation tank may be maintained at a constant level (e.g., after the system equilibrates while the cathode is applying the relatively constant current density), and/or a fraction of the compounds may be withdrawn from the system (e.g., through the outlet) as the system runs continuously. As described elsewhere herein, the flow rate through the cathode side of the electrochemical cell and through the first inlet of the recirculation tank, the flow rate through the second inlet of the recirculation tank, and the flow rate through the outlet of the recirculation tank may be altered depending on the desired current density at the cathode and/or the desired withdrawal rate of the compound from the system.

The system may further comprise any of a variety of sensors. In some cases, sensors for measuring the flow rate into and/or out of the components of the electrochemical system (e.g., the electrode stack, the cathodic reservoir, the anodic reservoir) may be used. Other sensors are also possible, e.g., sensors for measuring the concentration of species in solution (e.g., the concentration of electrogenerated compound). In some embodiments, a sample of solution from the electrochemical system may be withdrawn and tested external the system to determine a concentration of species in solution. In some embodiments, sensors may be present to determine the generation and/or presence of undesirable materials, e.g., precipitates. According to some embodiments, species such as precipitates may be observed through optical means (e.g., spectroscopy) and/or via an increase in resistance or other electrical methods. Other methods are also possible. The sensors may provide real-time feedback and/or be in communication with processors and/or controllers in order alter system parameters in real time to increase system efficiency, for example, the flow rates and/or applied current densities. In some cases, the system may comprise flow sensors, but not other types of sensors. Still other systems do not comprise any sensors.

According to some embodiments, methods comprising mixing a liquid and a gas to form a two-phase solution, flowing the two-phase solution over and/or through at least a portion of an electrode comprising a substrate and applying a voltage to the electrode such that at least a portion of the gas participates in a reaction to electrochemically generate a compound at the electrode are detailed. In some cases, the solution containing the electrogenerated compound is recirculated to the compartment containing the electrode at least until the compound is present in solution in an amount of greater than or equal to 2 wt %. For example, referring again to FIGS. 3-4, a two-phase solution may be flowed through a cathode substrate of an electrochemical cell, wherein the electrochemical cell may be present within an electrode stack.

The use of a two-phase solution, in accordance with some embodiments, may facilitate electrocatalytic reactions involving gaseous reactants and liquid phase reactant. It is believed that the use of two-phase solutions may promote the formation of three-phase boundaries on the surface of the electrode (e.g., on an external surface and/or in the void space of the electrode). In some cases, two phase solutions generally refer to the simultaneous flow of two different phases, for example, gas and liquid, that are interspersed.

The characteristics of two-phase solutions may depend on the relative flow rates of the constituent phases, the properties of the phases, and/or the interactions of the phases with the system (e.g., the fluidic channel transporting the two-phase solution, the electrode structure, etc.).

In some embodiments, the liquid may be flowed to the intersection where two-phase solution may be generated at any of a variety of rates. In some cases, the rate of liquid flow may be dependent on the volumetric size of the system. In some embodiments, the liquid may be flowed to the intersection where two-phase solution may be generated at a rate of greater than or equal to 0.2 mL/min, greater than or equal to 0.5 mL/min, greater than or equal to 1 mL/min, greater than or equal to 2 mL/min, greater than or equal to 5 mL/min, greater than or equal to 30 mL/min, greater than or equal to 50 mL/min, greater than or equal to 100 mL/min, greater than or equal to 500 mL/min, greater than or equal to 1000 mL/min, or greater than or equal to 2500 mL/min. In some cases, the liquid may flow at a rate of less than or equal to 5000 mL/min, less than or equal to 2500 mL/min, less than or equal to 1000 mL/min, less than or equal to 500 mL/min, less than or equal to 100 mL/min, less than or equal to 50 mL/min, less than or equal to 30 mL/min, less than or equal to 5 mL/min, less than or equal to 2 mL/min, less than or equal to 1 mL/min, or less than or equal to 0.5 mL/min. Combinations of the foregoing ranges are possible. Other ranges are also possible.

In some embodiments, the gas may be flowed to the intersection where two-phase solution may be generated at of a variety of rates. In some cases, the mass flow rate of liquid may be dependent on the volumetric size of the system. In some embodiments, the gas may be flowed to the intersection where two-phase solution may be generated at a mass flow rate of greater than or equal to 0.2 standard liters per minute (slpm), greater than or equal to 1 slpm, greater than or equal to 1 slpm, greater than or equal to 5 slpm, greater than or equal to 10 slpm, greater than or equal to 25 slpm, or greater than or equal to 35 slpm. In some cases, the liquid may flow at a rate of less than or equal to 50 slpm, less than or equal to 35 slpm, less than or equal to 25 slpm, less than or equal to 10 slpm, less than or equal to 5 slpm, or less than or equal to 1 slpm, less than or equal to 0.5 slpm. Combinations of the foregoing ranges are possible. Other ranges are also possible.

In some cases, the ratio of the gas present in the two-phase solution to the amount of gas converted to compound in the electrocatalytic reaction may be greater than or equal to 2, greater than or equal to 3, greater than or equal to 4, greater than or equal to 5, greater than or equal to 6, greater than or equal to 7, greater than or equal to 8, or greater than or equal to 9. In some cases, the ratio of the gas present in the two-phase solution to the amount of gas converted to compound in the electric catalytic reaction may be less than or equal to 10, less than or equal to 9, less than or equal to 8, less than or equal to 7, less than or equal to 6, less than or equal to 5, less than or equal to 4, or less than or equal to 3. Combinations of the four going ranges are possible (e.g., greater than or equal to 1 and less than or equal to 10, greater than or equal to 4 and less than or equal to 6). Other ranges are also possible.

The electrocatalysis performed in the systems described herein, in accordance with some embodiments, involve flowing solution across and/or through at least one of the electrodes in the system. For example, as described elsewhere herein, the system may include an electrode containing a substrate, a pretreatment of hydrophobic particles (e.g., PTFE particles), and a catalyst layer comprising an active material and/or hydrophobic particles. In some such embodiments, pressurized flow may be used to facilitate the flow of solution across and/or through at least one of the electrodes of the system. In some embodiments, pressurized flow of the two-phase solution may facilitate the use of two-phase solutions in combination with the electrode structures described herein.

To achieve pressurized flow of the fluid across and/or through the electrode of the system, in some embodiments, any of a variety of methods may be used. For example, in some embodiments, fluid pumps (e.g., peristaltic pumps, diaphragm pumps, gear pumps, centrifugal pumps, rotary vane pumps), compressed gas, hydraulic systems, or pneumatic systems may be used. Liquid ring compressors are particularly advantageous for providing pressure to gases. In some cases, liquid ring compressors may humidify the gas. Other methods may also be used, as this disclosure is not so limited. In some cases, mass flow controllers and/or mass flow sensors may be coupled with the methods for pressurizing flow to achieve certain flows rates over and/or through at least one of the electrodes of the systems.

Any of a variety of pressures may be used, in accordance with some embodiments. Pressures may be varied, in some cases, to achieve different flow rates of the solution across and/or through the electrodes of the system. Different flow rates may be desirable, in accordance with some embodiments, based on a variety of factors, including mass transport of the reactants to the electrode, mass transport of the electrogenerated compounds away from the electrode, and/or maintaining certain current densities at the electrode, as described in more detail elsewhere herein.

In some embodiments, recirculating the catholyte and/or the anolyte solution after it passes over and/or through the cathode and anode, respectively, may provide any of a variety of advantages. For example, in some cases, recirculating an electrogenerated compound from the anode and/or cathode in the system may reduce concentration gradients of the electrogenerated compound near the anode or cathode. According to some such embodiments, this may reduce and/or eliminate the formation of precipitates including and/or involving the electrogenerated compound.

For example, as shown in FIG. 1, solution containing the electrogenerated compound that flows from the outlets A8 and C4 of the cathode or anode may flow to reservoirs A4 and C5. The electrogenerated compound collected in at least one of the reservoirs may be separated and/or drained from the reservoir via an outlet on the reservoir. For example, solution from the cathodic reservoir is removed via outlet C6 to obtain solution containing the electrogenerated compound. In place of the removed solution, fresh reactant solution, e.g., a solution having a composition substantially the same as the solution flowed over the electrode before electrogenerating any compounds and/or deionized water containing essentially none of the electrogenerated compound, may be added to the reservoir in place of the removed solution via the inlet C1, which may help to maintain a constant level of electrogenerated compound within the reservoir (e.g., cathodic reservoir) when operating the system at steady state.

The system shown in FIG. 1 may provide various advantages, for instance, the configuration of the system facilitates the recirculation of the compound in the catholyte (as illustrated, e.g., or anolyte in alternative embodiments) and thus may minimize concentration gradients of the electrogenerated compound near the cathode. Moreover, the system shown in FIG. 1 may facilitate the continuous operation of the system while also continuously drawing off electrogenerated compound from, for example, the catholyte reservoir C5 via outlet C6. In such a manner, using outlet C6 and inlet C1 of the catholyte reservoir C5, the rate at which electrogenerated compound is drawn from the catholyte reservoir C5 may be based on the flow rate of the catholyte reservoir solution through the outlet C6. In some such cases, if this rate of electrogenerated compound removal through the outlet is balanced with the rate at which the compound is electrogenerated at the electrode (e.g., determined from the current density), then the concentration of the electrogenerated compound throughout the system may be maintained at a relatively constant value during steady-state operation.

In some embodiments, due to the relatively high flow rates used in the system, the solution flowing from the outlet of the system into a reservoir may initially contain a relatively low amount of electrogenerated compound. For example, in some cases where the system is electrogenerating hydrogen peroxide, the cathode may generate no more than 2 wt %, no more than 1 wt %, no more than 0.8 wt %, no more than 0.6 wt %, no more than 0.4 wt %, no more than 0.2 wt %, no more than 0.1 wt %, no more than 0.08 wt %, no more than 0.05 wt %, no more than 0.03 wt %, no more than 0.01 wt %, no more than 0.008 wt %, no more than 0.005 wt %, or no more than 0.003 wt % of hydrogen peroxide in the solution flowing from the outlet of the electrochemical system after a single pass by the cathode (e.g., or cathodes in an electrode stack). In some such cases, it may be advantageous to recirculate the solution from the system to accumulate more electrogenerated compound in the solution flowing through the system. In some embodiments, the system may be configured so that solution is not withdrawn from the reservoir until a certain amount of electrogenerated compound is in the electrolyte solution being recirculated through the system (e.g., present in the reservoir).

In accordance with some embodiments, the electrogenerated compound may be recirculated through the system without withdrawing any electrogenerated compound (e.g., via outlet C5 in FIG. 1) until the electrogenerated compound is present in solution in a predetermined concentration, for example, present in the solution in an amount of at least 0.2 wt %, at least 0.4 wt %, at least 0.6 wt %, at least 0.8 wt %, at least 1 wt %, at least 1.5 wt %, at least 2 wt %, at least 3 wt %, at least 4 wt %, at least 5 wt %, or at least 6 wt % of the solution. In some cases, the solution may be recirculated without removing any electrogenerated compound in solution until the electrogenerated compound is present in solution in an amount of no more than 7 wt %, no more than 6 wt %, no more than 5 wt %, no more than 4 wt %, no more than 2 wt %, no more than 1.5 wt %, no more than 1 wt %, no more than 0.8 wt %, no more than 0.6 wt %, or no more than 0.4 wt % of the solution. Combinations of the foregoing ranges are possible (e.g., greater than or equal to 2 wt % and less than or equal to 6 wt %). Other ranges are also possible. In some embodiments, once the electrogenerated compound is present at a desired amount in the recirculating solution, at least a portion of the electrogenerated compound may be withdrawn from the recirculated solution via an outlet, for example, outlet C6 of the catholyte reservoir as shown in FIG. 1. In some embodiments, as described elsewhere herein, fresh solution (e.g., deionized water and/or solution not comprising the electrogenerated compound) may be introduced to the reservoir through inlet C1 at the same rate at which solution is withdrawn from the reservoir, in some embodiments, which may provide a method to continuously produce solution comprising the electrogenerated compound at a desired concentration.

Figure 8:
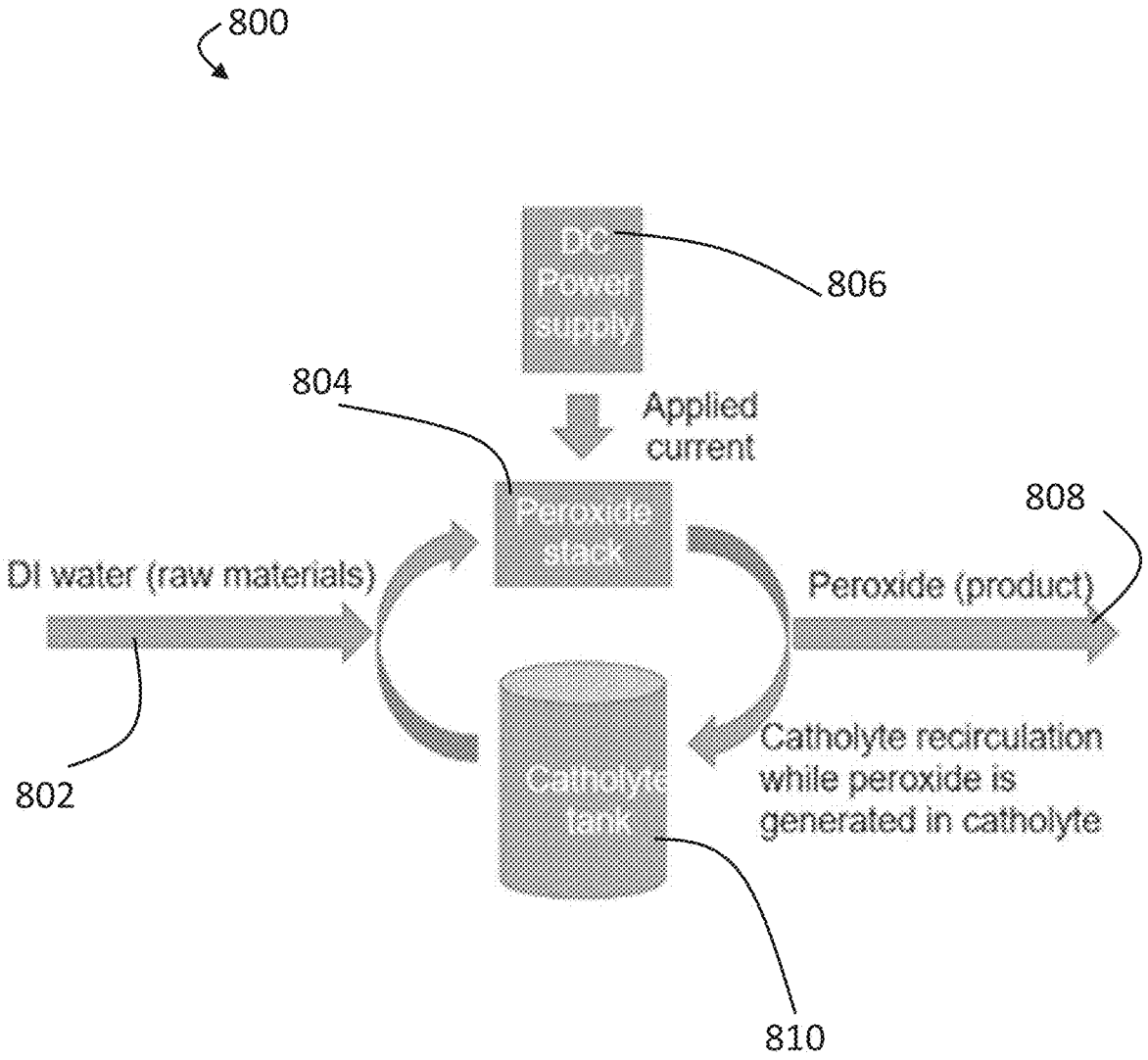
FIG. 8 is a method diagram for flow recirculation, according to some embodiments.

FIG. 8 shows a general flow diagram 800 related to recirculating the electrolyte in an electrochemical system for generating hydrogen peroxide. Other embodiments for electrogenerating other compounds are also possible, as this disclosure is not so limited. The raw materials, e.g., deionized (DI) water, or water having a at least a certain level of resistivity as described elsewhere herein, and/or other electrolyte components and/or reactants may be flowed into electrochemical stack 804 (e.g., peroxide stack, the electrochemical system). An applied current density may be applied 806 to the electrochemical stack 804 via a power source to electrochemically generate peroxide (e.g., or other compounds in other systems). Electrochemically generating compounds such as peroxide, in some cases, refers to applying a voltage to an electrode to facilitate a reduction and/or oxidation reaction at the electrode. In some such embodiments described herein, such as peroxide generation, at least one reactant is reduced and/or oxidized at the electrode, which then may react with another species in solution to form the final, electrogenerated compound. In some cases, the solution containing the electrogenerated produce may be flowed to a reservoir 810, for instance, a catholyte tank, where it may be recirculated to the peroxide stack. When recirculating the solution, the electrogenerated compound may be diluted before recirculating by mixing with raw materials 802. In some cases, after electrogenerating the compound, some compound may be withdrawn from the solution 808 for use elsewhere. According to some embodiments, recirculation before withdrawing the electrogenerating compound 808 may continue until a desired concentration of the electrogenerated compound is present in the electrolyte solution. For example, raw materials may not be continuously introduced in the system 802 until electrogenerated compound is being withdrawn 808, so as to maintain a relatively constant concentration of the electrogenerated compound in the system.

Some aspects of the present disclosure are related to methods of using and/or operating the systems described herein.

According to some embodiments, the electrode structures described elsewhere herein may be used in the systems, for example an electrode including a substrate. In some cases, electrode structures disclosed in the present application may facilitate the formation of three phase boundaries, at which certain electrochemical reactions may occur (e.g., reduction of oxygen). As disclosed elsewhere herein, it is believed that the discrete hydrophilic and hydrophobic regions on the surface of the electrode promote the formation of such three-phase boundaries.

In some embodiments, to maintain the discrete hydrophobic and hydrophilic regions on the electrode (e.g., the hydrophilic active material such as carbon and/or the hydrophobic particles such as PTFE particles), it may be beneficial to keep the electrode dry (i.e. having minimal or no continuous bulk water on and/or throughout the substrate of the electrode) when not in use. In some cases, flowing a gas over the electrode structure before flowing a solution over and/or through the electrode may be advantageous. In some cases, the gas may be dry. In some cases, the gas may have a relative humidity of greater than or equal to 50%, greater than or equal to 75%, greater than or equal to 90%, up to 100%. In some embodiments, the gas may comprise $O_2$, $N_2$, $H_2$, Ar, or the like. Other gases are also possible. Combinations of gases, where the combinations have various ratios of constituent gases, are possible.

According to some embodiments, after flowing the gas, solution may be flowed over and/or through the electrode. In some embodiments, the solution may consist of deionized water. In some cases, the solution may be flowed over and/or through the electrode with the gas. In some cases, the solution may comprise an electrolyte solution, for example, a solution comprising water and electrolyte ions (e.g., dissociated NaOH, or the like, as described elsewhere herein).

In some cases, using the systems disclosed in the present disclosure, electrochemical reactions at the electrodes may occur in a relatively efficient manner. For example, the electrochemical reactions may proceed at a relatively high faradaic efficiency with a low percentage of side products, in some embodiments. According to some embodiments, the electrochemical reactions may proceed without having to apply a significant amount of overpotential when compared to the thermodynamic reduction potential of the reaction. Advantageously, in some such cases, the electrochemical reaction may occur without needing to apply a significant amount of overpotential despite, for example, the relatively sluggish kinetics of the reaction (e.g., oxygen reduction, $CO_2$ reduction, or the like) due to the electrode structures described herein and/or the systems disclosed (e.g., flowing a two-phase solution).

In some cases, the faradaic efficiency of at least one of the reactions in the electrochemical system may be relatively high. In some embodiments, the faradaic efficiency of the reduction reaction (e.g., the two-electrode reduction or oxygen to hydrogen peroxide) in the electrochemical system may be relatively high, for example, due to the electrode structure and/or the system design using a two-phase solution. According to some embodiments, the faradaic efficiency of at least one of the reactions in the electrochemical system may be greater than or equal to 80%, greater than or equal to 85%, greater than or equal to 90%, greater than or equal to 95%, greater than or equal to 98%, greater than or equal to 99%, greater than or equal to 99.5%, or greater than or equal to 99.9%. In some such cases, the faradaic efficiency may refer to the reduction reaction (e.g., oxygen reduction to hydrogen peroxide). In some such cases, the faradaic efficiency may refer to the oxidation reaction.

Accordingly, in some embodiments, due to the relatively high faradaic efficiencies of the at least one reaction in the electrochemical system, relatively low over potentials may be used to obtain relatively high current densities at the electrodes of the system. For example, in some cases, the overpotential input into the system relative to the thermodynamic reduction potential of the half reaction (e.g., the reduction reaction) may be less than or equal to 500 millivolts, less than or equal to 400 millivolts, less than or equal to 300 millivolts, less than or equal to 200 millivolts, less than or equal to 100 millivolts, less than or equal to 50 millivolts, or less than or equal to 20 millivolts. In some cases, the overpotential input into the system relative to the thermodynamic potential difference of the two half cells (e.g., between the anodic and cathodic reactions) may be less than or equal to 1 volt, less than or equal to 900 millivolts, less than or equal to 800 millivolts, less than or equal to 700 millivolts, less than or equal to 600 millivolts, less than or equal to 500 millivolts, or less. In some embodiments, the overpotential input into the system may be related to the identity of the half reactions, potential loss due to the presence of the separator, concentration polarization, and/or the operating conditions (e.g., current density, temperature, or the like).

In some embodiments, the relatively high faradaic efficiency towards certain electrochemical reactions using the electrode structures and/or the systems described herein may facilitate the application of relatively high current densities at the electrodes in the systems without significant energy losses and/or generation of a significant amount of side products. In some cases, an absolute magnitude of the current density at the electrode (e.g., at the cathode, for example, during the oxygen reduction reaction; as calculated using the projected 2-D area of the untreated substrate) may be greater than or equal to 20 $mA/cm^2$, greater than or equal to 50 $mA/cm^2$, greater than or equal to 100 $mA/cm^2$, greater than or equal to 150 $mA/cm^2$, greater than or equal to 200 $mA/cm^2$, greater than or equal to 300 $mA/cm^2$, greater than or equal to 400 $mA/cm^2$, greater than or equal to 500 $mA/cm^2$, greater than or equal to 600 $mA/cm^2$, greater than or equal to 700 $mA/cm^2$, or greater than or equal to 800 $mA/cm^2$. In some embodiments, the absolute magnitude of the current density at the electrode may be less than or equal to 800 $mA/cm^2$, less than or equal to 700 $mA/cm^2$, less than or equal to 600 $mA/cm^2$, less than or equal to 500 $mA/cm^2$, less than or equal to 400 $mA/cm^2$, less than or equal to 300 $mA/cm^2$, less than or equal to 200 $mA/cm^2$, less than or equal to 150 $mA/cm^2$, less than or equal to 100 $mA/cm^2$, less than or equal to 50 $mA/cm^2$. Combinations of the foregoing ranges are possible. Other ranges are also possible.

In some cases, while the electrochemical reactions in the system may be run at a certain current densities (e.g., greater than or equal to 150 $mA/cm^2$) when the system is operating at steady state, it may be advantageous to slowly increase the absolute magnitude of the current density when initiating the system. For instance, in some cases, slowly ramping the absolute magnitude of the current density may gradually heat the system (e.g., the solution flowing through the system), so as to prevent and/or minimize the amount of precipitate that may form in the system. In some cases, heating the system may occur by joule heating. In some embodiments, the system may have heaters incorporated, for example, resistive heating coil and/or a heat exchanger. Other heaters are also possible. According to some embodiments, the solution may be heated before being flowed through the system. In some cases, the absolute magnitude of the current density may be increased in a linear ramping function, in a stepwise function, in an exponential function, or the like.

In some cases, the absolute magnitude of the current density may be increased at a rate of greater than or equal to 3 $mA/cm^2/min$, greater than or equal to 25 $mA/cm^2/min$, greater than or equal to 50 $mA/cm^2/min$, greater than or equal to 100 $mA/cm^2/min$, or greater than or equal to 150 $mA/cm^2/min$. In some embodiments, the absolute magnitude of the current density may be increased at a rate of less than or equal to 200 $mA/cm^2/min$, less than or equal to 150 $mA/cm^2/min$, less than or equal to 100 $mA/cm^2/min$, less than or equal to 50 $mA/cm^2/min$, or less than or equal to 25 $mA/cm^2/min$. Combinations of the foregoing ranges are possible. Other ranges are also possible.

After an initial increase in the absolute magnitude of the current density, the average temperature of the solution and/or the system may increase (e.g., by joule heating) to be greater than or equal to 25 degrees C., greater than or equal to 30 degrees C., greater than or equal to 35 degrees C., or greater than or equal to 40 degrees C. before increasing the absolute magnitude of the current density again. In some cases, the average temperature of the solution and/or the system may increase to be less than or equal to 45 degrees C., less than or equal to 40 degrees C., less than or equal to 35 degrees C., or less than or equal to 30 degrees C. for altering the absolute magnitude of the current density again. Combinations of the foregoing ranges are possible. Other ranges are also possible.

Some aspects of the foregoing methods are related to increasing the efficiency of the system and/or minimizing and/or preventing the formation of a precipitate in the system. In some cases, the amount of precipitate formed in the system may be less than or equal to 10 g, less than or equal to 1 g, less than or equal to 0.1 g, or less than or equal to 0.01 g, for example, after 6 hours of continuous operation of the system. In some embodiments, the precipitate may comprise sodium peroxide hydrates. In some cases, the precipitate may comprise Fe and/or Ni. In some embodiments, the precipitate may comprise iron oxide. According to some embodiments, the precipitate may comprise $Fe_2O_3$. In some cases, the precipitate may comprise nickel oxide and/or nickel hydroxide. In some cases, the precipitate comprises NiO and/or $Ni(OH)_2$ and/or NiOOH. Other precipitates are also possible. In some embodiments, the precise identity of the precipitate may not be known.

In some embodiments, where a precipitate is formed at a relatively slow rate (e.g., 0.01 g precipitate/6 hours of operation), the precipitate may accumulate over long periods of operation of the system. The inventors have recognized in the context of the present invention that periodically cleaning the system may provide certain advantages, such as removing the precipitate and/or prolonging the lifetime of the system.

In some embodiments, a precipitate may form at the intersection point of gas and liquid injection points. The use of humidified gas prevents the formation of precipitate, in accordance with some embodiments. The use of a liquid ring compressor may be advantageous as it naturally humidifies reactant gases during its operation.

In some cases, the system may be electrochemically generating a compound and then an absolute magnitude of a current density of the system may be decreased to less than or equal to 1 $mA/cm^2$, less than or equal to 0.1 $mA/cm^2$, or less, for example to 0 $mA/cm^2$. In some embodiments, to remove the precipitate, a solution comprising a reducing agent and/or a chelation agent (e.g., a cleaning solution) may be flowed through the system. In other embodiments, the solution may be deionized water with no additives. The solution may be flowed through the system with a gas, for instance, as a two-phase solution, in some cases. In other embodiments, the solution may be flowed through the system as is without a gas.

The reducing agent of the solution to remove the precipitate may, in accordance with some embodiments, comprise sodium hydrosulfite, sodium metabisulfite, and/or sodium sulfite. Other reducing agents are possible. In some cases, the solution for removing the precipitate may comprise a chelating agent, such citric acid. Other chelating agents are also possible.

The solution, according to some embodiments, may be continuously flowed through the system to clean the system for at least 20 seconds and no more than 7 days. In some cases, such cleaning of the system may be performed at least once a year and no more than once a day.

In some cases, deionized water may be flowed through the system after the solution comprising the reducing agent and the chelating agent is used to clean the system. The deionized water may be co-flowed through the system with a gas, e.g., to form a two-phase solution, to remove any remaining precipitate and/or cleaning solution and prevent flooding of the cathode electrode structure. In some embodiments, flowing the cleaning solution and then the deionized water may be done immediately before operating the system and/or before shutting down the system.

In some embodiments, after decreasing the absolute magnitude of the applied current density in the electrochemical system, a solution is flowed through the system for at least 1 minute, at least 5 minutes, or at least 10 minutes. In some cases, the solution comprises the electrolyte used during operation of the electrochemical system. In some embodiments, the solution comprises water having a resistivity of greater than or equal to 15 megaohms cm, greater than or equal to 17 megaohms cm, greater than or equal to 18 megaohms cm, or greater than or equal to 18.2 megaohms cm at 25 degrees C. Gas may be flowed through the system, in some cases, with the solution, for example, as a two-phase solution. In some embodiments, after flowing the solution, gas may be flowed through the system to purge to electrode stack of liquid and/or to maintain the hydrophobicity of the electrode in the system. Accordingly, the gas may comprise $O_2$, $N_2$, $H_2$, Ar, or the like. Other gases and/or combinations of the gases are also possible.

In some embodiments, the electrodes, systems, and methods described herein are generally related to improving the efficiency of certain electrochemical reactions within systems and/or the lifetime of such systems. For example, in some cases, a system may electrogenerate hydrogen peroxide at a relatively high efficiency with little overpotential and an electrolyte solution comprising approximately 2 M NaOH and 1 M hydrogen peroxide at 35 degrees C. at least 1,000 hours, at least 10,000 hours, or at least 30,000 hours. In some such embodiments, the system may run no more than 50,000 hours, no more than 30,000 hours, or no more than 10,000 hours. In some cases, due to some of the aspects of the electrode structure and/or the system described elsewhere herein, some systems may operate at a relatively high efficiency (e.g., at least 90% faradaic efficiency, at least 95% faradaic efficiency, or the like for the target compound) with little overpotential (e.g., no more than 1000 millivolts, no more than 500 millivolts, no more than 200 millivolts, no more than 100 millivolts, or the like) for at least 100 hours, at least 1,000 hours, or at least 10,000 hours. In some cases, the system may operate with such efficiencies for no more than 50,000 hours, no more than 10,000 hours, or no more than 1,000 hours. In some cases, the performance over long times may be estimated, for example, by running the systems of interest at relatively higher absolute magnitudes of applied current densities or voltages, relative to parameters sufficient for electrogenerating the desired compound.

The above-described embodiments of the technology described herein can be implemented in any of numerous ways. For example, the embodiments may be implemented using hardware, software or a combination thereof. When implemented in software, the software code can be executed on any suitable processor or collection of processors, whether provided in a single computing device or distributed among multiple computing devices. Such processors may be implemented as integrated circuits, with one or more processors in an integrated circuit component, including commercially available integrated circuit components known in the art by names such as CPU chips, GPU chips, microprocessor, microcontroller, or co-processor. Alternatively, a processor may be implemented in custom circuitry, such as an ASIC, or semicustom circuitry resulting from configuring a programmable logic device. As yet a further alternative, a processor may be a portion of a larger circuit or semiconductor device, whether commercially available, semi-custom or custom. As a specific example, some commercially available microprocessors have multiple cores such that one or a subset of those cores may constitute a processor. Though, a processor may be implemented using circuitry in any suitable format.

Further, it should be appreciated that a computing device including one or more processors may be embodied in any of a number of forms, such as a rack-mounted computer, a desktop computer, a laptop computer, or a tablet computer. Additionally, a computing device may be embedded in a device not generally regarded as a computing device but with suitable processing capabilities, including a Personal Digital Assistant (PDA), a smart phone, tablet, or any other suitable portable or fixed electronic device.

Also, a computing device may have one or more input and output devices. These devices can be used, among other things, to present a user interface. Examples of output devices that can be used to provide a user interface include display screens for visual presentation of output and speakers or other sound generating devices for audible presentation of output. Examples of input devices that can be used for a user interface include keyboards, individual buttons, and pointing devices, such as mice, touch pads, and digitizing tablets. As another example, a computing device may receive input information through speech recognition or in other audible format.

Such computing devices may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, the embodiments described herein may be embodied as a computer readable storage medium (or multiple computer readable media) (e.g., a computer memory, one or more floppy discs, compact discs (CD), optical discs, digital video disks (DVD), magnetic tapes, flash memories, RAM, ROM, EEPROM, circuit configurations in Field Programmable Gate Arrays or other semiconductor devices, or other tangible computer storage medium) encoded with one or more programs that, when executed on one or more computers or other processors, perform methods that implement the various embodiments discussed above. As is apparent from the foregoing examples, a computer readable storage medium may retain information for a sufficient time to provide computer-executable instructions in a non-transitory form. Such a computer readable storage medium or media can be transportable, such that the program or programs stored thereon can be loaded onto one or more different computing devices or other processors to implement various aspects of the present disclosure as discussed above. As used herein, the term "computer-readable storage medium" encompasses only a non-transitory computer-readable medium that can be considered to be a manufacture (i.e., article of manufacture) or a machine. Alternatively or additionally, the disclosure may be embodied as a computer readable medium other than a computer-readable storage medium, such as a propagating signal.

The terms "program" or "software" are used herein in a generic sense to refer to any type of computer code or set of computer-executable instructions that can be employed to program a computing device or other processor to implement various aspects of the present disclosure as discussed above. Additionally, it should be appreciated that according to one aspect of this embodiment, one or more computer programs that when executed perform methods of the present disclosure need not reside on a single computing device or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

The embodiments described herein may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Further, some actions are described as taken by a "user." It should be appreciated that a "user" need not be a single individual, and that in some embodiments, actions attributable to a "user" may be performed by a team of individuals and/or an individual in combination with computer-assisted tools or other mechanisms.

In some embodiments, the determining and/or monitoring of parameters of the system (e.g., flow rates, temperatures, concentrations of compounds, or the like) may be performed in real time and may be used to provide real-time feedback to adjust one or more parameters of the system (e.g., flow rate, applied current density, voltage, or the like). Such methods may be implemented in certain cases by one or more controllers, e.g., including at least one processor operatively coupled to the various controllable portions of the system as disclosed herein. The method may be embodied as computer readable instructions stored on non-transitory computer readable memory associated with at least one processor such that when executed by at least one processor of the system may perform any of the actions related to the methods disclosed herein. Additionally, it should be understood that the disclosed order of the steps above is exemplary and that the disclosed steps may be performed in a different order, simultaneously, and/or may include one or more additional intermediate steps not shown as the disclosure is not so limited.

The following examples are intended to illustrate certain embodiments of the present invention, but do not exemplify the full scope of the invention.

Example 1

The following example describes an electrochemical system for generating hydrogen peroxide.

A cathode block was machined from resin-impregnated graphite. An inlet passage was configured to carry premixed oxygen and aqueous solution (e.g., a two-phase solution) to the cathode electrode comprising a non-woven carbon substrate pretreated with hydrophobic particles and a catalyst layer from an external source. An outlet passage was connected to the cathode block generally parallel to the inlet passage.

An anode block was constructed using a nickel block and an anode electrode comprising an expanded nickel metal mesh. An inlet passage was configured to carry electrolyte to the anode from an external source. An outlet passage was connected to the anode generally parallel to the inlet passage.

The anode was arranged parallel to the cathode block, with the anode and the cathode separated by a cation exchange membrane (e.g., Nafion) in order to allow conduction of sodium ions.

A mixture of aqueous electrolyte and oxygen was delivered to the cathode block via the inlet passage, flowed through the porous cathode, and then flowed out of the cathode block via the outlet passage. Aqueous electrolyte was delivered to the anode block via the inlet passage, through the anode, and out of the anode block via the outlet passage. The flow rates in the cathode and anode blocks were independently controlled via mass flow controllers and/or peristaltic pumps. The electrolyte through the anode block flowed while the electrolyte/oxygen mixture flowed through the cathode block, and a voltage of 1.0-1.4 V was applied. Table 1 shows the system generated hydrogen peroxide in an amount of 0.2-0.3 wt % of the electrolyte-oxygen mixture per pass over the cathode at an efficiency of approximately 98%.

TABLE 1

Operational parameters of the system for generating hydrogen peroxide.

| Quantity | Value |
|---|---|
| j ($A/cm^2$) | 0.15-0.4 |
| V | 1.0-1.5 |
| Faradaic Efficiency (%) | Approximately 98 |
| $H_2O_2$ (wt %) | 0.005-0.5 wt % per pass (e.g., and up to 5 wt % during recirculation) |
| NaOH (wt %) | 2.1:1-3:1 ratio, 2-7M anode |
| $O_2$ in cathode block (stoichiometric ratio compared to $H_2O_2$, x) | 2x-10x |
| P (atm) | 0.5-3 |
| Electrode area ($cm^2$) | 100-500 |
| Separator | PFSA membrane |
| Catalyst | Carbon with PTFE |
| Electrode | Carbon paper/cloth/felt |
| Flow field | Forced convection |

Example 2

The following example describes the pretreatment of electrodes.

Figure 9A:
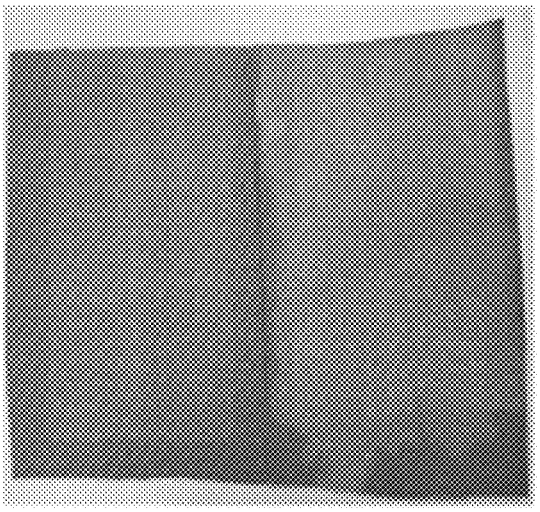
FIGS. 9A-9B are images of pretreated electrodes, according to some embodiments.
Figure 9B:
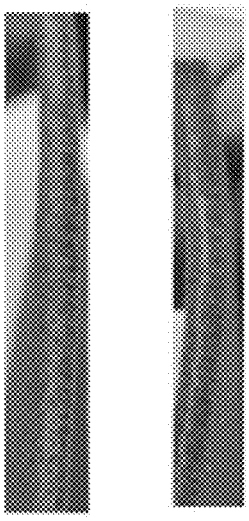

Electrodes were pretreated with PTFE particles suspended in an alcohol (e.g., isopropyl alcohol, IPA) or in water with surfactant. FIG. 9A are images of the electrodes obtained from the pretreatment. The electrode on the left shows the results obtained from IPA-pretreated electrode, whereas the right image shows the water-pretreated electrode. In the case where the solvent was IPA, the electrodes had a relatively uniform coating of PTFE (e.g., after the IPA evaporated) when compared to the electrodes prepared using water and surfactant mixture as the solvent. FIG. 9B show alternative cross-sectional images of the electrodes shown in FIG. 9A. Again, the IPA-treated electrode on the left shows a more homogeneous distribution of PTFE particles than the water-treated electrode on the right, which shows PTFE agglomerating on one side of the electrode. The results show pretreating the electrode with a solution of IPA results in a relatively uniform distribution of PTFE on the substrate, relative to pretreating with a solution of water and surfactant.

Example 3

The following example describes the construction and operation of an electrochemical system.

An electrochemical system 1 as shown in FIG. 1 was constructed by the following method. First, electrochemical cells were constructed, with each cell comprising an anode plate, a cathode plate, and a separator. These electrochemical cells were then arranged in sequence to form a stack S1. This stack was clamped with compression plates. Anolyte inlet A7 and anode fluid outlet A8 were provided and connected to the anode plate and fluidically connected to the anode of each cell via a common manifold and/or manifolds. Catholyte inlet C3 (e.g., for liquid) and cathode gas inlet O2 and outlet C4 were provided and connected to the cathode plate and fluidically connected to the cathode of each cell via a common manifold and/or manifolds.

An anolyte pump A5 was used to connect a reservoir A4 of anolyte to the anolyte inlet A7. A catholyte pump C2 was used to connect a reservoir of catholyte C5 to the catholyte inlet C3. Product gases and/or excess reactant gases were captured in a collection tank O8 through an anode vent O4 and cathode vent O3 and sent to recirculate to the cathode by a liquid ring compressor O5. The flow rates of the catholyte, anolyte, reactant gases, and product gases were metered and regulated by flow control devices (not shown).

A current was applied to the electrode stack while the anolyte and catholyte and reactant gas were flowing through the stack in order to electrogenerate compounds.

Example 4

The following example describes electrodes having different substrates, where each of the electrodes are for forming hydrogen peroxide. Each electrode was assembled into an electrochemical cell comprising the cathode electrode of interest, a separator, and a porous metal anode.

Figure 10:
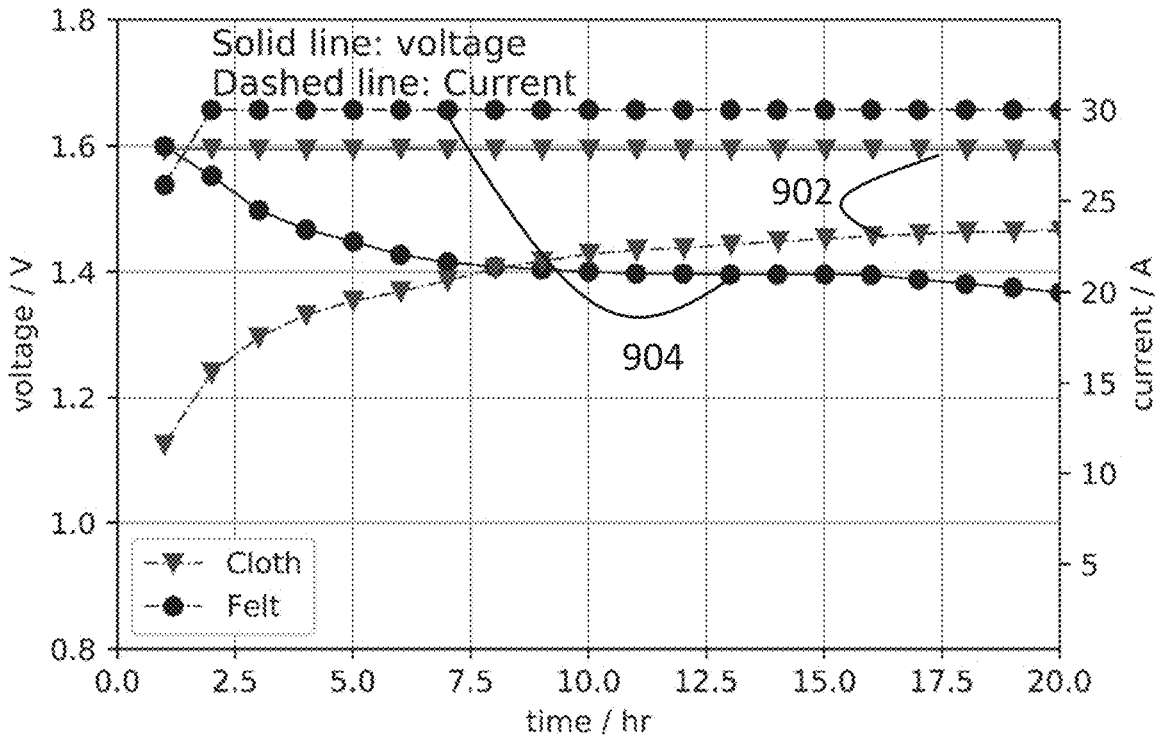
FIG. 10 is a plot of voltage vs time for various electrodes, according to some embodiments.

Two electrodes were used for peroxide generation, one comprising a substrate comprising carbon cloth and a second comprising a substrate comprising carbon felt (e.g., non-woven fibers). The electrodes were each pretreated with PTFE powder suspended in IPA and then a slurry comprising PTFE powder, PTFE dispersion as a binder, and an active material comprising carbon was applied to the electrode. The electrode was sintered before the experiments. The electrolyte for each experiment was similar to that used in Table 1. The results are shown in FIG. 10. The carbon cloth 902 reached a maximum current of 24 A at a cell voltage of 1.6. The carbon felt was able to reach 30 A at a cell voltage of less than or equal to 1.4V. This shows using a substrate comprising carbon felt provides a more efficient generation of peroxide compared to the carbon cloth substrate.

Example 5

The following example describes electrodes that were heated under various conditions during fabrication, where each of the electrodes are for forming hydrogen peroxide.

Figure 11A:
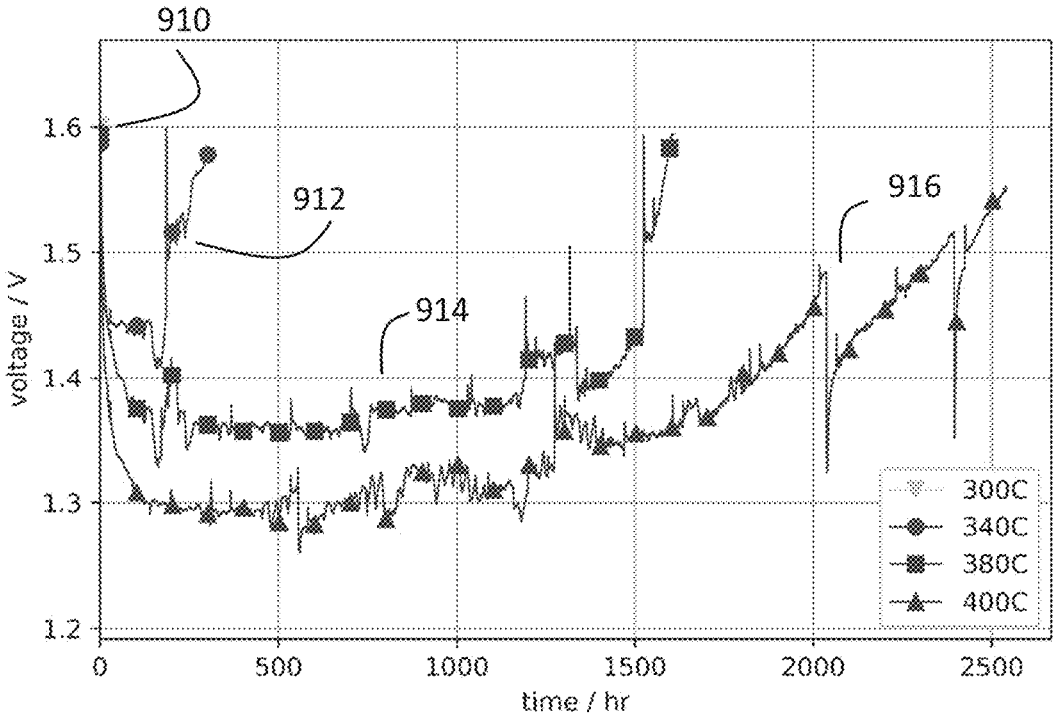
FIGS. 11A-11B are plots of voltage vs time for various electrodes, according to some embodiments.
Figure 11B:
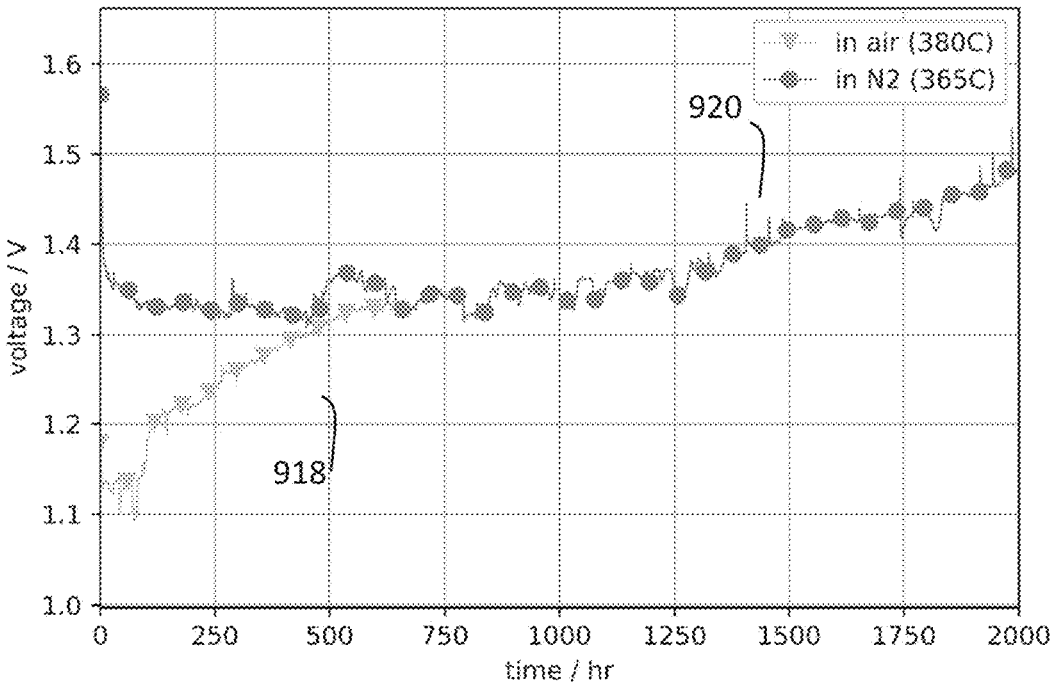

Six electrodes were used for peroxide generation, each heated under different conditions. The electrodes were otherwise prepared as in Example 4 and then used for peroxide generation. The results are shown in FIG. 11A-11B.

The first set of four electrodes was sintered in nitrogen at varying temperatures. The voltage needed to maintain the applied current is shown in FIG. 11A and was inversely related to the sintering temperature, e.g., the electrode 916 with the highest sinter temperature at 400 degrees C. yielded the lowest operating voltage. The electrode 910 with the lowest sintering temperature of 300 degrees C. was unable to maintain the applied current. The electrode 916 sintered at 400 degrees C. also exhibited the longest usable life.

The second set of two electrodes were sintered at similar temperatures in different atmospheres. The voltage required to maintain the applied current is shown in FIG. 11B and was lower for the electrode 918 sintered in the oxidative atmosphere. However, the voltage increased rapidly and the electrode faradaic efficiency began decreasing at 500 hours. The electrode 920 sintered in the inert atmosphere was able to last 2000 hours before the faradaic efficiency exhibited signs of decline. Sintering in the oxidative atmosphere increased the hydrophilicity of the active material comprising carbon. Initially, this provides a higher reactive surface area. However, it quickly begins to flood, disrupting the delivery of oxygen to catalytic sites, ultimately resulting in failure.

Example 6

The following example describes electrodes having different compositions of a slurry comprising PTFE and active material, where each of the electrodes are for forming hydrogen peroxide.

Figure 12:
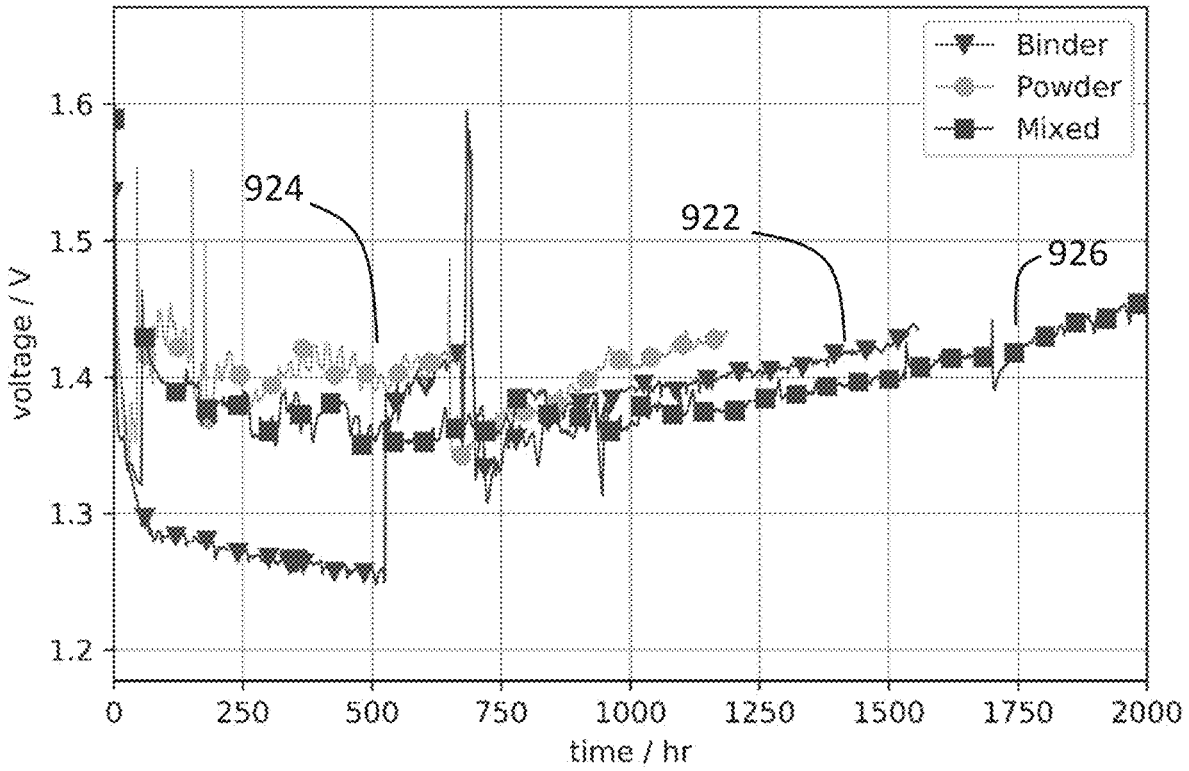
FIG. 12 is a plot of voltage vs time for various electrodes, according to some embodiments.

Three electrodes were prepared for peroxide generation, each using different PTFE particle sources in the slurry containing the active material. The electrodes were otherwise prepared as in Example 4 and then used for peroxide generation. The voltage needed to maintain a current density of 300 mA/cm$^2$ for 50 hours (e.g., PTFE powder only and PTFE powder and binder) or 500 hours (e.g., PTFE binder only) and then to maintain a current density of 400 mA/cm$^2$ on each electrode is shown in FIG. 12. Electrode 922 was prepared using only binder, electrode 924 was prepared using only PTFE powder, and electrode 926 was prepared using PTFE powder and binder. Over the course of the experiment, electrode 926 showed the lowest voltage required to maintain the applied current densities for the majority of the experiment at 400 mA/cm$^2$, indicating a more efficient electrocatalytic reaction compared to the other electrodes. The rate of voltage increase in electrode 926 was also slowest.

Example 7

The following example describes electrodes having different amounts of PTFE in the catalyst layer, where each of the electrodes are for forming hydrogen peroxide.

Figure 13:
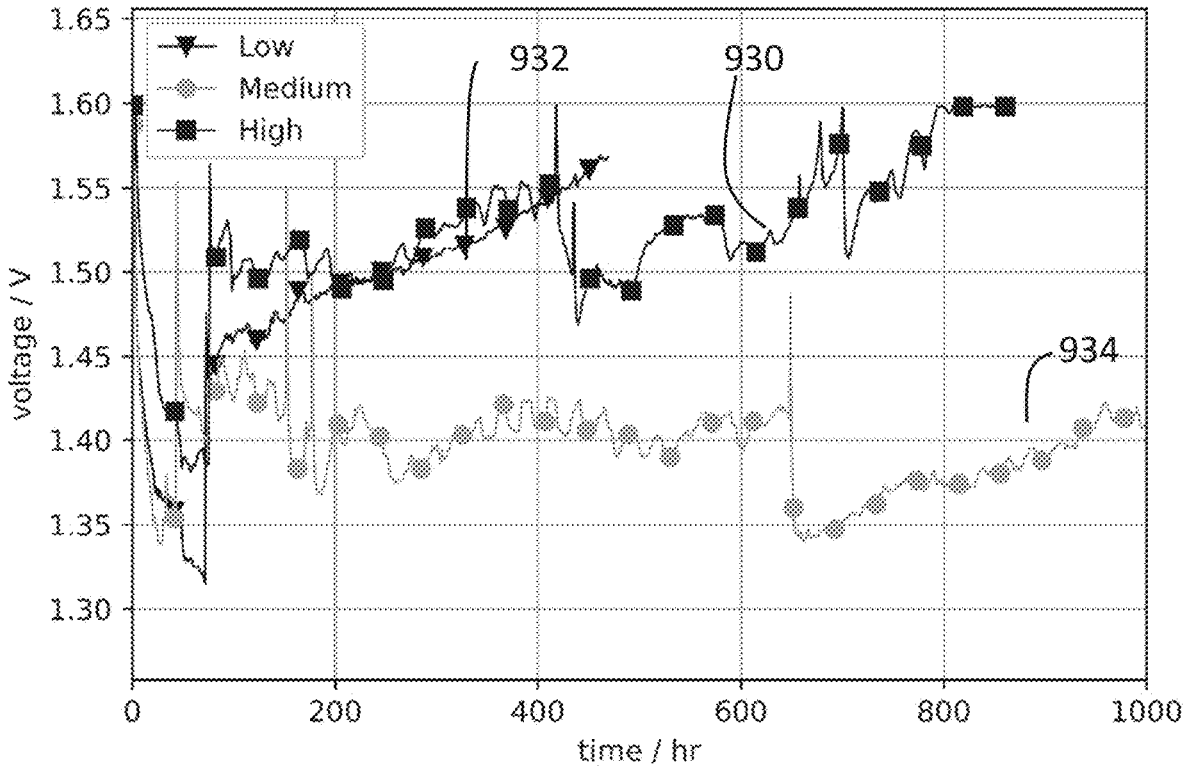
FIG. 13 is a plot of voltage vs time for various electrodes, according to some embodiments.

Three electrodes were prepared for peroxide generation, each prepared using different amounts of PTFE powder in the slurry comprising the active material and PTFE particles. The pretreatment was identical between the three electrodes. The electrodes were otherwise prepared as in Example 4 and then used for peroxide generation. The voltage needed to maintain a current density of 300 mA/cm$^2$ and then 400 mA/cm$^2$ on each electrode is shown in FIG. 13. The electrode having 0.6 mg/cm$^2$ of PTFE 934 performed more efficiently than the electrode with less PTFE powder 932 (0.3 mg/cm$^2$) and the electrode having more PTFE powder 930 (1.9 mg/cm$^2$). This shows the amount of PTFE present in the electrode affects the catalysis, and that too much or too little of the PTFE (e.g., or other hydrophobic polymers) may detract from the efficiency of the catalysis.

Example 8

The following example describes electrodes having different amounts of active material, where each of the electrodes are for forming hydrogen peroxide.

Figure 14:
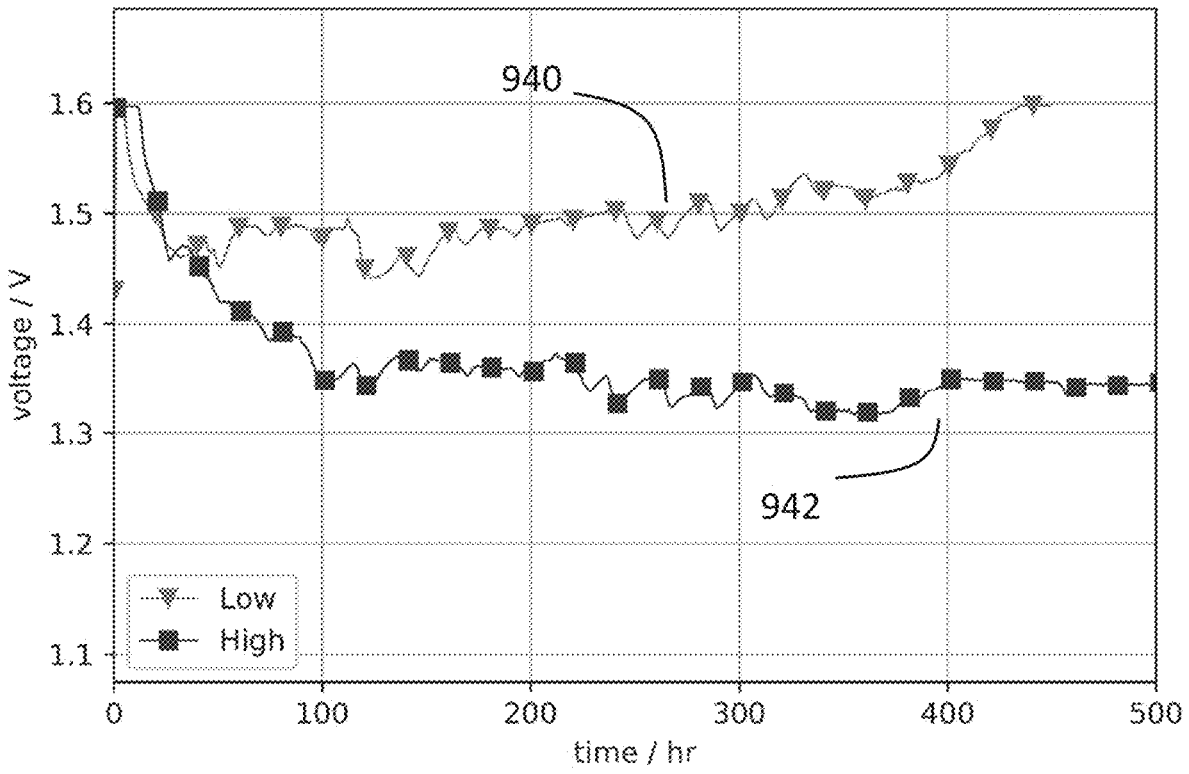
FIG. 14 is a plot of voltage vs time for various electrodes, according to some embodiments.

Two electrodes were prepared for hydrogen peroxide generation, each preparing using different amounts of active material coated on a pretreated electrode. The electrodes were otherwise prepared as in Example 4 and then used for peroxide generation. The voltage needed to maintain a current density of 300 mA/cm$^2$ on each electrode is shown in FIG. 14. The electrode 942 having 3.4 mg/cm$^2$ total active material comprising carbon, PTFE binder, and PTFE powder performed more efficiently than the electrode 940 with 0.85 mg/cm$^2$ total active material. This shows the amount of active material present in the electrode affects the catalysis, and that insufficient loading may detract from the efficiency of the catalysis.

Example 9

The following example describes electrodes having different amounts of hydrophobic particles on the substrate as the pretreatment, where each of the electrodes are for forming hydrogen peroxide.

Figure 15A:
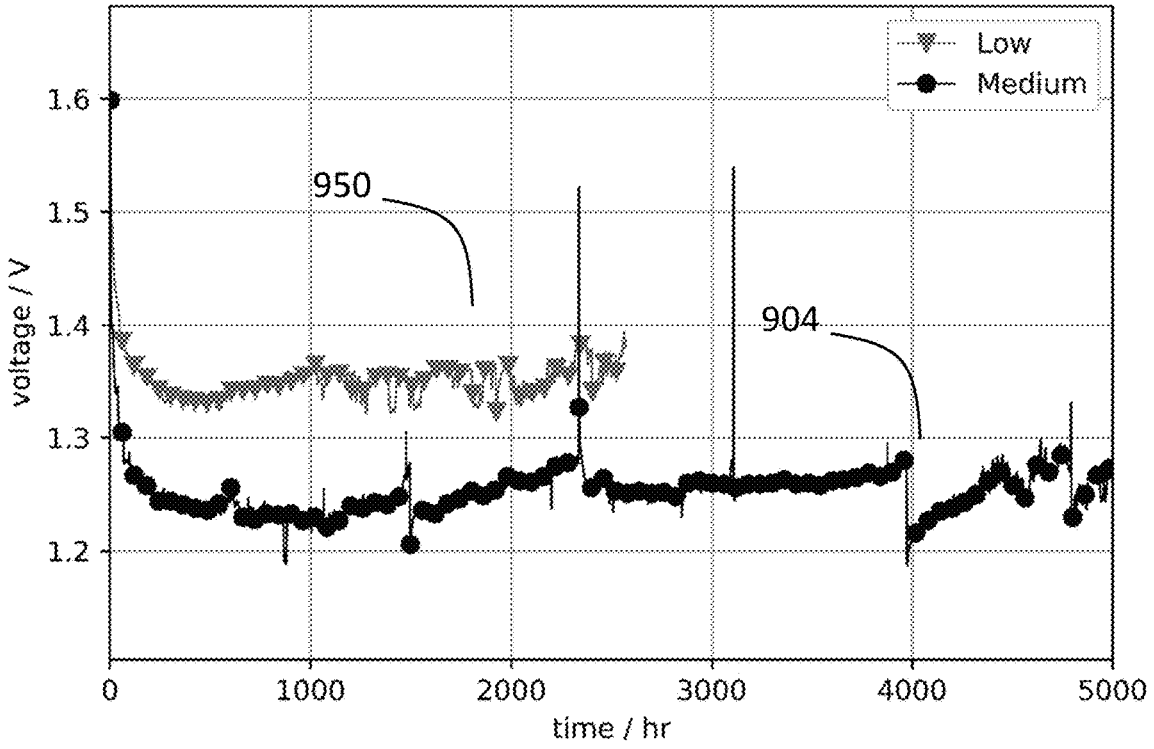
FIGS. 15A-15B are plots of voltage vs time for various electrodes, according to some embodiments.
Figure 15B:
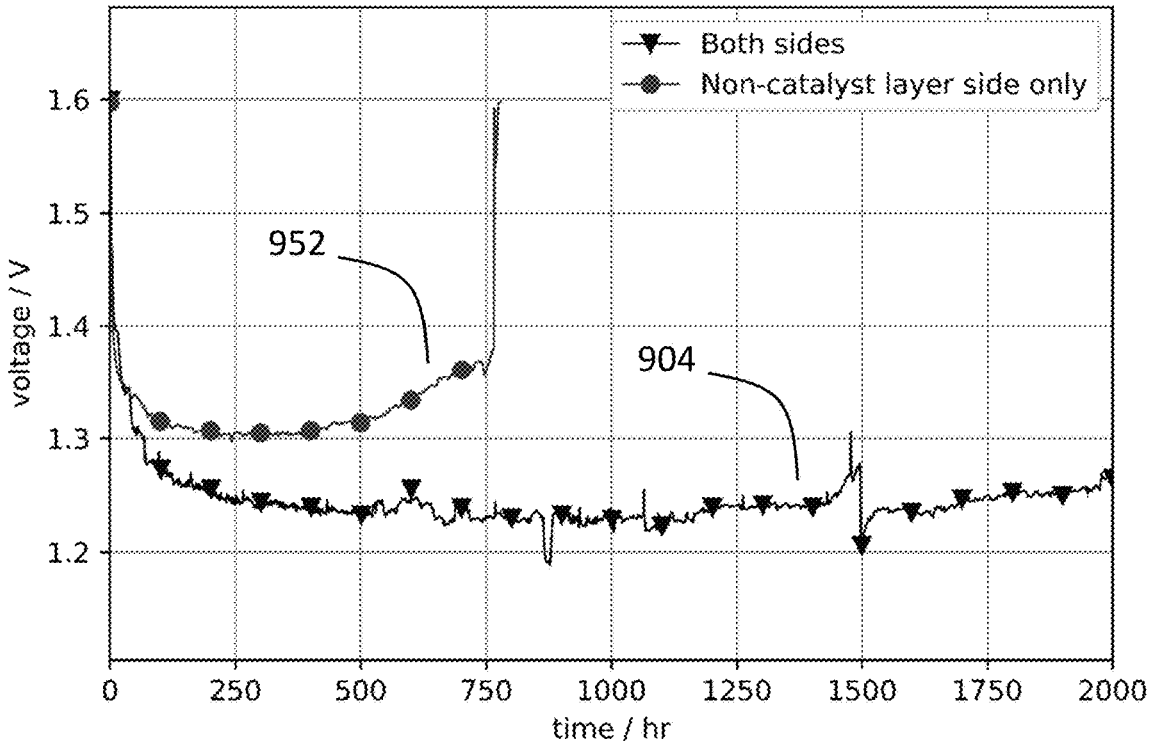

Three electrodes were prepared for hydrogen peroxide generation, each preparing using different amounts of hydrophobic particles coated on a pretreated electrode. The electrodes were otherwise prepared as in Example 4 and then used for peroxide generation. One electrode 904 was formed with medium loading of hydrophobic particles on the substrate at 3 mg/cm$^2$ on both the top and bottom plane of the substrate. Another electrode 950 was formed with low loading of hydrophobic particles on both the top and bottom plane of the substrate at 2 mg/cm$^2$. A third electrode 952 was formed with 4.5 mg/cm$^2$ on only one plane of the substrate opposite the plane where the active material was formed. The voltage needed to maintain a current density of 300 mA/cm$^2$ on each electrode is shown in FIGS. 15A-15B. The electrode 904 having 3.0 mg/cm$^2$ hydrophobic particles on both sides performed more efficiently than the electrode with 2.0 mg/cm$^2$ hydrophobic particles on both sides. The electrode 952 having pretreat on only one of the two planes of the substrate performed worse than electrodes 904 and 952, with voltage increasing before 750 hours of operation This shows that the amount of hydrophobic particles present in the electrode pretreatment affects the catalysis, and that insufficient loading may detract from the efficiency of the catalysis. Furthermore, it shows that the presence of particles may be required on both sides of the substrate. In other words, it is not sufficient to have hydrophobic particles only within the active material that forms the catalyst layer.

Example 10

The following example describes exemplary electrodes 904 and 960 exhibiting long lifetimes, where each of the electrodes are for forming hydrogen peroxide.

Figure 16:
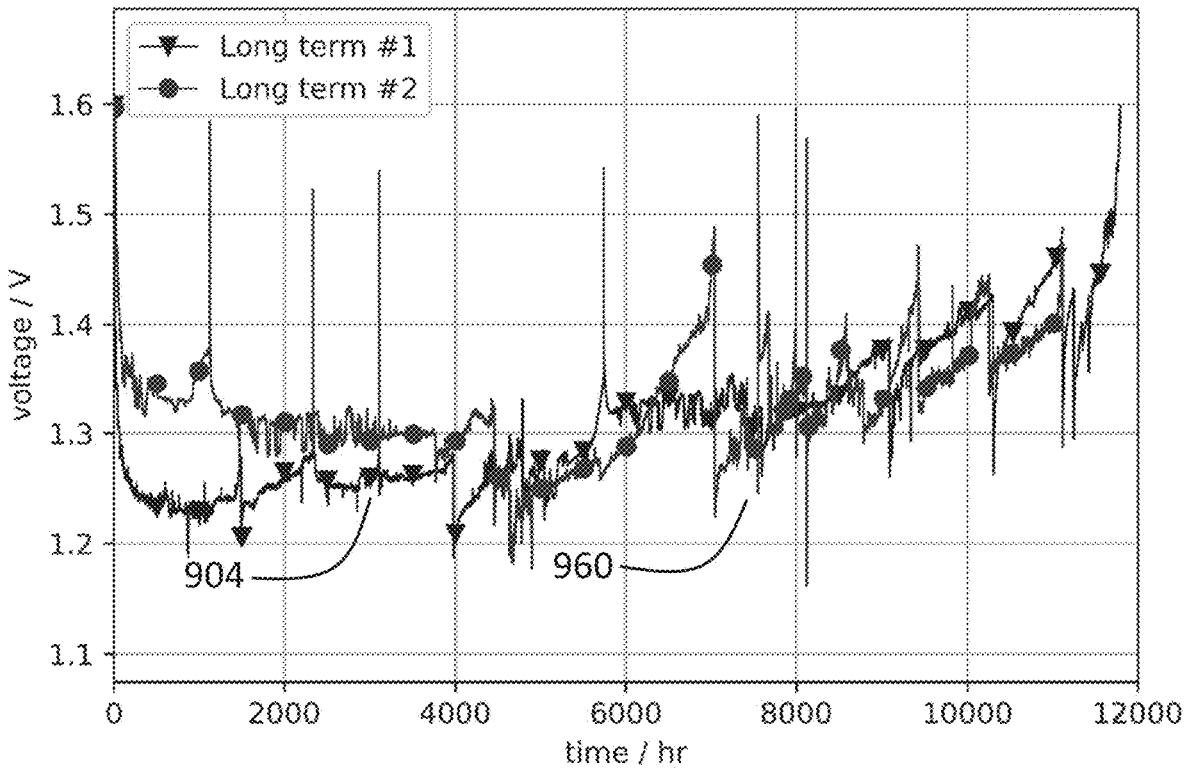
FIG. 16 is a plot of voltage vs time for various electrodes, according to some embodiments.

The electrode 960 was prepared with approximately double the loading of active material as electrode 904 and 50% more hydrophobic particles in the pretreatment. The voltage required to maintain an operating current of 300 mA/cm$^2$ is shown in FIG. 16. The voltage remained below 1.5V for over 10,000 hours for electrodes 904 and 960, and the faradaic efficiency for hydrogen peroxide production remained above 95%.

Example 11

The following example describes an exemplary electrode.

Figure 17:
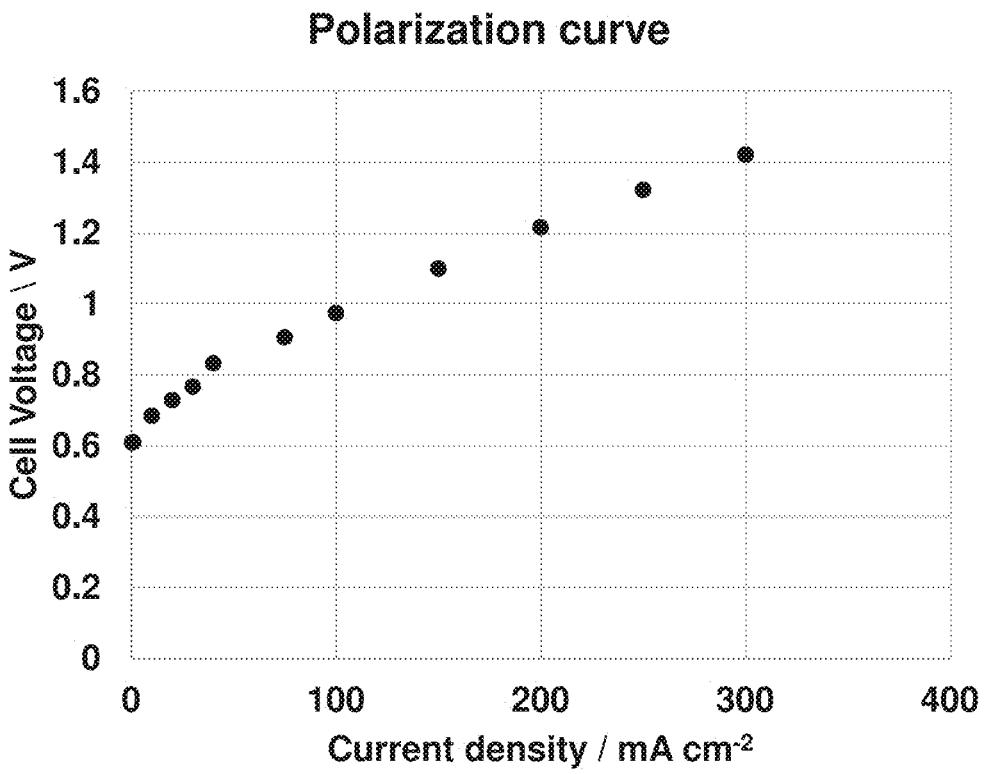
FIG. 17 is an I-V curve of an electrode, according to some embodiments.

The electrode was prepared as in Example 10 and operated over a range of current densities for generating hydrogen peroxide. FIG. 17 shows the results of the experiment. The voltage required for each applied current density is among the lowest reported for electrogeneration of hydrogen peroxide.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present invention.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B," when used in conjunction with open-ended language such as "comprising" can refer, in one embodiment, to A without B (optionally including elements other than B); in another embodiment, to B without A (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

As used herein, "wt %" is an abbreviation of weight percentage.

Some embodiments may be embodied as a method, of which various examples have been described. The acts performed as part of the methods may be ordered in any suitable way. Accordingly, embodiments may be constructed in which acts are performed in an order different than illustrated, which may include different (e.g., more or less) acts than those that are described, and/or that may involve performing some acts simultaneously, even though the acts are shown as being performed sequentially in the embodiments specifically described above.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

In the claims, as well as in the specification above, all transitional phrases such as "comprising," "including," "carrying," "having," "containing," "involving," "holding," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. An electrode, comprising:

a non-woven substrate including fibers comprising carbon;

a first hydrophobic polymer formed on at least a portion of the non-woven substrate, the first hydrophobic polymer comprising polytetrafluoroethylene (PTFE) particles; and a catalyst layer comprising a second hydrophobic polymer and an active material comprising carbon, the second hydrophobic polymer comprising PTFE particles, the active material having a surface area of greater than or equal to 5 $m^2/g$ and less than or equal to 5000 $m^2/g$, the catalyst layer formed on at least a portion of the non-woven substrate and/or the first hydrophobic polymer, wherein a plurality of hydrophobic regions is distributed on at least a portion of the non-woven substrate, wherein the plurality of hydrophobic regions comprises the PTFE particles of the second hydrophobic polymer.

2. The electrode of claim 1, wherein the first and/or the second hydrophobic polymer comprises a PTFE powder and/or PTFE micropowder.

3. The electrode of claim 1, wherein the non-woven substrate has a porosity of at least 0.85.

4. The electrode of claim 1, wherein an average shortest dimension of the non-woven substrate is greater than or equal to 100 microns and less than or equal to 5 mm.

5. The electrode of claim 1, wherein the non-woven substrate comprises elemental carbon.

6. The electrode of claim 1, wherein the non-woven substrate comprises carbon felt.

7. The electrode of claim 1, wherein the average largest cross-sectional dimension of the PTFE particles is no more than 25 microns.

8. The electrode of claim 1, wherein the PTFE particles infiltrate at least 5% of a thickness of the non-woven substrate.

9. The electrode of claim 1, wherein the PTFE particles infiltrate through a thickness of the non-woven substrate.

10. The electrode of claim 1, wherein the first and/or second hydrophobic polymer comprises PTFE from a dispersion and/or emulsion.

11. The electrode of claim 1, wherein the first and/or second hydrophobic polymer comprises a mixture of PTFE powder and/or micropowder and/or PTFE from a dispersion and/or emulsion.

12. An electrode, comprising:

a non-woven substrate including fibers comprising carbon;

a first hydrophobic polymer formed on at least a portion of the non-woven substrate; and a catalyst layer comprising a second hydrophobic polymer and an active material comprising carbon, the catalyst layer formed on at least a portion of the non-woven substrate and/or the first hydrophobic polymer;

wherein a plurality of hydrophobic regions is distributed on at least a portion of the non-woven substrate, wherein the plurality of hydrophobic regions comprises the first hydrophobic polymer and/or the second hydrophobic polymer, and wherein at least a portion of the plurality of hydrophobic regions is at least partially surrounded by a hydrophilic region comprising the active material.

13. A system, comprising the electrode of claim 1, wherein the electrode is configured to electrogenerate hydrogen peroxide.

14. The system of claim 13, wherein the system is configured to operate at a faradaic efficiency for generating hydrogen peroxide of greater than or equal to 95%.

* * * * *